US007215907B2

(12) United States Patent
Fukuchi et al.

(10) Patent No.: US 7,215,907 B2
(45) Date of Patent: May 8, 2007

(54) METHOD AND APPARATUS FOR IMAGE FORMING CAPABLE OF EFFECTIVELY ELIMINATING COLOR DISPLACEMENTS

(75) Inventors: Yutaka Fukuchi, Kanagawa-ken (JP); Kazuosa Kuma, Kanagawa-ken (JP); Makoto Kikura, Kangawa-ken (JP); Yuusuke Noguchi, Kanagawa-ken (JP); Hiroshi Ishii, Kanagawa-ken (JP); Kazuki Suzuki, Saitama-ken (JP); Joh Ebara, Kanagawa-ken (JP); Toshiyuki Uchida, Kanagawa-ken (JP); Noriaki Funamoto, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 265 days.

(21) Appl. No.: 10/884,979

(22) Filed: Jul. 7, 2004

(65) Prior Publication Data

US 2005/0084293 A1 Apr. 21, 2005

(30) Foreign Application Priority Data

| | | |
|---|---|---|
| Jul. 7, 2003 | (JP) | 2003-192821 |
| Dec. 5, 2003 | (JP) | 2003-408291 |
| Apr. 8, 2004 | (JP) | 2004-114714 |

(51) Int. Cl.
*G03G 15/00* (2006.01)

(52) U.S. Cl. ..... 399/167

(58) Field of Classification Search ..... 399/167, 399/66, 297, 301; 318/90–97; 388/842, 388/848

See application file for complete search history.

(56) References Cited

U.S. PATENT DOCUMENTS

| | | | |
|---|---|---|---|
| 5,040,025 | A | 8/1991 | Fukuchi |
| 5,052,336 | A | 10/1991 | Fukuchi |
| 5,055,881 | A | 10/1991 | Fukuchi |

(Continued)

FOREIGN PATENT DOCUMENTS

| | | |
|---|---|---|
| EP | 1 387 221 | 2/2004 |

(Continued)

OTHER PUBLICATIONS

U.S. Appl. No. 11/150,105, filed Jun. 13, 2005, Kuma et al.

(Continued)

*Primary Examiner*—David M. Gray
*Assistant Examiner*—Ryan Gleitz
(74) *Attorney, Agent, or Firm*—Oblon, Spivak, McClelland, Maier & Neustadt, P.C.

(57) ABSTRACT

An image forming apparatus including at least one image bearing member configured to bear a toner image on a surface thereof, and a transferring member arranged close to or in contact with the at least one image bearing member and configured to rotate in substantially synchronism with the at least one image bearing member to transfer the toner image born on the at least one image bearing member onto a recording medium. The apparatus further includes at least one first motor rotating the at least one image bearing member, a second motor rotating the transferring member, and a control mechanism configured to control a rotation number of at least one of the at least one first motor and the second motor during at least one of rise and fall time periods with a command clock signal and a feedback signal in accordance with a predetermined velocity curve.

73 Claims, 31 Drawing Sheets

U.S. PATENT DOCUMENTS

| | | | |
|---|---|---|---|
| 5,124,759 | A | 6/1992 | Fukuchi et al. |
| 5,235,392 | A | 8/1993 | Hediger |
| 5,300,996 | A | 4/1994 | Yokoyama et al. |
| 5,329,340 | A | 7/1994 | Fukuchi et al. |
| 5,689,764 | A | 11/1997 | Fukuchi et al. |
| 5,799,229 | A | 8/1998 | Yokoyama et al. |
| RE36,124 | E | 3/1999 | Yokoyama et al. |
| 5,878,317 | A | 3/1999 | Masuda et al. |
| 5,913,095 | A | 6/1999 | Takashima et al. |
| 5,946,529 | A | 8/1999 | Sato et al. |
| 6,128,451 | A | 10/2000 | Fukuchi |
| 6,181,899 | B1 | 1/2001 | Fukuchi |
| 6,385,418 | B1 | 5/2002 | Fukuchi |
| 6,576,177 | B2 | 6/2003 | Fukuchi |
| 6,647,223 | B2 | 11/2003 | Ishii |
| 6,725,991 | B2 | 4/2004 | Murano et al. |
| 6,779,975 | B2 | 8/2004 | Takashima et al. |
| 2002/0003968 | A1 | 1/2002 | Marujama |
| 2003/0085508 | A1 | 5/2003 | Fukuchi |
| 2003/0194466 | A1 | 10/2003 | Fukuchi |
| 2003/0231364 | A1 | 12/2003 | Shoji et al. |
| 2004/0000753 | A1 | 1/2004 | Fukuchi |
| 2004/0052560 | A1 | 3/2004 | Ishii et al. |
| 2004/0126139 | A1 | 7/2004 | Yoshizawa et al. |
| 2004/0126150 | A1 | 7/2004 | Noguchi et al. |
| 2004/0131381 | A1 | 7/2004 | Kawasumi et al. |

FOREIGN PATENT DOCUMENTS

| | | | | |
|---|---|---|---|---|
| JP | 11285292 | A | * | 10/1999 |
| JP | 2002-131091 | | | 5/2002 |
| JP | 2002-311672 | | | 10/2002 |
| JP | 2003091128 | A | * | 3/2003 |

OTHER PUBLICATIONS

U.S. Appl. No. 11/227,517, filed Sep. 16, 2005, Ebara et al.
U.S. Appl. No. 11/247,269, filed Oct. 12, 2005, Uchiyama et al.
U.S. Appl. No. 11/280,353, filed Nov. 17, 2005, Ishii.
U.S. Appl. No. 11/342,724, filed Jan. 31, 2006, Funamoto et al.
U.S. Appl. No. 11/377,568, filed Mar. 17, 2006, Katoh et al.
U.S. Appl. No. 11/500,306, filed Aug. 8, 2006, Funamoto.

* cited by examiner

METHOD AND APPARATUS FOR IMAGE FORMING CAPABLE OF EFFECTIVELY ELIMINATING COLOR DISPLACEMENTS

CROSS REFERENCE TO RELATED APPLICATIONS

The present application claims priority under 35 U.S.C. § 119 to Japanese Patent Applications No. 2003-192821 filed on Jul. 7, 2003, No. 2003-408291 filed on Dec. 5, 2003, and No. 2004-114717 filed on Apr. 8, 2004 in the Japanese Patent Office, the entire contents of which are incorporated herein by reference.

BACKGROUND OF THE INVENTION

1. Field of the Invention

The present invention relates to an image forming method and apparatus, and more particularly to a method and apparatus for image forming capable of effectively eliminating color displacement by controlling a clock control motor controlled by a command clock signal and a feedback signal, in accordance with a velocity curve.

2. Discussion of the Background

Background image forming apparatuses are commonly known as electrophotographic copying machines, printing machines, facsimile machines, and multi-functional apparatuses having at least two functions of copying, printing and facsimile functions. Some of the background apparatuses use an intermediate transfer method, and some use a direct transfer method.

The background image forming apparatus using the intermediate transfer method is referred to as an "intermediate transfer image forming apparatus", and transfers an electrostatic latent image formed on a photoconductor onto an intermediate transfer member before transferring the electrostatic latent image onto a recording medium.

The background image forming apparatus using the direct transfer method is referred to as a "direct transfer image forming apparatus", and directly transfers the electrostatic latent image onto the recording medium which is conveyed by a recording medium bearing member.

In both background image forming apparatuses, the photoconductor is driven by a photoconductor motor to rotate, and the intermediate transfer member and the recording medium bearing member are driven by a drive motor to rotate.

The photoconductor and the intermediate transfer member rotate while they are held in contact to each other, a surface linear velocity of the photoconductor is required to have the same rate as that of the intermediate transfer member. In a case where the photoconductor rotates at a different rate from the intermediate transfer member, a surface of the photoconductor rubs a surface of the intermediate transfer member, hastening their surface wear.

To prevent the wearing of the surfaces, the intermediate transfer image forming apparatus has employed a stepping motor as the photoconductor motor and the drive motor for controlling the number of input pulses of the stepping motor to synchronize the surface linear velocities of the photoconductor and the intermediate transfer member. Also, the direct transfer image forming apparatus has employed the stopping motor for synchronizing the surface linear velocities of the photoconductor and the recording medium bearing member.

The stepping motor, however, generally consumes a large amount of electric power and produces a loud noise. Therefore, a clock control motor such as a direct current (DC) brushless motor is used as an alternative to the stepping motor. The DC brushless motor is controlled by a command clock signal and a feedback signal, and can reduce the power consumption and the loud noise.

The DC brushless motor, however, may vary its rotation speed particularly when it is started and stopped. In a case where the DC brushless motor is used as the photoconductor motor and the drive motor, the surface linear velocity of the photoconductor may be greatly different from that of the intermediate transfer member or that of the recording medium bearing member, which results in significant wear that shortens its life. Consequently, the DC brushless motor has been thought to be unsuitable for the background image forming apparatus.

FIG. 1 shows an example of the command clock signal of the DC brushless motor. The rotation of the DC brushless motor is controlled by the command clock signal having a predetermined number of clock pulses, as shown in FIG. 1, and the feedback signal output from the DC brushless motor.

FIG. 2 shows an example of the surface linear velocities of the photoconductor and the intermediate transfer member when the DC brushless motors are started. The DC brushless motor works as the photoconductor motor which rotates the photoconductor and the drive motor which rotates the intermediate transfer member. The solid line represents the surface linear velocity of the photoconductor, and the alternate long and short dash line represents the surface linear velocity of the intermediate transfer member. The photoconductor motor and the drive motor are controlled by a command clock signal same as the command clock signal shown in FIG. 1. However, when DC brushless motor is started, a significant difference between the surface linear velocity of the photoconductor and the surface linear velocity of the intermediate transfer member may be caused due to a property of the DC brushless motor, loads applied to the photoconductor and the intermediate transfer member, and the difference of the inertias of the photoconductor, as shown in FIG. 2.

FIG. 3 shows a graph of the command clock signal when the DC brushless motor is stopped, and FIG. 4 shows a graph of the surface linear velocity of the photoconductor and the intermediate transfer member when the DC brushless motor is stopped.

When a motor stop signal is issued to stop inputting the command clock signal to the photoconductor motor and the drive motor as shown in FIG. 3, the surface linear velocities of the photoconductor and the intermediate transfer member driven by the DC brushless motor start to decrease down to a level, as shown in FIG. 4, at which the photoconductor and the intermediate transfer member stop as shown in FIG. 4. At this time, a significant difference between the surface linear velocity of the photoconductor and the surface linear velocity of the intermediate transfer member may also be caused due to a property of the DC brushless motor, loads applied to the photoconductor and the intermediate transfer member, and the difference of the inertias of the photoconductor, as indicated by the solid line and the alternate long and short dash line shown in FIG. 4.

As described above, the significant difference between the surface linear velocity of the photoconductor and the surface linear velocity of the intermediate transfer member may cause damages such as scratches on the surfaces thereof and defects such as streaks on an image, resulting in a deterioration of the image. The defects may be observed when the DC brushless motor is used as the drive motor for the recording medium bearing member. Due to the drawbacks as described above, the stepping motor has preferably been used, without solving the problems of high power consumption and loud noise.

SUMMARY OF THE INVENTION

The present invention has been made under the above-described circumstances.

An object of the present invention is to provide a novel image forming apparatus which can control a clock control motor controlled by a command clock signal and a feedback signal, in accordance with the velocity curve.

In one exemplary embodiment, a novel image forming apparatus includes at least one image bearing member, a transferring member, at least one first motor, a second motor, and a control mechanism. The at least one image bearing member is configured to bear a toner image on a surface thereof. The transferring member is arranged close to or in contact with the at least one image bearing member and is configured to rotate in substantially synchronism with the at least one image bearing member to transfer the toner image born on the at least one image bearing member onto a recording medium. The at least one first motor rotates the at least one image bearing member. The second motor rotates the transferring member. The control mechanism is configured to control a rotation number of at least one of the at least one first motor and the second motor during at least one of rise and fall time periods with a command clock signal and a feedback signal in accordance with a predetermined velocity curve.

A novel image forming apparatus includes at least one image bearing member, an intermediate transfer member, a third motor, a fourth motor, a transfer mechanism, and a control mechanism. The at least one image bearing member is configured to bear a toner image on a surface thereof. The intermediate transfer member is configured to receive the toner image from the at least one image bearing member. The third motor rotates the at least one image bearing member. The fourth motor rotates the intermediate transfer member. The transfer mechanism is configured to transfer the toner image from the intermediate transfer member to a recording medium. The control mechanism is configured to control rotations of the third and fourth motors. At least one of the third and fourth motors includes a clock control motor controlled by a command clock signal and a feedback signal. The control mechanism controls a rotation number of the clock control motor in accordance with a predetermined velocity curve during at least one of rise and fall time periods of the clock control motor.

The third motor may include the clock control motor, and the fourth motor may include a stepping motor.

Each of the third and fourth motors may include the clock control motor.

The clock control motor may be controlled to be rotated by the command clock signal having the clock number in accordance with the predetermined velocity curve during the at least one of rise and fall time periods of the clock control motor.

The clock control motor may be controlled to be rotated by the command clock signal having a gradually increasing pulse number during the rise time period, having a substantially constant pulse number during a steady rotation time period, and having a gradually decreasing pulse number during the fall time period.

The image forming apparatus may further include a braking mechanism configured to forcedly reduce a rotation number of the clock control motor during the fall time period of the clock control motor.

The rotation number of the clock control motor may be controlled by changing a pulse number of the command clock signal in steps during the at least one of rise and fall time periods of the clock control motor.

The predetermined velocity curve may be stored in a memory and may be changed by controlling an operation panel of the image forming apparatus or a connecting terminal of the image forming apparatus.

The clock control motor may include a direct current brushless motor.

A novel image forming method includes the steps of driving an image bearing member with a primary driving member, driving an overlaying member with a secondary driving member, forming a toner image on the image bearing member, moving the toner image with the image bearing member to a primary transfer position, overlaying at least one toner image formed on the bearing member into a single toner image at the primary transfer position, transporting the single toner image to a secondary transfer position, transferring the single toner image transported to the secondary transfer position by the transporting step onto a recording medium, and controlling a rotation number of at least one of the primary and secondary driving members with a command clock signal and a feedback signal in accordance with a predetermined velocity curve.

The controlling step may control the rotation number of the at least one of the primary and secondary driving members during at least one of rise and fall time periods with the command clock signal and the feedback signal in accordance with the predetermined velocity curve.

A novel image forming apparatus includes at least one image bearing member, a recording medium bearing member, a fifth motor, a sixth motor, a transfer mechanism, and a control mechanism. The at least one image bearing member is configured to bear a toner image on a surface thereof. The recording medium bearing member is configured to carry a recording medium to receive the toner image from the at least one image bearing member. The fifth motor rotates the at least one image bearing member. The sixth motor rotates the recording medium bearing member. The transfer mechanism is configured to transfer the toner image from the image bearing member to a recording medium. The control mechanism is configured to control rotations of the fifth and sixth motors. At least one of the fifth and sixth motors includes a clock control motor controlled by a command clock signal and a feedback signal. The control mechanism controls a rotation number of the clock control motor in accordance with a predetermined velocity curve during at least one of rise and fall time periods of the clock control motor.

The fifth motor may include the clock control motor, and the sixth motor includes a stepping motor.

Each of the fifth and sixth motors may include the clock control motor.

The clock control motor may be controlled to be rotated by the command clock signal having the clock number in accordance with the predetermined velocity curve during the at least one of the rise and fall time periods of the clock control motor.

The clock control motor may be controlled to be rotated by the command clock signal having a gradually increasing pulse number during the rise time period, having a substantially constant pulse number during a steady rotation time period, and having a gradually decreasing pulse number during the fall time period.

The novel image forming apparatus may further include a braking mechanism configured to forcedly reduce a rotation number of the clock control motor during the fall time period of the clock control motor.

The rotation number of the clock control motor may be controlled by changing a pulse number of the command clock signal in steps during the at least one of the rise and fall time periods of the clock control motor.

The predetermined velocity curve may be stored in a memory and can be changed by controlling an operation panel of the image forming apparatus or a connecting terminal of the image forming apparatus.

The clock control motor may include a direct current brushless motor.

A novel image forming method includes the steps of energizing an image bearing member with a primary driving member, driving an overlaying member with a secondary driving member, forming a toner image on the image bearing member, moving the toner image with the image bearing member to a transfer position, transferring at least one toner image formed on the bearing member onto the recording sheet driven by the driving step in a single overlaid toner image at the transfer position, and controlling a rotation number of at least one of the primary and secondary driving members with a command clock signal and a feedback signal in accordance with a predetermined velocity curve.

A novel image forming apparatus includes a plurality of color image bearing members, a monochrome image bearing member, an intermediate transfer member, a first gear, a second gear, a seventh motor, an eighth motor, a ninth motor, a transfer mechanism, and a control mechanism. The plurality of color image bearing members have surfaces to bear a plurality of color toner images. The monochrome image bearing member has a surface to bear a monochrome toner image. The intermediate transfer member is configured to receive the plurality of color toner images from the plurality of color image bearing members and the monochrome toner image from the monochrome image bearing member. The first gear is coupled with at least one of the plurality of color image bearing members. The plurality of a second gear coupled with the monochrome image bearing member. The seventh motor includes the clock control motor rotating the at least one of the plurality of color image bearing members via the first gear. The eighth motor includes the clock control motor rotating the monochrome image bearing member via the second gear. The ninth motor rotates the intermediate transfer member. The transfer mechanism is configured to transfer the toner image from the intermediate transfer member to a recording medium. And, the control mechanism is configured to control rotations of the seventh, eighth and ninth motors. The control mechanism controls rotation numbers of the clock control motors during at least one of rise and fall time periods in accordance with a predetermined velocity curve.

A rotation number of at least one of the clock control motors of the seventh and eighth motors may be controlled to be changed to set positions of the first and second gears to have a predetermined phase relationship therebetween, after completion of the rise time periods of the seventh and eighth motors and before start of a subsequent image forming operation.

The control mechanism may have a plurality of operation modes which are selectable and bi-directionally switchable without stopping the eighth and ninth motors. The plurality of operation modes may include a color mode and a monochrome mode. The color mode has a function of producing a full-color image by sequentially overlaying the plurality of color toner images formed on the surfaces of the plurality of color image bearing members and the monochrome toner image formed on the surface of the monochrome image bearing member onto the intermediate transfer member, and onto the recording medium. The monochrome mode has a function of producing a monochrome image by stopping rotations of the plurality of color image bearing members, separating the intermediate transfer member from the plurality of color image bearing members, rotating the monochrome image bearing member, and transferring the monochrome toner image onto the intermediate transfer member, and onto the recording medium.

A rotation number of the at least one of the clock control motors of the seventh and eighth motors may be controlled to be changed to set positions of the first and second gears to have a predetermined phase relationship therebetween, before the subsequent image forming operation starts in the color mode which is previously switched from the monochrome mode.

The control mechanism may have a plurality of switchable surface linear velocities and a plurality of speed modes. The plurality of switchable surface linear velocities may include a first surface linear velocity, and a second surface linear velocity which is slower than the first surface linear velocity, The plurality of speed modes may include a full speed color mode, a low speed color mode, a full speed monochrome mode, and a low speed monochrome mode. The full speed color mode may have a function of rotating the plurality of color image bearing members, the monochrome image bearing member and the intermediate transfer member at the first surface linear velocity in the color mode. The full speed monochrome mode may have a function of rotating the monochrome image bearing member and the intermediate transfer member at the first surface linear velocity in the monochrome mode. The low speed color mode may have a function of rotating the plurality of color image bearing members, the monochrome image bearing member and the intermediate transfer member at the second surface linear velocity in the color mode. The low speed monochrome mode may have a function of rotating the monochrome image bearing member and the intermediate transfer member at the second surface linear velocity in the monochrome mode. The rotation number of the at least one of the clock control motors of the seventh and eighth motors is controlled to be changed to set positions of the first and second gears to have a predetermined phase relationship therebetween, before the subsequent image forming operation starts in one of the full speed color mode and the low speed color mode which is previously changed from different one of the full speed color mode, the low speed color mode, the full speed monochrome mode and the low speed monochrome mode.

The novel image forming apparatus may further include a first sensor and a second sensor. The first sensor is configured to detect a first position of the first gear in a circumferential direction of the first gear. The second sensor is configured to detect a second position of the second gear in a circumferential direction of the second gear. A rotation number of at least one the clock control motors of the seventh and eight motors may be controlled in accordance with a detection time difference between a first time period in which the first sensor detects the first position and a second time period in which the second sensor detects the second position, when the predetermined phase relationship between the first and second gears is adjusted.

The novel image forming apparatus may further include a third sensor, a fourth sensor and a second sensor. The third sensor is configured to detect a third position of the first gear in a circumferential direction of the first gear. The fourth sensor is configured to detect a fourth position of the second gear in a circumferential direction of the second gear. A rotation number of at least one of the clock control motors of the seventh and eight motors may be controlled in accordance with a value obtained by adding a predetermined correction value to a detection time difference between a third time period in which the third sensor detects the third position and a fourth time period in which the fourth sensor detects the fourth position, when the predetermined phase relationship between the first and second gears is adjusted.

The novel image forming apparatus may further include a third sensor and a fourth sensor. The third sensor may be configured to detect a third position of the first gear in a circumferential direction of the first gear. The fourth sensor may be configured to detect a fourth position of the second gear in a circumferential direction of the second gear. A rotation number of at least one of the clock control motors of the seventh and eight motors may be controlled in accordance with a value obtained by adding a predetermined correction value to a detection time difference between a third time period in which the third sensor detects the third position and a fourth time period in which the fourth sensor detects the fourth position, when the predetermined phase relationship between the first and second gears is adjusted.

A rotation number of at least one of the clock control motors of the tenth and eleventh motors may be controlled to be changed to set positions of the third and fourth gears to have a predetermined phase relationship, after completion of the rise time period of the tenth and eleventh motors and before start of a subsequent image forming operation.

The control mechanism may have a plurality of operation modes which are selectable and bi-directionally switchable without stopping the eleventh and twelfth motors. The plurality of operation modes may include a color mode and a monochrome mode. The color mode may have a function of producing a full-color image by sequentially overlaying the plurality of color toner images formed on the surfaces of the plurality of color image bearing members and the monochrome toner image formed on the surface of the monochrome image bearing member onto the recording medium carried by the recording medium bearing member. The monochrome mode may have a function of producing a monochrome image by stopping rotations of the plurality of color image bearing members, separating the recording medium bearing member from the plurality of color image bearing members, rotating the monochrome image bearing member, and transferring the monochrome toner image onto the recording medium carried by the recording medium bearing member.

A rotation number of the at least one of the clock control motors of the tenth and eleventh motors may be controlled to be changed to set positions of the third and fourth gears to have a predetermined phase relationship, before the subsequent image forming operation starts in the color mode which is previously switched from the monochrome mode.

The control mechanism may have a plurality of switchable surface linear velocities and a plurality of speed modes. The plurality of switchable surface linear velocities may include a third surface linear velocity, and a fourth surface linear velocity which is slower than the third surface linear velocity. The plurality of speed modes may include a full speed color mode, a low speed color mode, a full speed monochrome mode, and a low speed monochrome mode. The full speed color mode may have a function of rotating the plurality of color image bearing members, the monochrome image bearing member and the recording medium bearing member at the third surface linear velocity in the color mode. The full speed monochrome mode may have a function of rotating the monochrome image bearing member and the recording medium bearing member at the third surface linear velocity in the monochrome mode. The low speed color mode may have a function of rotating the plurality of color image bearing members, the monochrome image bearing member and the recording medium bearing member at the fourth surface linear velocity in the color mode. The low speed monochrome mode may have a function of rotating the monochrome image bearing member and the recording medium bearing member at the fourth surface linear velocity in the monochrome mode. A rotation number of the at least one of the clock control motors of the tenth and eleventh motors may be controlled to be changed to set positions of the third and fourth gears to have a predetermined phase relationship, before the subsequent image forming operation starts in one of the full speed color mode and the low speed color mode which is previously changed from different one of the full speed color mode, the low speed color mode, the full speed monochrome mode and the low speed monochrome mode.

The novel image forming apparatus further include a fifth sensor and a sixth sensor. The fifth sensor may be configured to detect a fifth position of the third gear in a circumferential direction of the third gear. The sixth sensor may be configured to detect a sixth position of the fourth gear in a circumferential direction of the fourth gear. A rotation number of at least one of the clock control motors of the tenth and eleventh motors may be controlled in accordance with a detection time difference between a fifth time period in which the fifth sensor detects the fifth position and a sixth time period in which the sixth sensor detects the sixth position, when the predetermined phase relationship between the third and fourth gears is adjusted.

The novel image forming apparatus may further include a seventh sensor and an eighth sensor. The seventh sensor may be configured to detect a seventh position of the third gear in a circumferential direction of the third gear. The eighth sensor may be configured to detect an eighth position of the fourth gear in a circumferential direction of the fourth gear. A rotation number of at least one of the clock control motors of the tenth and eleventh motors may be controlled in accordance with a value obtained by adding a predetermined correction value to a detection time difference between a seventh time period in which the seventh sensor detects the seventh position and an eighth time period in which the eighth sensor detects the eighth position, when the predetermined phase relationship between the third and fourth gears is adjusted.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
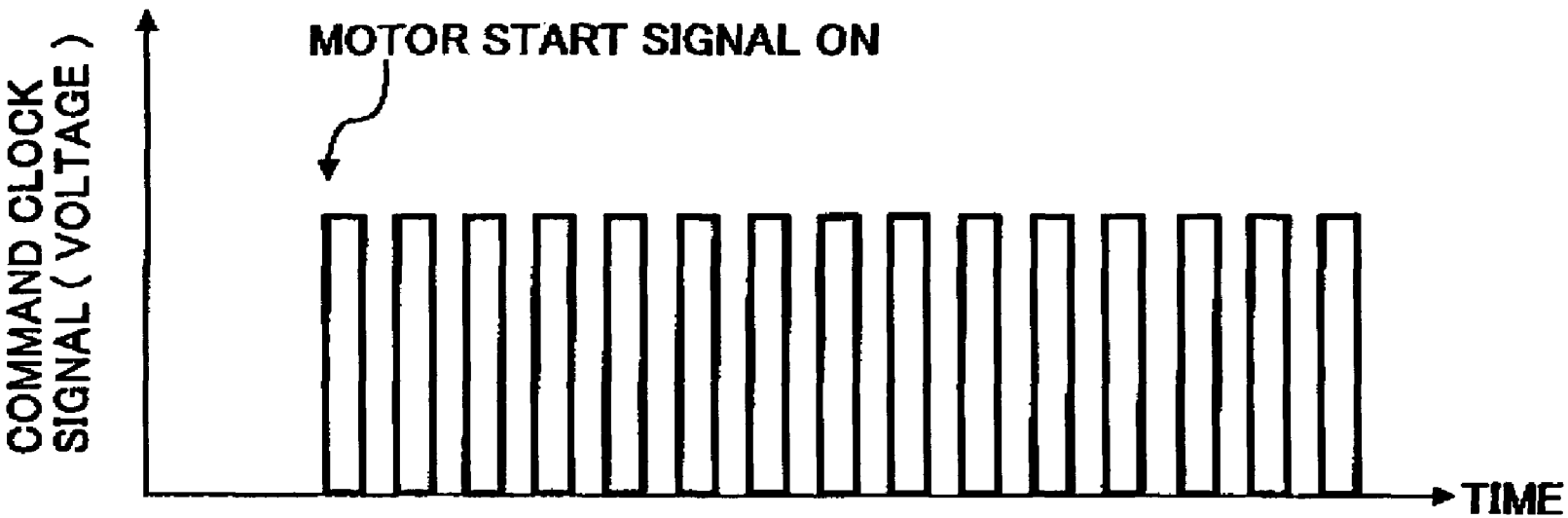
FIG. 1 PRIOR ART
FIG. 1 is a graph showing a command clock signal at a start of a DC brushless motor used in a background image forming apparatus.
Figure 2:
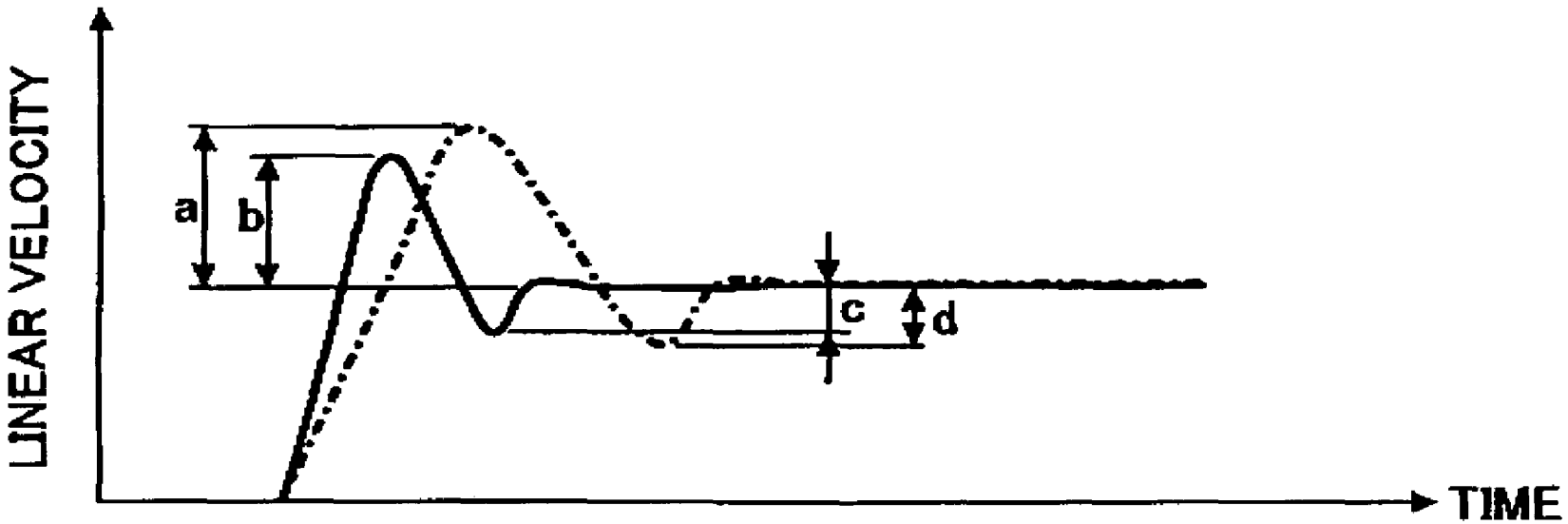
FIG. 2 PRIOR ART
FIG. 2 is a graph showing surface linear velocities at the start of a photoconductor and an intermediate transfer member driven by the DC brushless motor of FIG. 1.
Figure 3:
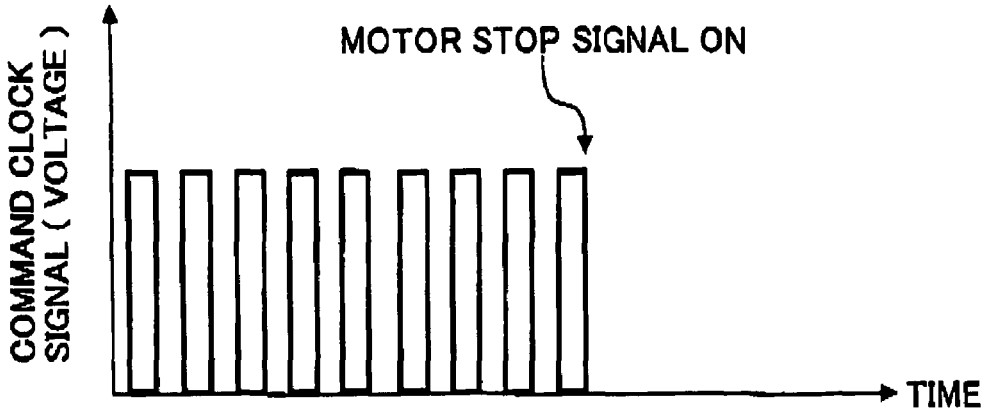
FIG. 3 PRIOR ART
FIG. 3 is a graph showing a command clock signal at a stop of the DC brushless motor.
Figure 4:
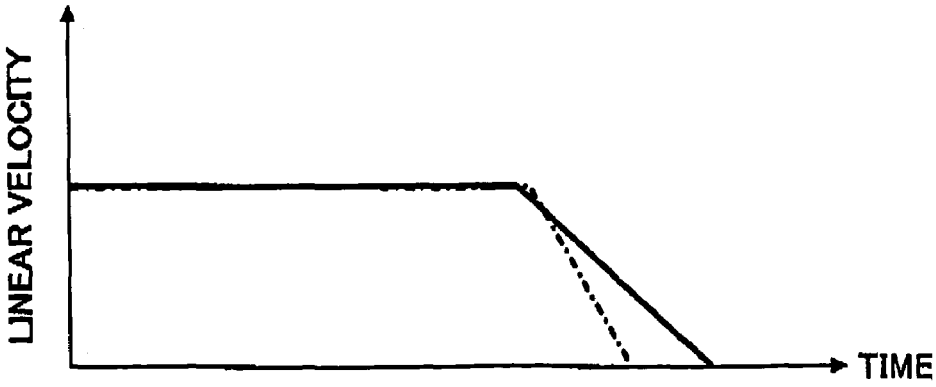
FIG. 4 PRIOR ART
FIG. 4 is a graph showing surface linear velocities at the stop of the photoconductor and the intermediate transfer member driven by the DC brushless motor of FIG. 3.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Figure 5:
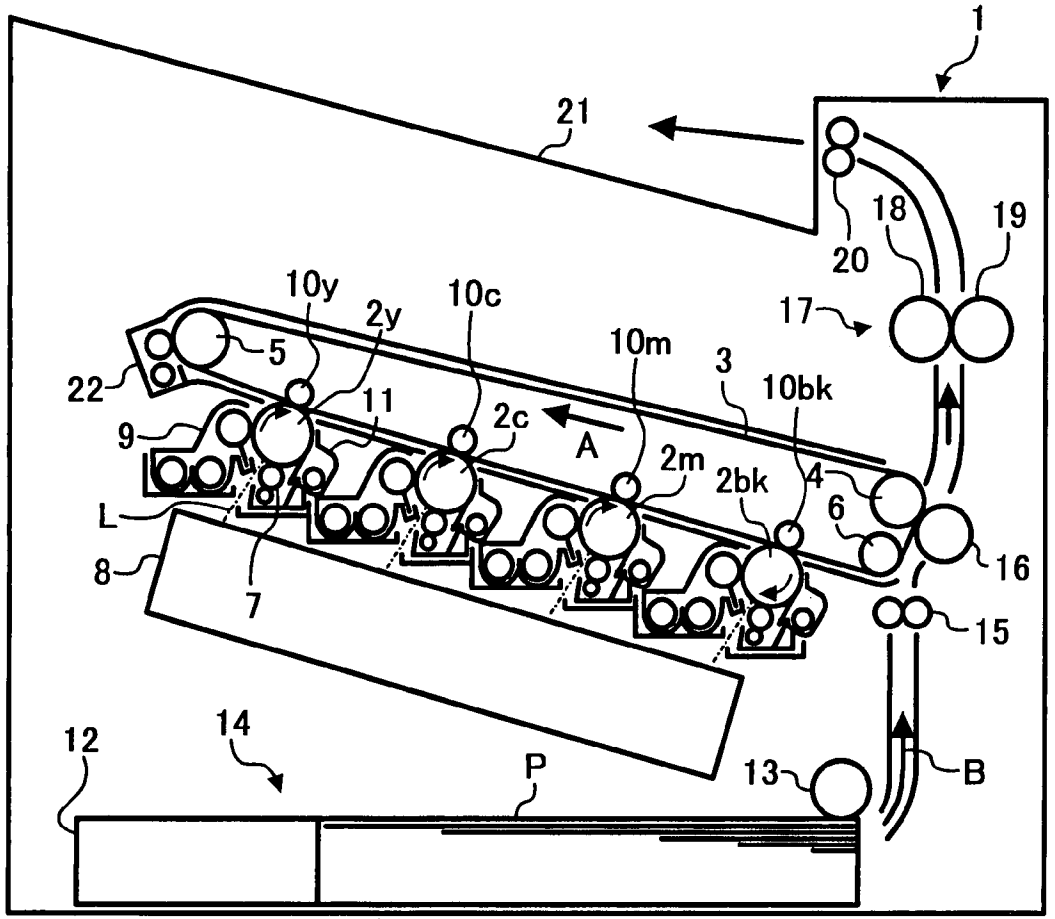
FIG. 5 is a drawing of a schematic structure of an image forming apparatus provided with an intermediate transfer member according to an exemplary embodiment of the present invention when the image forming apparatus is in a color mode.

FIG. 5 shows a schematic cross sectional view of an image forming apparatus 1. The image forming apparatus 1 of FIG. 5 is a printer using an intermediate transfer method. The image forming apparatus 1 includes four photoconductors 2*y*, 2*c*, 2*m* and 2*bk*, and an intermediate transfer member 3. The photoconductors 2*y*, 2*c*, 2*m* and 2*bk* are in a cylindrical shape, and have an outer diameter. The intermediate transfer member 3 forms an endless belt extended with supporting rollers 4, 5, and 6. The photoconductors 2*y*, 2*c*, 2*m* and 2*bk* have surfaces that are held in contact with a surface of the intermediate transfer member 3 when the photoconductors 2*y*, 2*c*, 2*m* and 2*bk* are activated for image forming. The photoconductors 2*y*, 2*c*, 2*m* and 2*bk* are driven by a photoconductor motor, which will be described below, in a direction indicated by arrows in FIG. 5. The intermediate transfer member 3 is rotated by a drive motor, which will also be described below, in a direction A, indicated by an arrow in FIG. 5.

As described above, the photoconductors 2*y*, 2*c*, 2*m* and 2*bk* are held in contact with the intermediate transfer member 3, and are rotated in a same direction that the intermediate transfer member 3 travels in FIG. 5. Since the photoconductors 2*y*, 2*c*, 2*m* and 2*bk* have structures and functions similar to each other, except that the toners contained therein are of different colors, the discussion below with respect to FIGS. 6–9 and 33 uses reference numerals for specifying components of the image forming apparatus 1 without suffixes of colors such as y, c, m and bk. In other words, the photoconductor 2 of FIG. 6, for example, can be any one of the photoconductors 2*y*, 2*c*, 2*m* and 2*bk*.

The photoconductor 2 has image forming components for forming an image around it. A charging unit including a charging roller 7 is applied with a charged voltage. When the photoconductor 2 is driven to rotate clockwise in FIG. 5, the charging unit applies the charged voltage to the photoconductor 2 to uniformly charge the surface of the photoconductor 2 to a predetermined polarity. An optical writing unit 8 emits a laser beam L, which is optically modulated. The laser beam L irradiates the photoconductor 2 so that an electrostatic latent image is formed on the charged surface of the photoconductor 2. A developing unit 9 visualizes the electrostatic latent image formed on the surface of the photoconductor 2 as a single color toner image. Thus, the toner image is formed on the surface of the photoconductor 2.

The intermediate transfer member 3 is held in contact with a primary transfer roller 10 (namely 10*y*, 10*c*, 10*m*, and 10*bk*) corresponding to the photoconductor 2. The primary transfer roller 10 is disposed opposite to the photoconductor 2, sandwiching the intermediate transfer member 3. The primary transfer roller 10 receives a transfer voltage to transfer the color toner image onto the surface of the intermediate transfer member 3 which is rotated in the direction A. After the toner image formed on the surface of the photoconductor 2 is transferred onto the surface of the intermediate transfer member 3, a cleaning unit 11 removes residual toner on the surface of the photoconductor 2.

Through the operations similar to those as described above, yellow, cyan, magenta and black images are formed on the surfaces of the respective photoconductors 2*y*, 2*c*, 2*m* and 2*bk*. Those color toner images are sequentially overlaid on the surface of the intermediate transfer member 3, such that a full-color toner image is formed on the surface of the intermediate transfer member 3.

In FIG. 5, a sheet feeding unit 14 is provided at a lower portion of the image forming apparatus 1. The sheet feeding unit 14 includes a sheet feeding cassette 12 and a sheet feeding roller 13. The sheet feeding cassette 12 accommodates a plurality of recording media such as transfer sheets and resin sheets that include a recording medium P. When the sheet feeding roller 13 is rotated by a drive motor (not shown), the recording medium P placed on the top of a stack of transfer sheets in the sheet feeding cassette 12 is fed and conveyed in a direction B in FIG. 5. The recording medium P is conveyed to a portion between rollers of a registration roller pair 15. The registration roller pair 15 stops and feeds the recording medium P in synchronization with a movement of the full-color toner image towards a portion between the supporting roller 4 held in contact with the intermediate transfer member 3 and a secondary transfer unit including a secondary transfer roller 16. At this time, the secondary transfer roller 16 is applied with an adequate predetermined transfer voltage to a predetermined polarity such that the full-color toner image, formed on the surface of the intermediate transfer member 3, is transferred on the recording medium P.

The recording medium P that has the full-color toner image thereon is conveyed further upward and passes between a pair of fixing rollers of a fixing unit 17. The fixing unit 17 includes a heat roller 18 having a heater therein and a pressure roller 19 for pressing the recording medium P for fixing the full-color toner image. The fixing unit 17 fixes the full-color toner image to the recording medium P by applying heat and pressure. After the recording medium P passes the fixing unit 17, the recording medium P is discharged by a sheet discharging roller pair 20 to a sheet discharging tray 21 provided at the upper portion of the image forming apparatus 1. After the full-color toner image is transferred onto the recording medium P, a transfer member cleaning unit 22 removes residual toner adhering on the surface of the intermediate transfer member 3. As described above, the image forming apparatus 1 of this embodiment of the present invention performs its image forming operation such that the full-color toner image formed on the photoconductor 2 is transferred onto the intermediate transfer member 3 and then onto the recording medium P to obtain a recorded image.

The above-described image forming operations are performed in a color mode for producing a full-color image on the recording medium P. The image forming apparatus 1 also performs image forming operations in a black-and-white mode for producing a single black-and-white toner image on the recording medium P.

Figure 6:
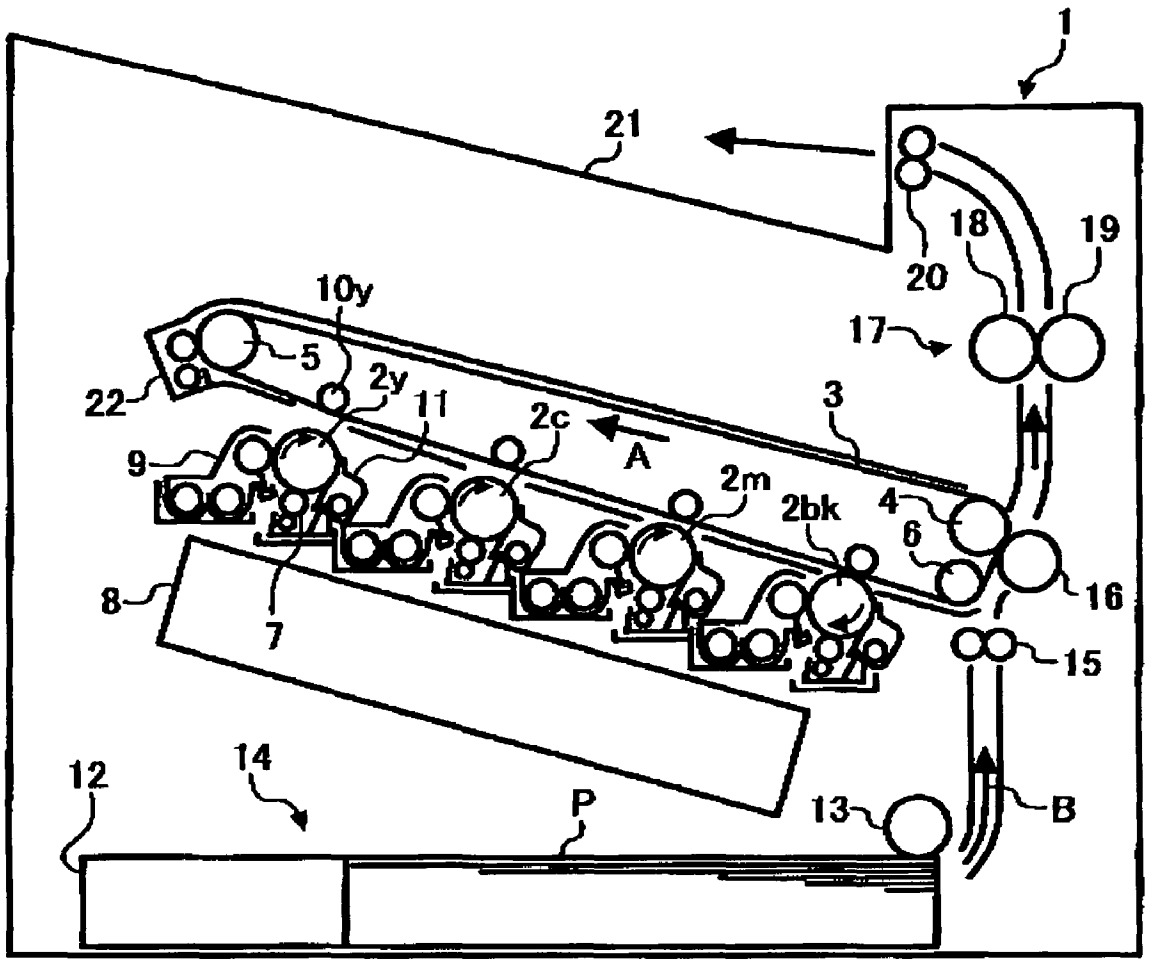
FIG. 6 is a drawing of a schematic structure of the image forming apparatus of FIG. 5 when the image forming apparatus is in a black-and-white mode.

Referring to FIG. 6, the image forming apparatus 1 in the black-and-white mode is described.

In the black-and-white mode, the intermediate transfer member 3 is detached from the surfaces of the photoconductors 2*y*, 2*c* and 2*m* used for producing a full-color toner image and is held in contact with the photoconductor 2*bk* used for producing a black-and-white toner image. In the black-and-white mode, the photoconductors 2*y*, 2*c*, and 2*m* are not rotated while the photoconductor 2*bk* is rotated.

The black-and-white toner image is formed on the photoconductor 2*bk* through the same operations as those for the full-color toner image. The black-and-white toner image formed on the photoconductor 2*bk* is transferred onto the surface of the intermediate transfer member 3 that is rotated in the direction A in FIG. 6.

The recording medium P is also fed from the sheet feeding unit 14, is fed and stopped in synchronization with the registration roller pair 15, and is conveyed to the portion between the supporting roller 4 held in contact with the intermediate transfer member 3 and the secondary transfer roller 16. Consequently, the black-and-white toner image is transferred onto the recording medium P at the portion. The recording medium P also passes through the fixing unit 17. At this time, the black-and-white toner image on the recording medium P is fixed, and is then discharged to the sheet discharging tray 21. In the black-and-white mode, the photoconductors 2*y*, 2*c*, and 2*m* do not operate and are not held in contact with the intermediate transfer member 3. As a result, the photoconductors 2*y*, 2*c*, and 2*m* may be used longer, compared to a case where the photoconductors 2*y*, 2*c*, and 2*m* are held in contact with the intermediate transfer member 3 during an image forming operation of a black-and-white toner image.

The image forming apparatus 1 using the intermediate transfer method as shown in FIG. 5 has a structure, in which a plurality of photoconductors carry their toner image which are different in colors from each other, transfer the respective toner images onto the intermediate transfer member 3 to form an overlaid full-color toner image, and then transfer the overlaid full-color toner image onto the recording medium P. As an alternative, the image forming apparatus 1 may have a structure in which one photoconductor carries one toner image in one cycle of a plurality of toner images with different colors from each other, such as yellow, cyan, magenta and black toner images, on a surface thereof, sequentially transfers toner images one after another onto the intermediate transfer member to form an overlaid full-color toner image, and then transfer the overlaid full-color toner image onto the recording medium P. In this case, merely one photoconductor is used for the image forming operation.

As described above, the image forming apparatus using the intermediate transfer method according to this embodiment of the present invention includes at least one photoconductor for bearing a toner image and an intermediate transfer member for receiving the toner image formed on the photoconductor, so that the toner image transferred onto the intermediate transfer member onto a recording medium to obtain a recorded image.

Figure 7:
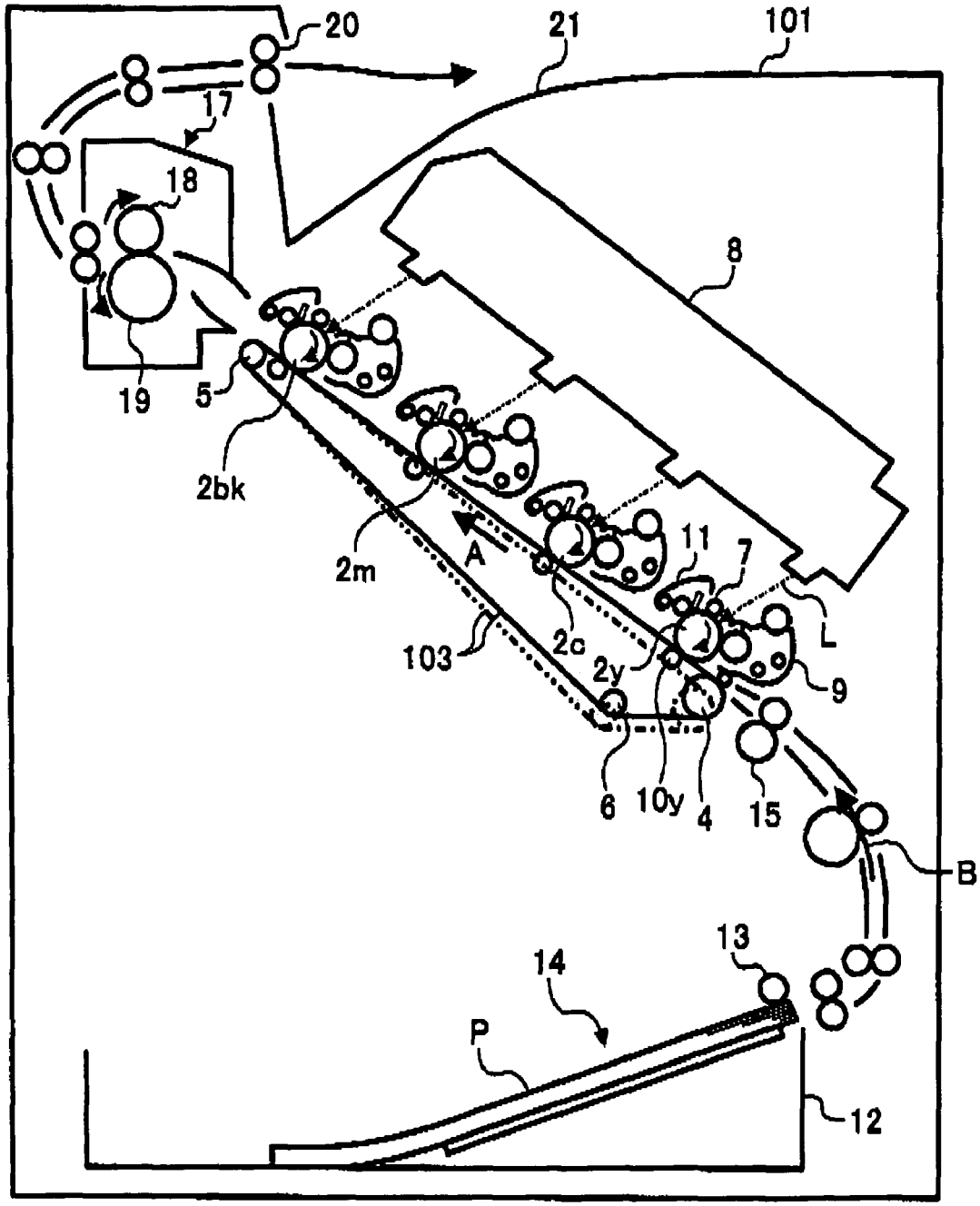
FIG. 7 is a drawing of a schematic structure of an image forming apparatus provided with a recording medium bearing member according to an exemplary embodiment of the present invention when the image forming apparatus.

Referring to FIG. 7, a structure of an exemplary image forming apparatus 101 with a direct transfer method is described. When components included in the image forming apparatus 101 have structures and functions same as those of the image forming apparatus 1 of FIG. 5, the reference numerals for specifying the components of the image forming apparatus 1 are applied to the respective components of the image forming apparatus 101, except for the image forming apparatus 101 and a recording medium bearing member 103.

In FIG. 7, similar to the image forming apparatus with the intermediate transfer method, the image forming apparatus with the direct transfer method also includes four photoconductors 2*y*, 2*c*, 2*m* and 2*bk* and a recording medium bearing member 103. The photoconductors 2*y*, 2*c*, 2*m* and 2*bk* are in a cylindrical shape, and have an outer diameter, The recording medium bearing member 103 forms an endless belt extended with supporting rollers 4, 5, and 6. The photoconductor 2*y*, 2*c*, 2*m* and 2*bk* are held in contact with the recording medium bearing member 103 and are rotated in a same direction that the intermediate transfer member 3 travels in FIG. 7.

Through the operations similar to those as described in the discussion of FIG. 5, yellow, cyan, magenta and black images are formed on the surfaces of the respective photoconductors 2*y*, 2*c*, 2*m* and 2*bk*. The recording medium P fed from the sheet feeding cassette 14 is conveyed by the recording medium bearing member 103 and sequentially passes through portions between the respective photoconductors 2*y*, 2*c*, 2*m* and 2*bk* and the recording medium bearing member 103 so that respective color toner images formed on the respective photoconductors 2*y*, 2*c*, 2*m* and 2*bk* are sequentially overlaid onto the recording medium P. The overlaid color toner image formed on the recording medium P is fixed to the recording medium P by the fixing unit 17. After passing through the fixing unit 17, the recording medium P is discharged to the sheet discharging tray 21.

As described above, the image forming apparatus 101 with the direct transfer method of FIG. 7 includes the recording medium bearing member 103, and has a structure in which the recording medium bearing member 103 conveys a recording medium so that respective color toner images formed on the respective photoconductors 2*y*, 2*c*, 2*m* and 2*bk* are transferred onto the recording medium. The image forming apparatus 1 with the intermediate transfer method of FIG. 5, on the other hand, transfers the respective color toner images formed on the respective photoconductors 2*y*, 2*c*, 2*m* and 2*bk* onto the intermediate transfer member 3 and then onto the recording medium. The difference described above is a basic difference between the image forming apparatus with the intermediate transfer method and that with the direct transfer method.

The image forming apparatus 101 of FIG. 7 with the direct transfer method also has a commonly known structure with one photoconductor, which is same as that of the image forming apparatus 1 of FIG. 5 with the intermediate transfer method. In this structure, the image forming apparatus 101 with the direct transfer method includes one photoconductor 2. The one photoconductor 2 bears one toner image in one cycle of a plurality of toner images with different colors from each other on a surface thereof, sequentially transfers toner images one after another onto the recording medium P carried by the recording medium bearing member 103 to form an overlaid full-color toner image. This structure may also be applied to the present invention. Further, the image forming apparatus 101 with the direct transfer method may also have a structure in which a single toner image is formed on the photoconductor 2, and is transferred onto a recording medium P carried by a recording medium bearing member 103, so as to obtain a single color image. This structure may also be applied to the present invention, As described above, the image forming apparatus 101 using the direct transfer method according to this embodiment of the present invention includes at least one photoconductor for bearing a toner image and a recording medium bearing member for carrying a recording medium for receive the toner image formed on the photoconductor, so that the toner image is directly transferred onto the recording medium bearing member to obtain a recorded image.

Hereinafter, the discussion will be made mainly for structures and functions with respect to the image forming apparatus with the intermediate transfer method. However, structures and functions with respect to the image forming apparatus with the direct transfer method may also be applied to the present invention.

Figure 8:
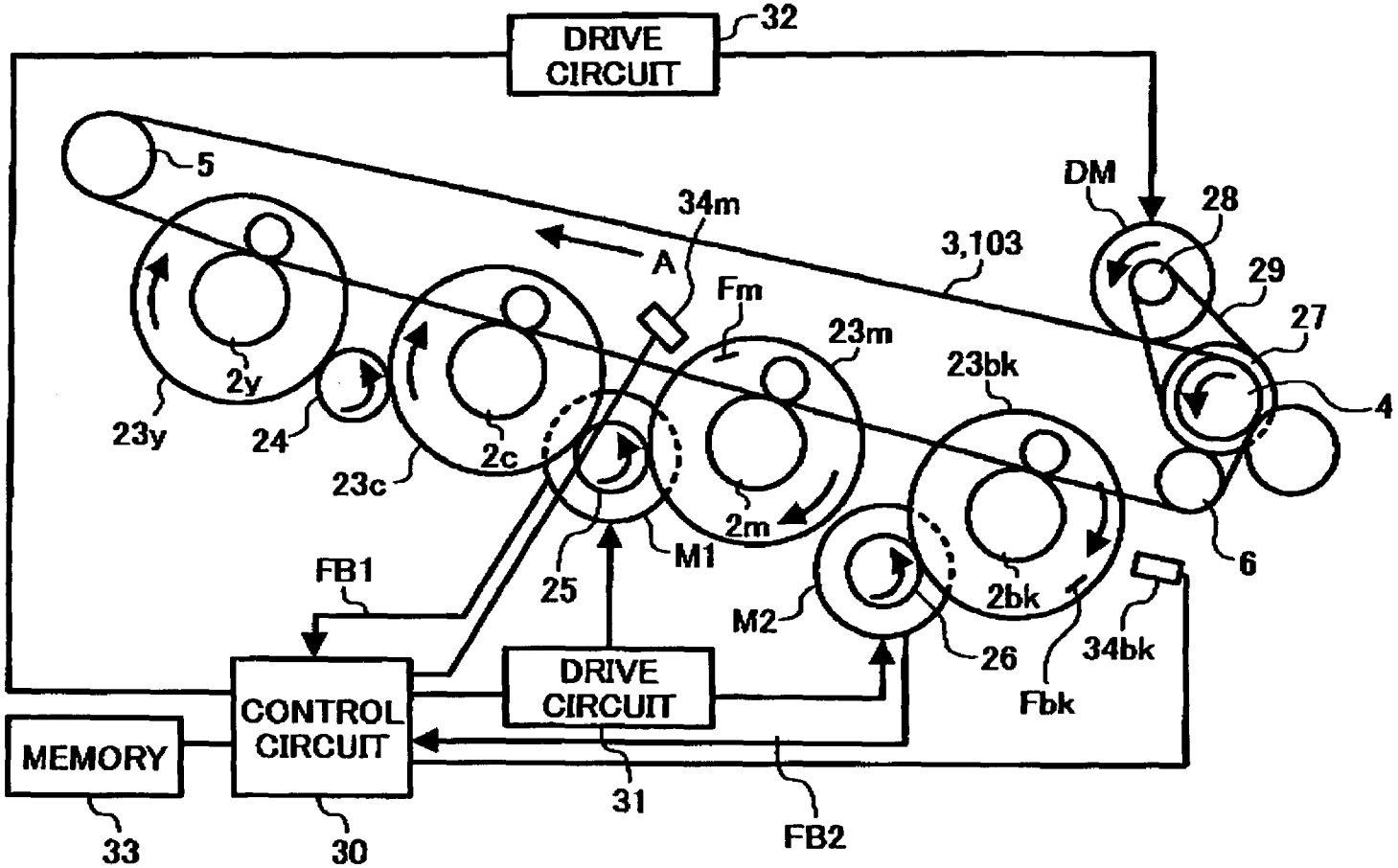
FIG. 8 is a schematic structure of drive circuits driving the photoconductors and the intermediate transfer member of the image bearing member of FIG. 5.

Referring to FIG. 8, a structure of an image forming system driving the photoconductors 2*y*, 2*c*, 2*m* and 2*bk* and the intermediate transfer member 3 is described with respect to the image forming apparatus with the intermediate transfer method of FIG. 5 according to an exemplary embodiment of the present invention. The image forming system of FIG. 8 is included in the image forming apparatus 1 of FIG. 5, and can also be applied to the image forming apparatus 101 of FIG. 7.

As shown in FIG. 8, the image forming apparatus 1 with the intermediate transfer method includes photoconductor motors M1 and M2 which drive the photoconductors 2*y*, 2*c*, 2*m* and 2*bk* to rotate clockwise in FIG. 5, and a drive motor DM which drives the intermediate transfer member 3 to rotate in a direction A. The photoconductor motor M1 of FIG. 8 drives the photoconductors 2*y*, 2*c* and 2*m* to rotate for forming yellow, cyan and magenta toner images, respectively. The photoconductor motor M2 of FIG. 8 drives the photoconductor 2*bk* to rotate for forming a black-and-white toner image.

The image forming apparatus 101 of FIG. 7 with the direct transfer method also includes the photoconductor motors M1 and M2 which drive the photoconductors 2*y*, 2*c*, 2*m* and 2*bk* to rotate, and the drive motor DM which drives the recording medium bearing member 103 to rotate. The photoconductor motors M1 and M2 and the drive motor DM included in the image forming apparatus 101 of FIG. 7 with the direct transfer method have the same structures and functions as those of the photoconductor motors M1 and M2 and the drive motor DM included in the image forming apparatus 1 of FIG. 5 with the intermediate transfer method, so that they drive the photoconductors 2*y*, 2*c*, 2*m* and 2*bk* and the recording medium bearing member 103 to rotate.

The photoconductors 2*y*, 2*c*, 2*m* and 2*bk* include gears 23*y*, 23*c*, 23*m* and 23*bk*, respectively. The gears 23*y*, 23*c*, 23*m* and 23*bk*, which are concentrically coupled with the respective photoconductors 2*y*, 2*c*, 2*m* and 2*bk* have a common radius and a common number of teeth.

Figure 9:
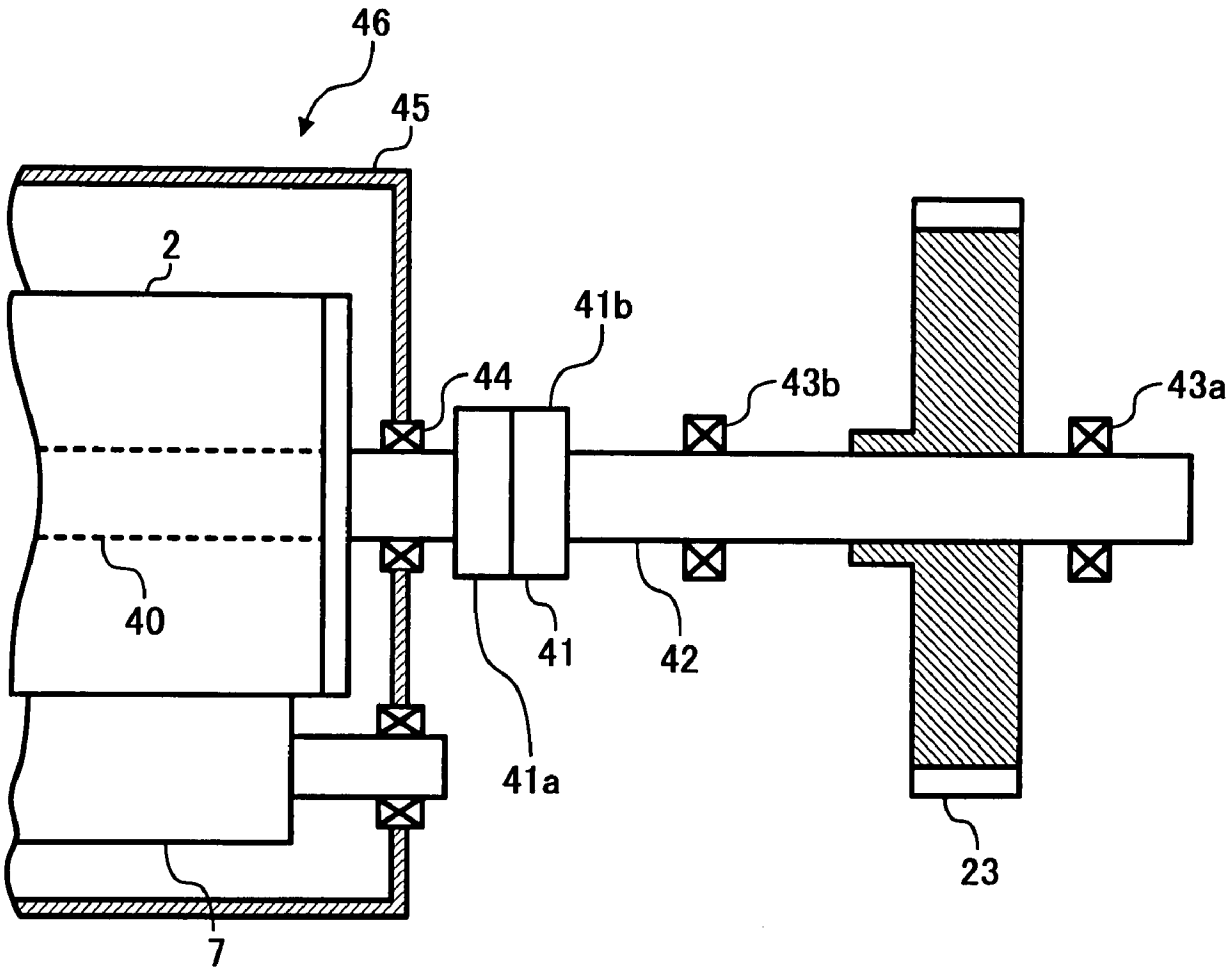
FIG. 9 is a schematic structure of a positional relationship of the photoconductor and gears provided for driving the photoconductor.

Referring to FIG. 9, an alignment of a gear attached to a photoconductor is described. As previously indicated, the photoconductors 2*y*, 2*c*, 2*m* and 2*bk* have structures and functions similar to each other, except that the toners contained therein are of different colors, so the discussion with respect to FIG. 9 uses reference numerals for specifying components of the image forming apparatus 1 without suffixes of colors such as y, c, m and bk.

The photoconductor 2 is supported by a photoconductor shaft 40 which is concentrically fixed thereto. The photoconductor shaft 40 is connected with a drive shaft 42 via a joint set 41. The joint set 41 includes a first joint set 41*a* and a second joint set 41*b*. The first joint set 41*a* is attached onto a portion of the photoconductor shaft 40 on the side close to the photoconductor 2, and the second joint set 41*b* is attached onto a portion of the photoconductor shaft 40 on the side close to the gear 23. The drive shaft 42 is concentrically mounted to the photoconductor shaft 40, and is rotatably supported by a frame of the image forming apparatus 1 via first and second shaft bearings 43*a* and 43*b*. The drive shaft 42 is also provided with the gear 23 that is also shown in FIG. 8. The gear 23 includes an adequate material such as a metal and resin. In this embodiment, the gear 23 includes a resin.

The photoconductor shaft 40 is rotatably mounted to a housing 45 via a third shaft bearing 44. A process cartridge 46 is formed by a component at least one of the photoconductor 2, the photoconductor shaft 40 corresponding to the photoconductor 2, and the housing 45. In FIG. 9, a charging roller 7 is also rotatably mounted to the housing 45, as one component of the process cartridge 46. As shown in FIG. 9, the process cartridge 46 is detachably provided to the image forming apparatus 1. When the process cartridge 46 is removed from the image forming apparatus 1, the first and second joint members 41*a* and 41*b* of the joint set 41 are detached from the photoconductor shaft 42.

As shown in FIG. 8, the gear 23*y* coupled with the photoconductor 2*y*, and the gear 23*c* coupled with the photoconductor 2*c* are meshed with an intermediate gear 24. That is, the gears 23*y* and 23*c* are in mesh via the intermediate gear 24. The photoconductor motor M1 includes an output shaft having a first output gear 25 fixed thereto. The first output gear 25 is meshed with the gear 23*c*, which is coupled with the photoconductor 2*c*, and the gear 23*m*, which is coupled with the photoconductor 2*m*. The second photoconductor motor M2 includes an output shaft (not shown) having a second output gear 26 fixed thereto. The second output gear 26 is meshed with the gear 23*bk*, which is coupled with the photoconductor 2*bk*.

When the photoconductor motor M1 starts, the first output gear 25 rotates counterclockwise in FIG. 8, as indicated by an arrow shown in FIG. 8. Then, the gears 23*c* and 23*m*, which are meshed with the first output gear 25, are rotated clockwise in FIG. 8, as indicated by arrows shown in FIG. 8. Consequently, the photoconductors 2*c* and 2*m* are rotated in a same direction as that of the gears 23*c* and 23*m*, and at a same number of rotations as that of the gears 23*c* and 23*m*.

When the photoconductors 2*c* and 2*m* are rotated, the gear 23*y*, which is meshed with the gear 23*c* via the intermediate gear 24, is also rotated. Accordingly, the photoconductor 2*y* is rotated in a same direction as that of the gear 23*y* and at a same number of rotations as that of the gear 23*y*. The photoconductor 2*y* has the same number of rotations as those of the photoconductors 2*c* and 2*m*.

Further, when the photoconductor motor M2 starts, the second output gear 26 rotates counterclockwise in FIG. 8, as indicated by an arrow shown in FIG. 8. Then, the gear 23*bk*, which is meshed with the second output gear 26, is rotated clockwise in FIG. 8, as indicated by an arrow in FIG. 8. Consequently, the photoconductor 2*y* is rotated in a same direction as that of the gear 23*bk* and at a same number of rotations as that of the gear 23*bk*.

In a case where needed, each of the gears 23*y*, 23*c* and 23*m* coupled with the photoconductors 2*y*, 2*c* and 2*m*, respectively, is hereinafter referred to as a "color gear", and the gear 23*bk* coupled with the photoconductor 2*bk* is hereinafter referred to as a "black-and-white gear."

Further, as shown in FIG. 8, the supporting roller 4 that supports the intermediate transfer member 3 is integrally coupled with a first timing pulley 27 that is concentrically provided to the supporting roller 4. The first timing pulley 27 and a second timing pulley 28, which is fixed to an output shaft (not shown) of the drive motor DM, extendedly support a timing belt 29 which includes an endless belt. When the drive motor DM starts, the second timing. pulley 28 is rotated counterclockwise, as indicated by an arrow in FIG. 8. A driving force generated by the second timing pulley 28 is transmitted to the first timing pulley 27 via the timing belt 29. Then, the supporting roller 4 is rotated counterclockwise, which is a same direction that the first timing pulley 27 is rotated, at a same number of rotations as that of the first timing pulley 27. Consequently, the intermediate transfer member 3 is driven to rotate in a direction A as shown in FIG. 8. As described above, the photoconductors 2*y*, 2*c*, 2*m* and 2*bk* and the intermediate transfer member 3 are driven to rotate, so that the above-described image forming operations are performed.

In FIG. 8, the image forming system includes a control circuit 30 and first and second drive circuits 31 and 32. The control circuit 30 controls rotations of the photoconductor motors M1 and M2, and the drive motor DM. The first and second drive circuits 31 and 32 are circuits for driving the photoconductor motors M1 and M2, and the drive motor DM.

In the image forming system of FIG. 8, at least one motor of the photoconductor motors M1 and M2 and the drive motor DM includes a clock control motor. The clock control motor is controlled by a command clock signal and a feedback signal. In FIG. 8, the photoconductor motors M1 and M2 include the clock control motor, and the drive motor DM includes a stepping motor. A clock control motor that is commonly known is a direct current (DC) brushless motor. When the photoconductor motors M1 and M2 employ the DC brushless motor, the image forming system can reduce its power consumption and noise when compared to the photoconductor motors M1 and M2 employing the stepping motor.

In addition to the photoconductor motors M1 and M2, the drive motor DM may also include the clock control motor employing the DC brushless motor. By doing so, the above-described power consumption and noise may further be reduced. Nevertheless, the image forming apparatus 1 of the present invention uses a stepping motor for the drive motor OM because of reasons described below.

Generally, the intermediate transfer member 3 and the recording medium bearing member 103 can be rotated with a small amount of driving force. Accordingly, a small motor is required for the drive motor DM. However, a DC brushless motor which is compact in size and less expensive in cost is not in the market at the present time, so a small-sized stepping motor is reasonable for the driving motor DM to reduce manufacturing costs of the image forming apparatus 1. That is why the stepping motor is employed as the drive motor DM for the image forming apparatus 1.

By controlling the number of input pulses, the stepping motor can correctly control the rotation numbers during a rise time period, a fall time period, and a steady rotation time of the stepping motor.

On the contrary, it is difficult to correctly control the number of rotations of the DC brushless motor during the rise and fall time periods to obtain a desired number of rotations. When a background image forming apparatus uses the DC brushless motor for driving a photoconductor and an intermediate transfer member, a surface linear velocity of the photoconductor and that of the intermediate transfer member contacting the photoconductor may be substantially different during the rise and fall time periods. That is, a surface of the photoconductor rubs that of the intermediate transfer member extremely hard, and thereby the surfaces thereof may be worn away.

To eliminate the problem, tests were conducted and it was found that if the DC brushless motor is controlled to rotate according to a predetermined velocity curve, a substantially desired rotation rate may be obtained during a steady rotation time, a rise time period and a fall time period of the DC brushless motor. That is, the DC brushless motor that rotates at a rate according to the number of clocks of the command clock signal may be constructed such that the DC brushless motor is controlled to rotate during its rise and fall time periods by the command clock signal having the number of input pulses according to the predetermined velocity curve. The number of input pulses represents the number of input pulses generated in a unit time, that is a frequency.

Specifically, the image forming system of FIG. 8 operates as follows. A memory. 33 of FIG. 8 includes data of the predetermined velocity curve. The command clock signal according to the velocity curve is output from the control circuit 30 to drive the photoconductor motors M1 and M2 to rotate including the DC brushless motor at a rotation rate according to the number of input pulses. Feedback signals FB1 and FB2 that are output from the photoconductor motors M1 and M2, respectively, are compared with the above-described command clock signal to control the numbers of rotations of the photoconductor motors M1 and M2. The feedback signals FB1 and FB2 are pulse signals according to the numbers of rotations of the photoconductor motors M1 and M2. A feedback signal can be detected according to the number of rotation of a component which is rotated by the photoconductor motors M1 and M2, such as the photoconductors 2*y*, 2*c*, 2*m* and 2*bk*. With this structure, the clock control motor is controlled by the command clock signal and the feedback signal.

In the image forming system of the image forming apparatus 1 shown in FIG. 8, the drive motor DM includes a stepping motor. Therefore, the command clock signal synchronized with the rotation of the drive motor DM needs to be input to the photoconductor motors M1 and M2 such that surface linear velocities of the photoconductors 2*y*, 2*c*, 2*m* and 2*bk* may be approximately the same as that of the intermediate transfer member 3. To prevent an easy wearing of the photoconductors 2*y*, 2*c*, 2*m* and 2*bk* and the intermediate transfer member 3, the rotation of the DC brushless motor is controlled as follows. During the rise time period, the number of input pulses (frequency) of the command clock signal is continuously or gradually increased. During the fall time period, the number of input pulses of the command clock signal is continuously or gradually decreased. During the steady rotation time, the number of input pulses of the command clock signal is in a constant rate. Thus, the rotation of the DC brushless motor is controlled. By doing so, the intermediate transfer member 3 and the photoconductors 2*y*, 2*c*, 2*m* and 2*bk* which rotatably contact with the intermediate transfer member 3 during the rise and fall time periods of the photoconductor motors M1 and M2 and the drive motor DM may rotate at an approximately same surface linear velocity, and thereby the surfaces thereof are prevented from the easy wearing.

The easy wearing of the surfaces of the intermediate transfer member 3 and the photoconductors 2*y*, 2*c*, 2*m* and 2*bk* may also be reduced even if the above-described controls are performed during one of the rise and fall time periods. That is, at least one motor of the photoconductor motors M1 and M2 and the drive motor DM includes the clock control motor, more specifically the DC brushless motor, and a control unit for controlling the number of the clock control motor according to a predetermined velocity curve during at least one of the rise and fall time periods. By using the control unit, the wearing of the intermediate transfer member 3 and the photoconductors 2*y*, 2*c*, 2*m* and 2*bk* may be reduced and, at the same time, the power consumption and the operation noise may also be reduced. In the image forming apparatus 1, the control circuit 30 and the memory 33 of FIG. 8 represent the above-described control unit.

As described above, the rotation of the clock control motor is controlled by the command clock signal having the number of input pulses according to the above-described velocity curve during at least one of the rise and fall time periods. More preferably, the rotation of the clock control motor is controlled by the command clock signal having the gradually increasing number of input pulses during the rise time period, by the command clock signal having the constant number of clocks during the steady rotation time, and by the command clock signal having the gradually decreasing number of input pulses during the fall time period. The above-described structure is also applied to the image forming apparatus 101 with the direct transfer method.

Next, a detailed example of the above-described embodiment of the image forming apparatus 1 shown in FIG. 5 is described.

The drive motor DM is a stepping motor having specifications shown in Table 1 as described below.

TABLE 1

| Excitation Method | | Unipolar, 1–2 phase |
|---|---|---|
| Motor rotations (PPS, pulse per sec) | During steady rotation time | 2255.423 PPS |
| | At start | 786 PPS |
| | At stop | 786 PPS |
| Number of steps | At start | 100 steps |
| | At stop | 100 steps |
| Transition time period | Rise time period | 1000 mm/sec |
| | Fall time period | 1000 mm/sec |
| Surface linear velocity of intermediate transfer member in steady rotation time | | 155 mm/sec |

The photoconductor motors M1 and M2 are DC brushless motors. Rotations of the DC brushless motor are controlled according to a velocity curve corresponding to the specifications of the stepping motor that is shown in Table 1.

Generally, a primary frequency F (Hz) is obtained by a formula of:

$$F=N*Fd;$$

where "N" represents a natural number, and "Fd" represents a dividing frequency based on the primary frequency. According to the above-described formula, a relationship between a fundamental frequency F (Hz) and a predetermined dividing frequency Fd (Hz) of the image forming apparatus 1 is defined as the above-described formula, F=N*Fd, that is, Fd=F/N.

On the other hand, the dividing frequencies Fd (Hz) of the photoconductor motors M1 and M2 that include the DC brushless motors are obtained by a formula of:

$$Fd=R*P/60(s);$$

where "R" represents the number of rotations of the DC brushless motor (rpm), and "P" represents the number of frequency generation (FG) pulses to rotate the DC brushless motor for one cycle. According to the above-described formulae, the primary frequency F (Hz) can be obtained by a formula of:

$$F=N*R*P/60(s).$$

That is, the number of rotations of the DC brushless motor (rpm) can be obtained by a formula of:

$$R=F*60(s)/(P*N).$$

According to the relationships as described above, the rotation numbers of the photoconductor motors M1 and M2 can be modified by changing the natural number N. Further, by changing the number of pulses (FG pulses) of the command clock signal supplied to the photoconductor motors M1 and M2, the dividing frequency Fd can be controlled to set the rotation numbers of the respective photoconductor motors M1 and M2 to respective desired numbers. Thus, the rotation numbers of the photoconductor motors M1 and M2 are controlled to adjust the surface linear velocities of the photoconductors 2*y*, 2*c*, 2*m* and 2*bk*.

As an example of the surface linear velocities of the stepping motor used for the image forming apparatus 1, it was assumed the fundamental frequency F is 9830400 (Hz), and the number of FG pulses P is 45. Table 2 shows exemplary results according to the formulae as described above.

TABLE 2

| Common denominator (Natural number) | Dividing frequency (Hz) | Motor speed (rpm) | Surface linear velocity of photoconductor (mm/sec) |
|---|---|---|---|
| 8310 | 1182.960289 | 1577.280385 | 155.1588 |
| 8311 | 1182.817952 | 1577.090603 | 155.1918 |
| 8312 | 1182.67565 | 1576.900866 | 155.1731 |
| 8313 | 1182.533381 | 1576.711175 | 155.1544 |
| 8314 | 1182.391147 | 1576.52153 | 155.1358 |
| 8315 | 1182.248948 | 1576.33193 | 155.1171 |
| 8316 | 1182.106782 | 1576.142376 | 155.0985 |
| 8317 | 1181.964651 | 1575.952868 | 155.0798 |
| 8318 | 1181.822553 | 1575.763405 | 155.0612 |
| 8319 | 1181.68049 | 1575.573987 | 155.0425 |
| 8320 | 1181.538462 | 1575.384615 | 155.0239 |
| 8321 | 1181.396467 | 1575.195289 | 155.0053 |
| 8322 | 1181.254506 | 1575.006008 | 154.9866 |
| 8323 | 1181.11258 | 1575.816773 | 154.9680 |
| 8324 | 1180.970687 | 1574.627583 | 154.9494 |

Figure 10:
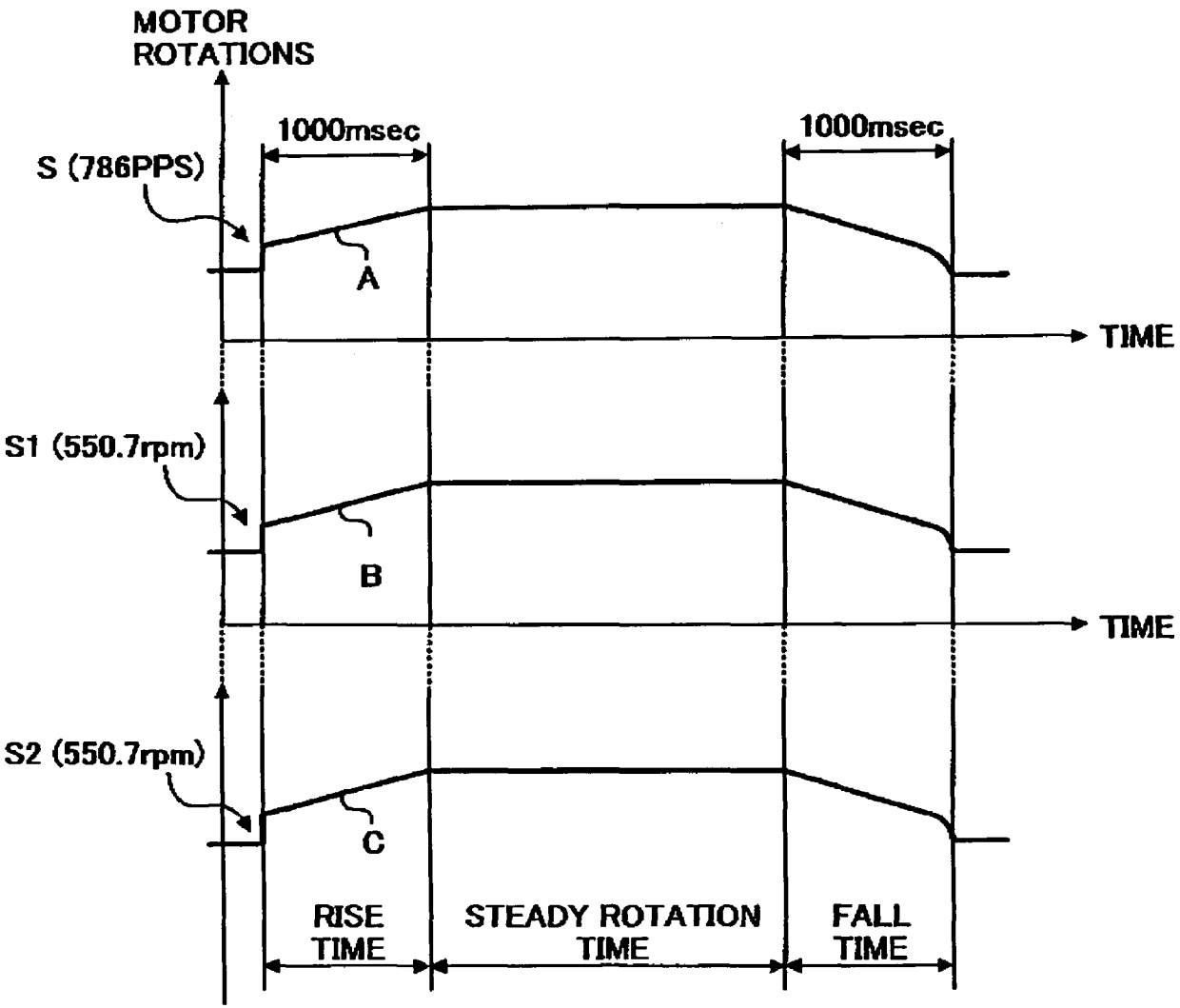
FIG. 10 is a graph showing motor rotations of photoconductor motors and a drive motor of the image forming apparatus of FIG. 5.

Referring to FIG. 10, a schematic graph of velocity curves of the drive motor DM including the stepping motor and the first and second photoconductor motors M1 and M2 including the DC brushless motor are described. A vertical axis of the graph indicates-the number of motor rotations, and a horizontal axis of the graph-indicates time. A velocity curve A indicates the number of pulses of the drive motor DM. A velocity curve B indicates the number of the pulses of the first photoconductor motor M1, and a velocity curve C indicates the number of pulses of the second photoconductor motor M2. The velocity curve A of FIG. 10 includes the number of pulses S0 which indicates the number of pulses at a start of the drive motor DM. The number of pulses S0 is 786 PPS, as shown in Table 1. Table 1 also indicates that periods required to the drive motor DM during the rise and fall time periods are 1000 msec each, the numbers of steps required at that time are 100 steps each, and the number of pulses during the steady rotation is 2255.423 PPS.

The rotation speeds of the first and second photoconductor motors M1 and M2 shown as the velocity curves B and C of FIG. 10 are controlled according to the velocity curve of the stepping motor indicated as the velocity curve A of FIG. 10. The numbers of pulses S1 and S2 indicate the number of pulses at a start of the photoconductor motors M1 and M2 respectively. Here, the natural number described above is set to 23800 so that the numbers of pulses S1 and S2 may become 550.7 rpm. The settings are made as described above because the photoconductor motors M1 and M2 may not be correctly rotated even if the clock having the number below the number of rotations during the steady rotation time is given at the start of the photoconductor motors M1 and M2.

A time required for the rise and fall time periods of the first and second photoconductor motors M1 and M2 is 1000 msec, which is the same as the time required to the drive motor DM. The DC brushless motor generally completes its rise time period of approximately 400 msec when a load to the motor drive shaft is 0.8 kgfcm. However, as shown in FIG. 10, by setting the rise and fall time periods of the photoconductor motors M1 and M2 to 1000 msec, which is far longer than 4000 msec, the velocity curves of the photoconductor motor M1 and M2 may be close to the velocity curve of the drive motor DM including the stepping motor with a higher precision, and thereby the wearing of the surfaces of the photoconductors 2*y*, 2*c*, 2*m* and 2*bk* and the intermediate transfer member 3 may effectively be reduced.

In this example, the number of rotations of the photoconductor motors M1 and M2 during the steady rotation time is approximately 1576.33. Accordingly, as shown in Table 2, the natural number during-the steady rotation time of the photoconductor motors M1 and M2 is 8315, the divided frequency is approximately 1182.2489, and the surface linear velocities of the photoconductors 2*y*, 2*c*, 2*m* and 2*bk* are 155.12 mm/sec.

By controlling the number of clocks of the command clock signal to be supplied to the photoconductor motors M1 and M2 as described above, the surface linear velocities of the photoconductors 2*y*, 2*c*, 2*m* and 2*bk* may be substantially equal to that of the intermediate transfer member 3 during the steady rotation time, the rise time period, and the fall time period.

When the number of rotations of the DC brushless motor become below a predetermined number of rotation, its control becomes difficult even during the fall time period. To eliminate the problem, as shown in FIG. 8, a feeler is provided to a gear attached to a photoconductor producing a color toner image. In this example, a feeler Fm is provided to the gear 23*m* attached for the photoconductor 2*m* producing a magenta toner image, and a feeler Fbk is provided to the gear 23*bk* attached for the photoconductor 2*bk* producing a black toner image. And, first and second sensors 34*m* and 34*bk* are fixedly disposed at the gears 23*m* and 23*bk*, respectively. These sensors 34*m* and 34*bk* includes a photo sensor, for example.

Figure 11:
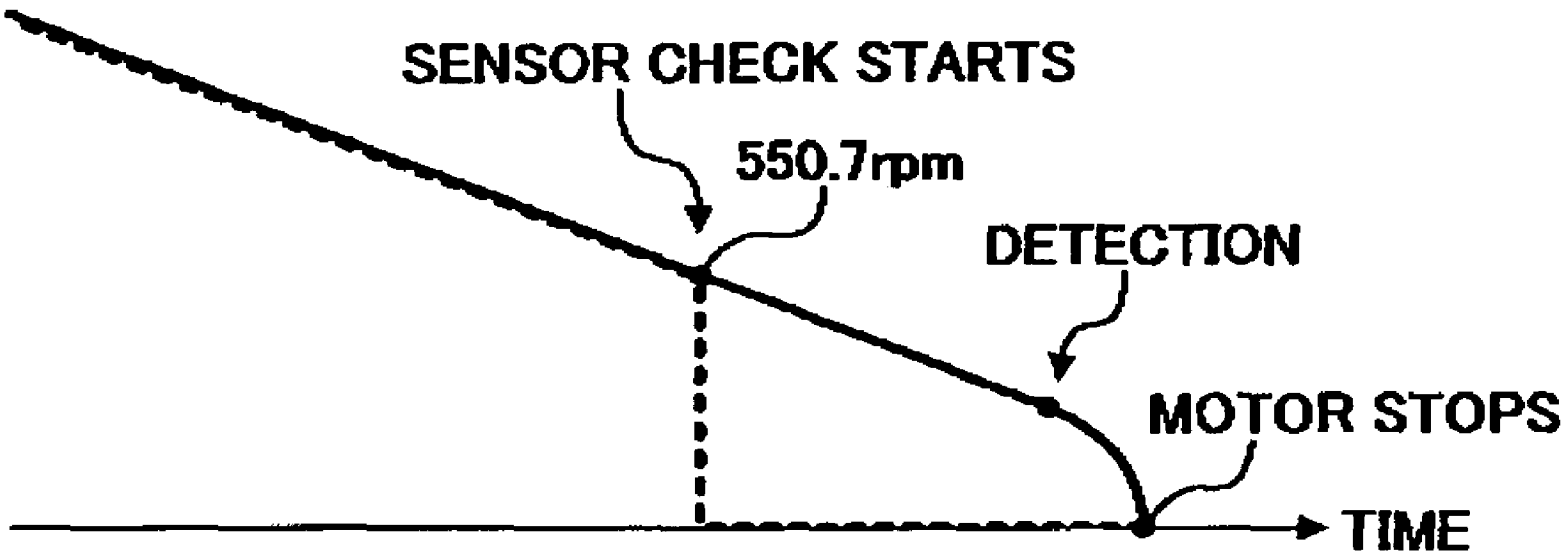
FIG. 11 is a graph showing motor rotations of the drive motor during a fall time period of the drive motor.

Referring to FIG. 11, the numbers of rotations of the photoconductor motors M1 and M2 including the DC brushless motor during the fall time period are described. FIG. 11 shows that when the numbers of rotations of the photoconductor motors M1 and M2 reach their respective predetermined values, the first and second sensors 34*m* and 34*bk* of FIG. 8 are started for checking. In this example, when the photoconductor motors M1 and M2 rotate at 550.7 rpm (the above-described natural number 23800), the first and second sensors 34*m* and 34*bk* are started. The numbers of clocks of the command clock signal which are input to the photoconductor motors M1 and M2 during the fall time period gradually decreases, as indicated by a dashed line in FIG. 11. When the photoconductor motors M1 and M2 rotate at the speed of 550.7 rpm, the input of clocks of the command clock signal to the photoconductor motors M1 and M2 is stopped. After the input of the clocks is stopped, if the first and second sensors 34*m* and 34*bk* detect the feelers Fm and Fbk, respectively, the speeds of the photoconductor motors M1 and M2 are forcedly decreased by applying the brakes so as to stop the photoconductor motors M1 and M2. Such control is made every time the clock pulses of the photoconductor motors M1 and M2 fall, both in the color mode and in the black-and-white mode. Since the photoconductor motors are forcedly stopped, the number of rotations of the photoconductor motors M1 and M2 may easily become close to or meet with the number of rotations of the drive motor MD.

Figure 12A:
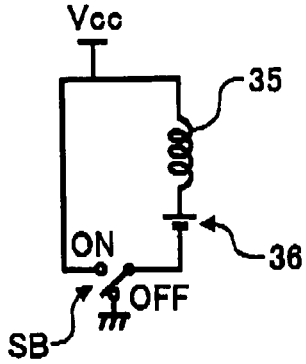
FIGS. 12A, 12B and 12C are drawings illustrating circuits of a braking mechanism of the DC brushless motor.
Figure 12B:
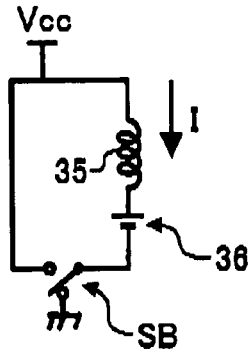
Figure 12C:
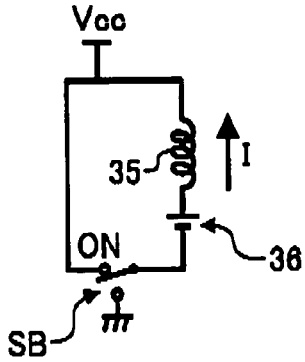

Referring to FIGS. 12A, 12B and 12C, states of a braking unit that applies the brakes onto the photoconductor motors M1 and M2 are described. A coil 35 of FIG. 12A represents a winding of the DC brushless motor included in the photoconductor motors M1 and M2. When the DC brushless motor rotates, a counter electromotive voltage is generated. Although the counter electromotive voltage and its action cannot be seen, it is illustrated in FIG. 12, represented by a symbol of a direct current having a reference numeral as a "counter electromotive voltage 36". When the DC brushless motor rotates, an electric current I flows in a direction indicated by an arrow in FIG. 12B. At this time, the DC brushless motor rotates clockwise. Under the status as shown in FIG. 12B, a short brake SB is turned on as shown in FIG. 12C, the counter electromotive voltage 36 is generated, and the electric current I flows oppositely. At this time, the DC brushless motor tries to rotate counterclockwise, so that the brake is applied to the DC brushless motor included in the photoconductor motors M1 and M2. Since the counter electromotive voltage becomes proportional to the number of rotations of a motor, when the number of rotations becomes 0 rpm, the counter electromotive voltage becomes 0V, and the motor stops without rotating counterclockwise.

As described above, the image forming apparatus 1 of the present invention includes the braking unit forcedly decreasing the speed of the clock control motor, when the number of rotations of the clock control motor becomes equal to or less than a predetermined value at the stop of the clock control motor including the DC brushless motor.

Figure 13:
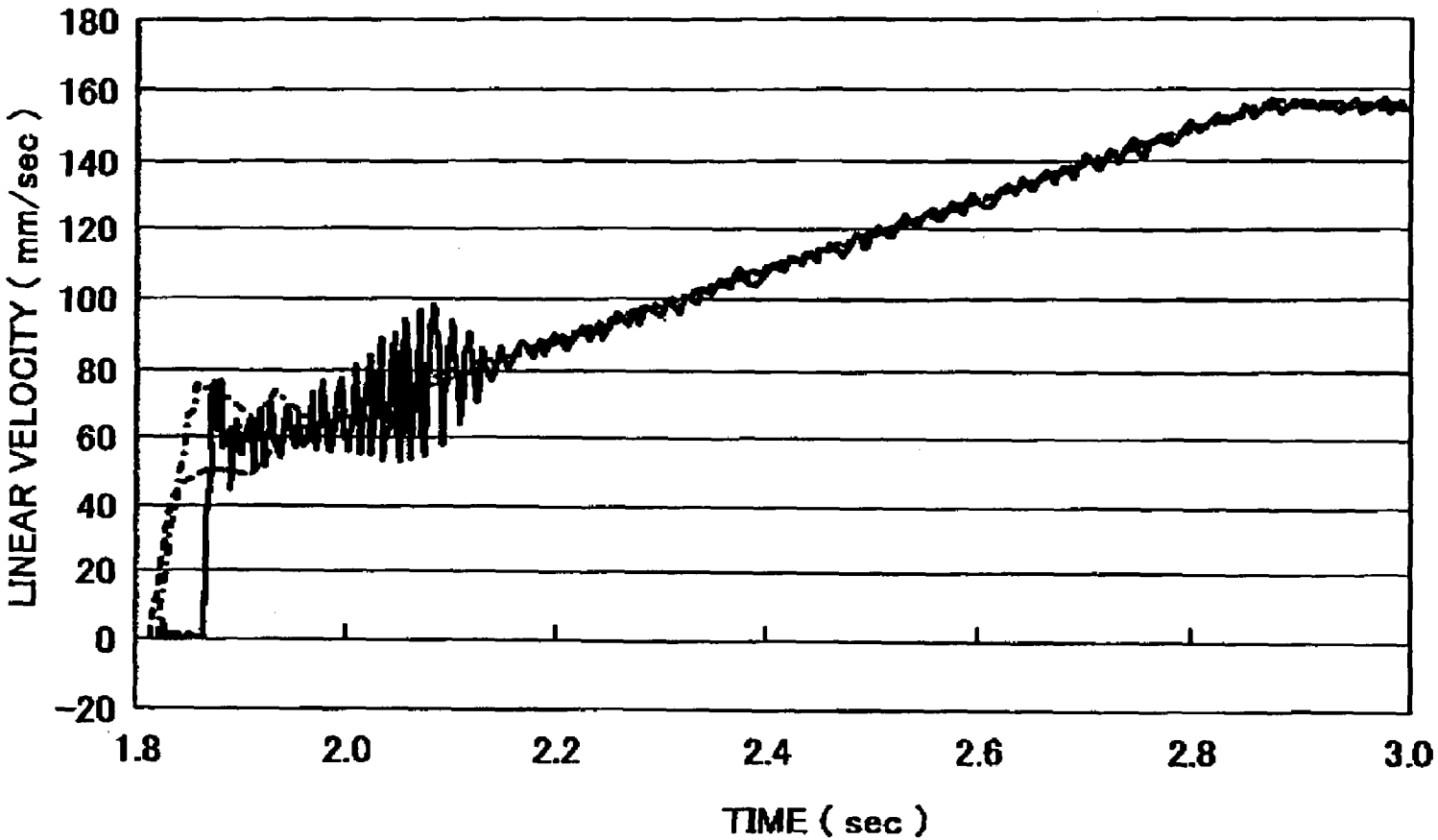
FIG. 13 is a graph showing surface linear velocities of two photoconductor motors and the drive motor during a rise time period.

Referring to FIG. 13, a test result examined at the start of the photoconductor motors M1 and M2 and the drive motor DM using the image forming apparatus 1 of FIGS. 5 to 8. The horizontal axis shows time, and the vertical axis surface linear velocities of the photoconductors 2*m* and 2*bk* and that of the intermediate transfer member 3. A solid line represents an actual measured value of the intermediate transfer member 3, a dashed line represents an actual measured value of the photoconductor 2*bk*, and a short and long dash line represents an actual measured value of the photoconductor 2*m*, which are common to FIG. 14.

As shown in FIG. 13, the photoconductor motors M1 and M2 and the drive motor DM start at a speed of 1000 msec. If such a long period of time is taken for the start, a slope for the surface linear velocity at the start does not change, when a load to the motor driving shaft of the photoconductor motors M1 and M2 vary at a value between 0 to 0.8 kgfcm.

Figure 14:
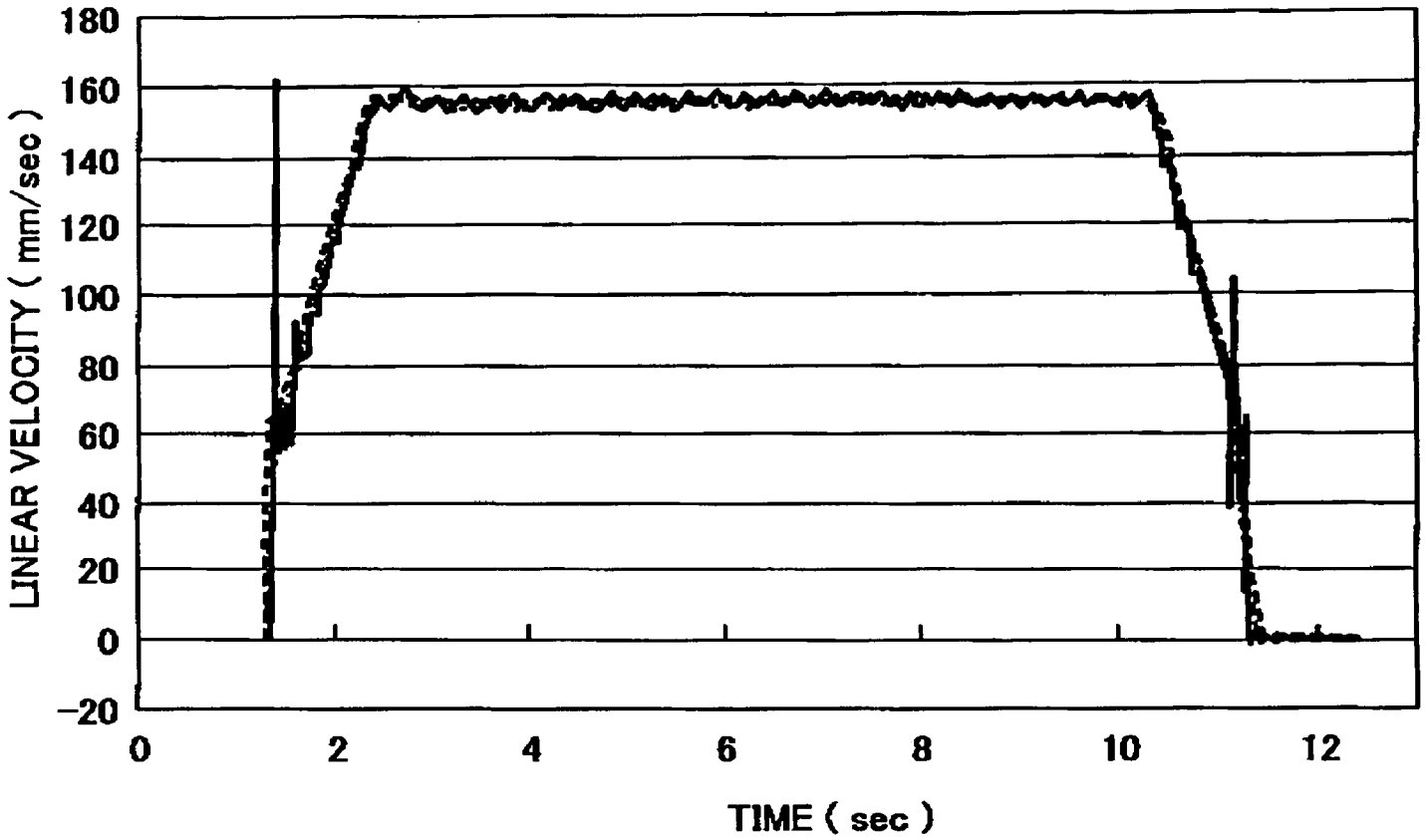
FIG. 14 is a graph showing surface linear velocities of the two photoconductor motors and the drive motor during the rise time period, a steady rotation time period and the fall time period.

Referring to FIG. 14, another test result is described. Tests were conducted under a condition that the photoconductor motors M1 and M2 and drive motor DM start and stop at a speed of 1000 msec, and steadily rotate at a speed of 6000 msec. As shown in FIG. 13, a solid line represents an actual measured value of the intermediate transfer member 3, a dashed line represents an actual measured value of the photoconductor 2*bk*, and a short and long dash line represents an actual measured value of the photoconductor 2*m*. FIG. 14 can tell that the photoconductor motors M1 and M2 including the DC brushless motor can be controlled at the start and stop thereof.

In FIG. 13, the supply of the command clock signal is continuously increased at the start of the photoconductor motors M1 and M2. By doing so, the surface linear velocities of the photoconductors 2*m* and 2*bk* linearly start as well. The status is same as a status at the start shown in FIG. 14. However, if the photoconductor motors M1 and M2 are controlled at the start and stop thereof, in a same manner as described above, a large amount of memory is required, and thereby a cost of the image forming apparatus 1 may be increased.

Hence, in a period at least one of the start and stop of the clock control motor including the DC brushless motor, the number of clocks of the command clock signal is changed in stages to control the number of rotations of the clock control motor. By doing so, an excessive amount of memory is not required and the cost of the image forming apparatus may be reduced.

Figure 15:
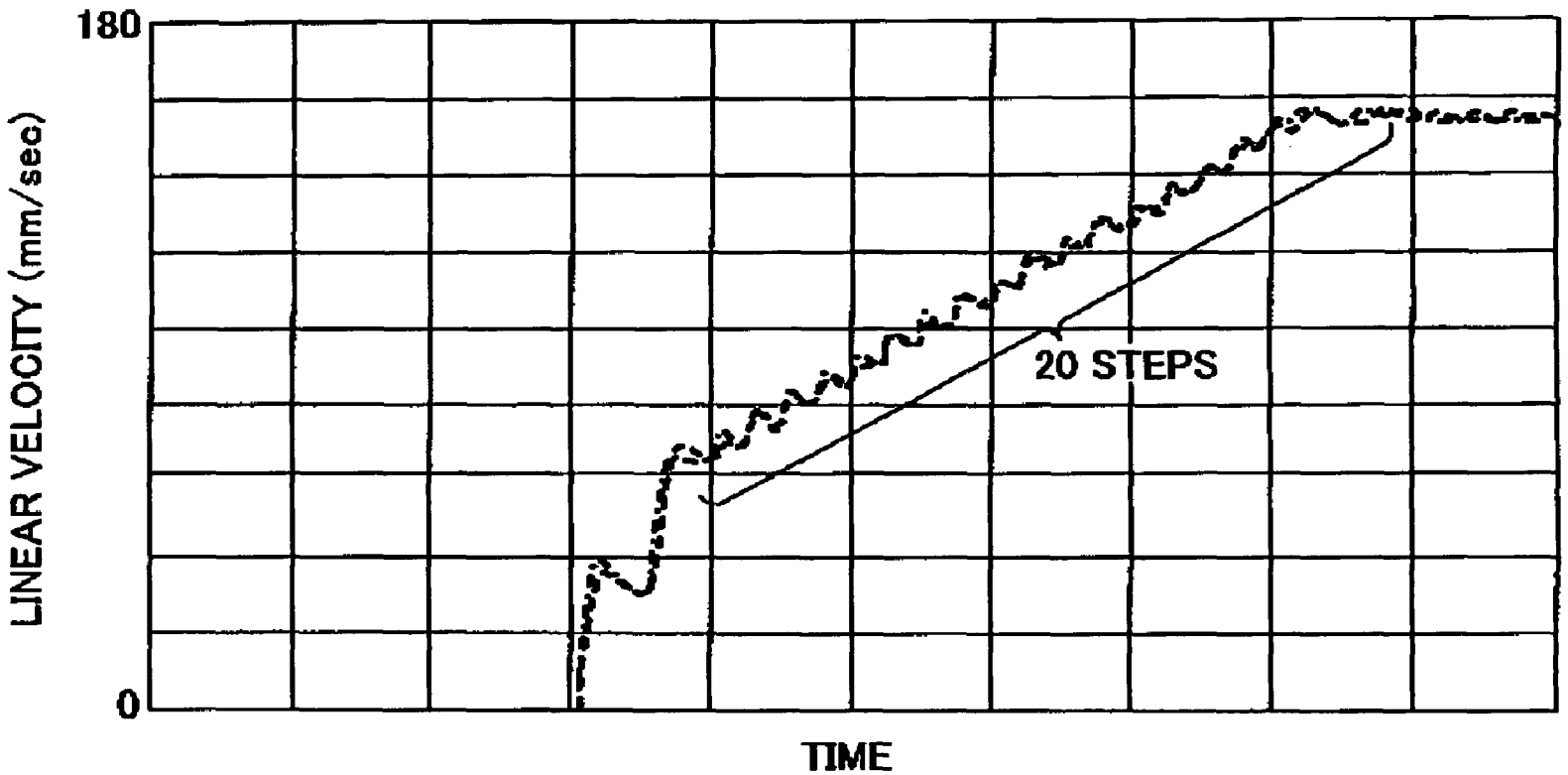
FIG. 15 is a graph showing surface linear velocities of the two photoconductor motors during the rise time period.

Referring to FIG. 15, an example of the test that the clocks of the command clock signal is changed in twenty stages when the photoconductor motors M1 and M2 are started. In the test, the number of clocks of the command clock signal to be supplied to the photoconductor motors M1 and M2 is incremented by one per one step. In this case, the command clock signal to the first and second photoconductor motors M1 and M2 is supplied from the same source as before, the surface linear velocities of the photoconductors 2*m* and 2*bk* have a substantially same curve at the start. When the photoconductor motors M1 and M2 are stopped, the motors M1 and M2 can be controlled as described above.

As previously described, the image forming apparatus 1 shown in FIGS. 5 to 8 includes the photoconductors 2*y*, 2*c* and 2*m* for producing color toner images, the gears 23*y*, 23*c* and 23*m* coupled with the photoconductors 2*y*, 2*c* and 2*m*, respectively, the photoconductor 2*bk* for producing a black-and-white toner image, the gear 23*bk* coupled with the photoconductor 2*bk*, the first photoconductor motor M1 including the clock control motor which rotates the photoconductors 2*y*, 2*c* and 2*m* via the gears 23*y*, 23*c* and 23*m*, respectively, and the second photoconductor motor M2 including the clock control motor which rotates the photoconductor 2*bk* via the gear 23*bk*. Both of the clock control motors for color and black-and-white images include the DC brushless motor.

When the above described gears 23*y*, 23*c*, 23*m* and 23*bk* include a resin material, it is generally mandatory that they have eccentricity to their respective shafts. With such eccentricity, an overlaid full-color image transferred from the photoconductors 2*y*, 2*c*, 2*m* and 2*bk* onto the intermediate transfer member 3 may have color shift therein. Hence, in the image forming apparatus 1 of the present invention, to prevent the color shift of the overlaid full-color image, the gears 23*y*, 23*c*, 23*m* and 23*bk* are disposed to have their predetermined phases in the rotation direction of the gears 23*y*, 23*c*, 23*m* and 23*bk*. It is commonly known that background image forming apparatuses have such structure as described above.

Figure 17:
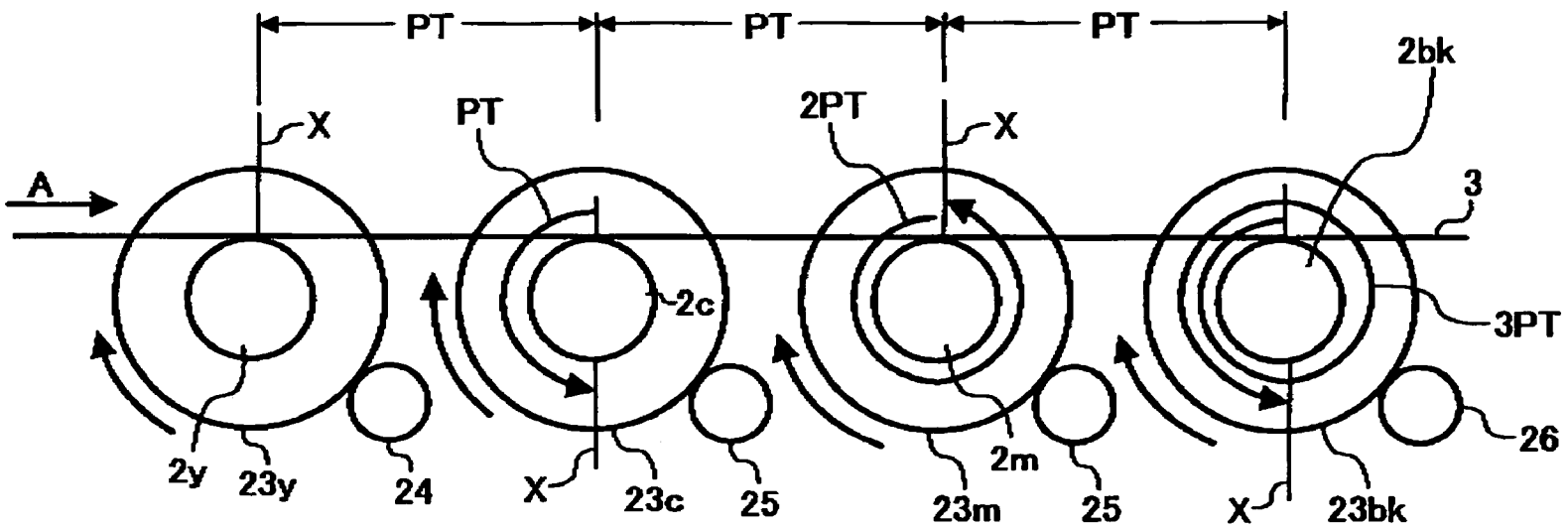
FIG. 17 is a schematic structure of a phase relationship of a plurality of gears.

Referring to FIG. 17, positions and phases of the gears 23*y*, 23*c*, 23*m* and 23*bk* and the photoconductors 2*y*, 2*c*, 2*m* and 2*bk* corresponding to the gears 23*y*, 23*c*, 23*m* and 23*bk* are described. The photoconductors 2*y*, 2*c*, 2*m* and 2*bk* have a portion contacting the intermediate transfer member 3 for transferring respective single color toner images formed on the surfaced thereon onto the surface of the intermediate transfer member 3. The portion is referred to as a "transfer portion". A distance from the transfer portion of one photoconductor to that of another photoconductor mounted next to the one photoconductor is referred to as a "distance PT". That is, the distance PT is formed between the photoconductors 2*y* and 2*c*, between the photoconductors 2*c* and 2*m*, and between the photoconductors 2*m* and 2*bk*. In addition, a reference position is provided to each of the gears 23*y*, 23*c*, 23*m* and 23*bk* which have an eccentricity equal to each other, and the photoconductors 2*y*, 2*c*, 2*m* and 2*bk* corresponding to the gears 23*y*, 23*c*, 23*m* and 23*bk* in the circumferential direction thereof. The reference position is referred to as a "reference position X", and is arranged at a portion farthest from the center of the shaft of the gears 23*y*, 23*c*, 23*m* and 23*bk*, and that of the photoconductors 2*y*, 2*c*, 2*m* and 2*bk* corresponding to the gears 23*y*, 23*c*, 23*m* and 23*bk*, respectively, in the circumferential direction.

FIG. 17 shows a status that the reference position X of the photoconductor 2*y* for a yellow toner image is at the transferring portion, that is, a status that the yellow toner image formed on the surface of the photoconductor 2*y* is transferred onto the intermediate transfer member 3. In FIG. 17, the photoconductors 2*y* and 2*c* are arranged adjacent to each other with the distance PT. That is, the reference position X of the photoconductor 2*c* is located upstream from its transfer portion by the distance PT in the rotation direction of the photoconductor 2*c*. Similar to the photoconductor 2*c*, the reference position X of the photoconductor 2*m* is located upstream from its transfer portion by approximately twice the distance PT, and the reference position X of the photoconductor 2*bk* is located upstream from its transfer position by approximately three times the distance PT.

As shown in FIG. 8, the gears 23*y*, 23*c*, 23*m* and 23*bk* are in mesh with the intermediate gear 24 and the first and second output gears 25 and 26. However, FIG. 17 shows, as a matter of convenience, that the intermediate gear 24 and the first and second output gears 25 and 26 which drive the gears 23*y*, 23*c*, 23*m* and 23*bk* are in mesh with the gears 23*y*, 23*c*, 23*m* and 23*bk* at identical positions in the circumferential direction thereof.

As described above, the circumferential phases of the gears 23*y*, 23*c*, 23*m* and 23*bk* and the meshing positions of the intermediate gear 24 and the first and second output gears 25 and 26 that drive the gears 23*y*, 23*c*, 23*m* and 23*bk* are specified. With this structure, even if the gears 23*y*, 23*c*, 23*m* and 23*bk* have a slight eccentricity, the overlaid full-color toner image transferred onto the intermediate transfer member 3 may be prevented from color shift. The circumferential phases of the gears 23*y*, 23*c*, 23*m* and 23*bk* and the meshing positions of the intermediate gear 24 and the first and second output gears 25 and 26 that drive the gears 23*y*, 23*c*, 23*m* and 23*bk*, as shown in FIG. 8, are relatively specified so as to obtain the same effect as that shown in FIG. 17. That is, the gears 23*y*, 23*c*, 23*m* and 23*bk* have respective-mounting angles to prevent the color shift on a full-color image completely produced.

Here, in the image forming apparatus 1 of the present invention, a color image is produced in the color mode and a black-and-white image is produced in the black-and-white mode, as previously described. In an image forming operation in the color mode, the first photoconductor motor M1 drives the photoconductors 2*y*, 2*c* and 2*m* to-rotate for forming respective single color toner images on the surfaces thereon, and the second photoconductor motor M2 drives the photoconductor 2*bk* to rotate for forming a black-and-white toner image on the surface thereon. The respective single color toner images and the black-and-white toner image are then transferred onto the intermediate transfer member 3, and onto the recording medium P to obtain a full-color image. Further, in an image forming operation in the black-and-white mode, the first photoconductor motor M1 does not operate the photoconductors 2*y*, 2*c* and 2*m* while the second photoconductor motor M2 drives the photoconductor 2*bk* to rotate for forming a black-and-white toner image on the surface thereon. The black-and-white toner image is then transferred onto the intermediate transfer member 3, and onto the recording medium P to obtain a black-and-white image. Specifically, while the photoconductors 2*y*, 2*c*, 2*m* and 2*bk* are held in contact with the intermediate transfer member 3 in the color mode, the photoconductors 2*y*, 2*c*, and 2*m* are separated from the intermediate transfer member 3 and the photoconductor 2*bk* is held in contact with the intermediate transfer member 3 in the black-and-white mode. The color mode and the black-and-white mode are selectably provided to the image forming apparatus 1 of the present invention.

As previously described, when the image forming operation is performed in-the black-and-white mode, only the photoconductor 2*bk* is rotated but the photoconductors 2*y*, 2*c* and 2*m* are stopped. Therefore, the gears 23*y*, 23*c*, 23*m* and 23*bk* shown in FIG. 17 may be out of phase in the circumferential direction thereof.

However, the image forming apparatus 1 of the present invention is provided with the feelers Fm and Fbk, and the first and second sensors 34*m* and 34*bk*. And, the image forming apparatus 1 also applies the brake on the first and second photoconductor motors M1 and M2 including the DC brushless motor at the stop thereof in the color mode, and it also applies the brake on the second photoconductor motor M2 in the black-and-white mode. Therefore, the gears 23*y*, 23*c*, 23*m* and 23*bk* and the photoconductors 2*y*, 2*c*, 2*m* and 2*bk* can be stopped at an approximately same position. By doing so, the previously described relationship of the gears 23*y*, 23*c*, 23*m* and 23*bk* is prevented from significantly being out of the above-described phase.

However, it is difficult for the above-described braking unit to maintain the relationship of phases of the gears 23*y*, 23*c*, 23*m* and 23*bk* with a high precision. Therefore, another structure instead of the above-described braking unit is preferably employed for adjusting the relationship of phases-of the gears 23*y*, 23*c*, 23*m* and 23*bk*.

As previously described with reference to FIG. 8, the image forming apparatus 1 includes the first and second sensors 34*m* and 34*bk* for detecting the feelers Fm and Fbk provided to the gears 23*m* and 23*bk*. The first sensor 34*m* detects a first position, which corresponds to the position of the feeler Fm, of the gear 23*m* in the circumferential direction of the gear 23*m*, and the second sensor 34*bk* detects a second position, which corresponds to the position of the feeler Fbk, of the gear 23*bk* in the circumferential direction of the gear 23*bk*. As an alternative, the feelers Fm and Fbk may be provided at the first and second positions, respectively, of the photoconductors 2*m* and 2*bk*, respectively, so that the first and second sensors 34*m* and 34*bk* can detect the feelers Fm and Fbk.

As described above, the image forming apparatus 1 includes the first sensor 34*m* for detecting the first position in the circumferential direction of the gear 23*m* (in FIG. 8) for a color image, and the second sensor 34*bk* for detecting the second position in the circumferential direction of the gear 23*bk* for a black-and-white image. In the image forming apparatus 1, the phases of the respective gears 23*y*, 23*c* and 23*m* for the color images and that of the gear 23*bk* for the black-and-white are adjusted in a period after the first and second photoconductor motors M1 and M2 are stopped and before the next image forming operation is started. That is, the relationship of the phases is adjusted in a period before the first and second photoconductor motors M1 and M2 steadily rotate. At this time, a time lag may be generated between a time when the first sensor 34*m* detects the first position that is the position of the feeler Fm and that when the second sensor 34*bk* detect the second position that is the position of the feeler Fbk, which is represented by "Δt". According to the time lag Δt, the number of rotations of at least one photoconductor motor of the first and second photoconductor motors M1 and M2 may be controlled, and the gears 23*y*, 23*c*, 23*m* and 23*bk* maintain or become close to the above-described relationship of the phases.

More specifically, when the color gears 23*y*, 23*c* and 23*m* and the black-and-white gear 23*bk* are correctly arranged to maintain the above-described respective predetermined phases for preventing the color shift and are rotated at the steady rotation, a reference time lag generated between a time when the first sensor 34*m* detects the feeler Fm and a time when the second sensor 34*bk* detects the feeler Fbk, which is defined as "ΔT". The time lag ΔT may include an appropriate number including zero (0). In this example, the reference time lag ΔT is set to zero. And, before adjusting the actual phases, according to a time difference between the time lag Δt and the reference time lag ΔT (zero in this example), the number of clocks of-the command clock signal to be supplied from the control circuit 30 to the first and second photoconductor motors M1 and M2 is increased or decreased. By doing so, the number of the photoconductor motors M1 and M2 can be controlled and the relationship of the phases of the gears 23*y*, 23*c*, 23*m* and 23*bk* are adjusted as described above. Then, the numbers of rotations of the photoconductor motors M1 and M2 are returned to those for the steady rotations to perform the image forming operations. With this structure, a color shift may be reduced and a high quality image may be obtained. When the time difference between the time lag Δt and the reference time lag ΔT is defined as a sensor detection time lag ΔS, the sensor detection time lag ΔS of the image forming apparatus 1 of the present invention may be equal to the time lag Δt.

As described above, the control unit including the control circuit 30 is configured such that when adjusting the relationship of the phases of the color gears 23*y*, 23*c* and 23*m* and the black-and-white gear 23*bk*, according to the time lag generated between a time when the first sensor 34*m* detects the first position and a time when the second sensor 34*bk* detects the second position, the number of rotations of at least one of the photoconductor motors M1 and M2. The control unit controls by changing the number of rotations of at least one of the first and second photoconductor motors M1 and M2 the color photoconductors 2*y*, 2*c* and 2*m*, so that the predetermined relationship of the phases of the color gears 23*y*, 23*c* and 23*m* and the black-and-white gear 23*bk* may be obtained in a period after the first and second photoconductor motors M1 and M2 are stopped and before the next image forming operation is started, that is, before the first and second photoconductor motors M1 and M2 steadily rotate.

Figure 18A:
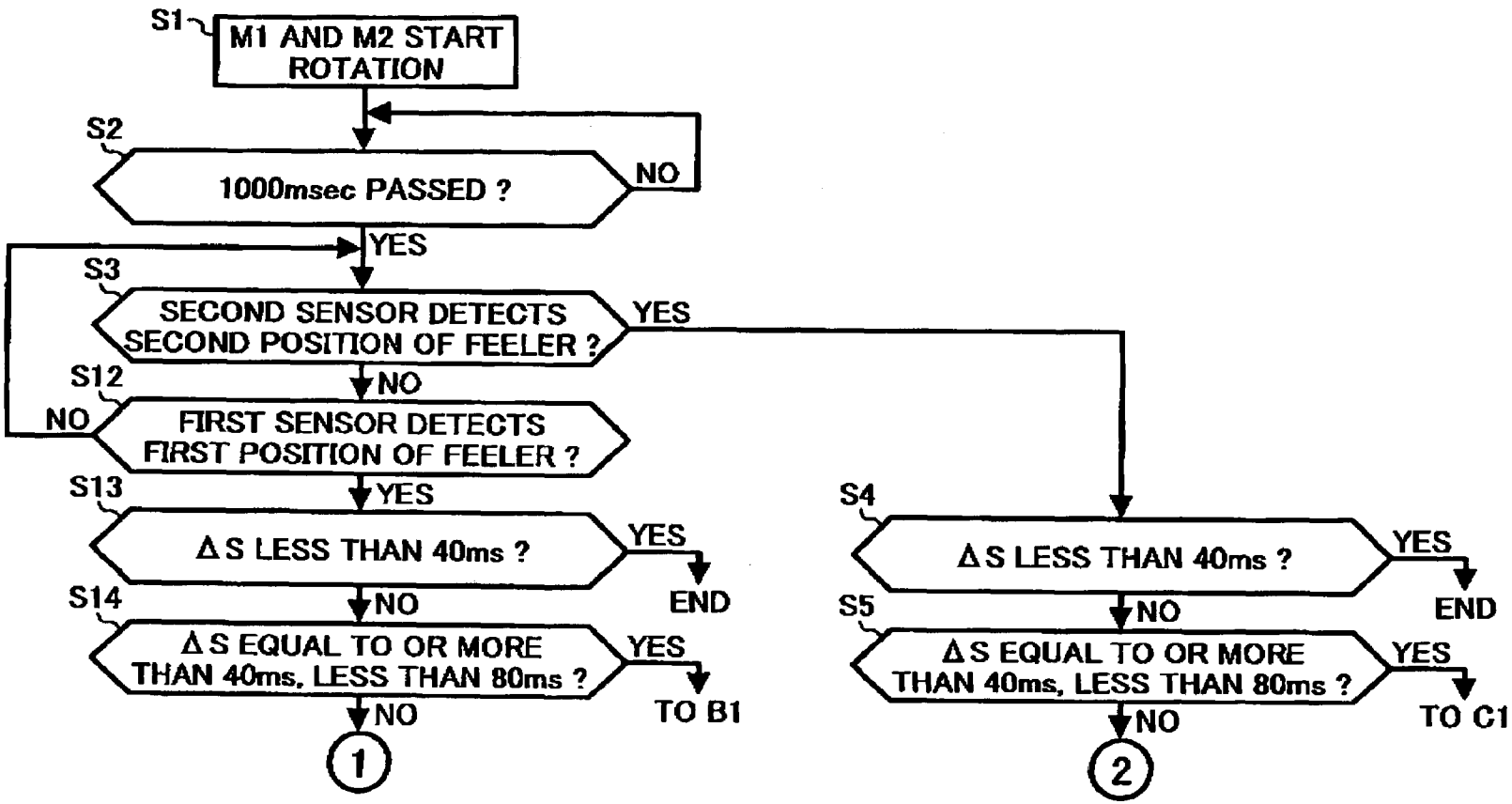
FIGS. 18A and 18B are flowcharts showing an adjustment of the plurality of gears.
Figure 18B:
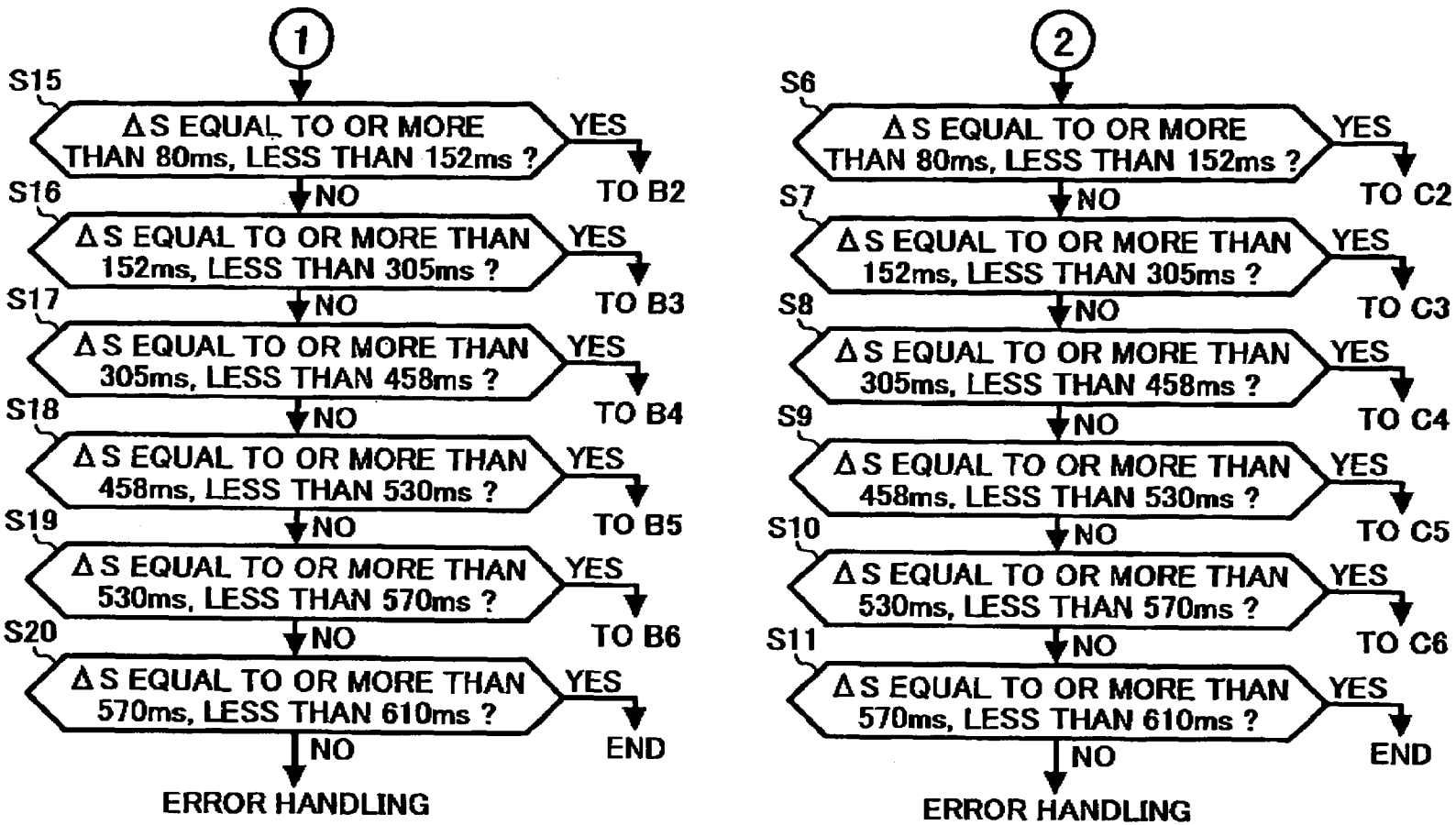

Referring to FIG. 18, a detailed example of the phase. adjusting operation of the relationship of the above-described phases is described.

In Step S1 of FIG. 18, rotations of the first and second photoconductor motors M1 and M2 are started. In Step S2, it is determined whether 1000 msec, which is a rise time period of the photoconductor motors M1 and M2, has passed. When 1000 msec has not passed and when the determination result in Step S2 is NO, the process of Step S2 repeats until the rotation speeds of the photoconductor motors M1 and M2 exceed 1000 msec. When 1000 msec has passed and the determination result in Step S2 is YES, the first and second sensors 34*m* and 34*bk* are started to be checked. In Step S3, it is determined whether the second sensor 34*bk* detects the feeler Fbk, which is the second position of the black-and-white gear 23*bk*, before the first sensor 34*m* detects the feeler Fm. When the second sensor 34*bk* detects the feeler Fbk before the first sensor 34*m* detects the feeler Fm and when the determination result in Step S3 is YES, the procedure goes to Steps S4 through S11 of FIG. 18. (When the second sensor 34*bk* does not detect the feeler Fbk before the first sensor 34*m* detects the feeler Fm and when the determination result in Step S3 is NO, the procedure goes to Step S12.)

In Step S4 of FIG. 18, it is determined whether the above-described sensor detection time lag ΔS is less than 40 ms. When the sensor detection time lag ΔS is less than. 40 ms and when the determination result in Step S4 is YES, the phase adjusting operation is completed. When the sensor detection time lag ΔS is equal to or more than 40 ms and when the determination result in Step S4 is NO, the procedure goes to Step S5.

In Step S5 of FIG. 18, it is determined whether the sensor detection time lag ΔS is equal to or more than 40 ms and less than 80 ms. When the sensor detection time lag ΔS is equal to or more than 40 ms and less than 80 ms and when the determination result in Step S5 is YES, the procedure goes to a process C1 (see below for details). When the sensor detection time lag ΔS is not equal to or more than 40 ms and not less than 80 ms and when the determination result in Step S5 is NO, the procedure goes to Step S6.

In Step S6 of FIG. 18, it is determined whether the sensor detection time lag ΔS is equal to or more than 80 ms and less than 152 ms when the sensor detection time lag ΔS is equal to or more than 80ms and less than 152 ms and when the determination result in Step S6 is YES, the procedure goes to a process C2 (see below for details). When the sensor detection time lag ΔS is not equal to or more than 80 ms and not less than 152 ms and when the determination result in Step S6 is NO, the procedure goes to Step S7.

In Step S7 of FIG. 18, it is determined whether the sensor detection time lag Δs is equal to or more than 152 ms and less than 305 ms. When the sensor detection time lag ΔS is equal to or more than 152 ms and less than 305 ms and when the determination result in Step S7 is YES, the procedure goes to a process C3 (see below for details). When the sensor detection time lag ΔS is not equal to or more than 152 ms and not less than 305 ms and when the determination result in Step S7 is NO, the procedure goes to Step S8.

In Step S8 of FIG. 18, it is determined whether the sensor detection time lag ΔS is equal to or more than 305 ms and less than 458 ms. When the sensor detection time lag ΔS is equal to or more than 305 ms and less than 458 ms and when the determination result in Step S8 is YES, the procedure goes to a process C4 (see below for details). When the sensor detection time lag ΔS is not equal to or more than 305 ms and not less than 458 ms and when the determination result in Step S8 is NO, the procedure goes to Step S9.

In Step S9 of FIG. 18, it is determined whether the sensor detection time lag ΔS is equal to or more than 458 ms and less than 530 ms. When the sensor detection time lag ΔS is equal to or more than 458 ms and less than 530 ms and when the determination result in Step S9 is YES, the procedure goes to a process C5 (see below for details). When the sensor detection time lag ΔS is not equal to or more than 458 ms and not less than 530 ms and when the determination result in Step S9 is NO, the procedure goes to Step S10.

In Step S10 of FIG. 18, it is determined whether the sensor detection time lag ΔS is equal to or more than 530 ms and less than 570 ms. When the sensor detection time lag ΔS is equal to or more than 530 ms and less than 570 ms and when the determination result in Step S10 is YES, the procedure goes to a process C6 (see below for details). When the sensor detection time lag ΔS is not equal to or more than 530 ms and not less than 570 ms and when the determination result in Step S10 is NO, the procedure goes to Step S11.

In Step S11 of FIG. 18, it is determined whether the sensor detection time lag ΔS Is equal to or more than 570 ms and less than 610 ms. When the sensor detection time lag Δs is equal to or more than 570 ms and less than 610 ms and when the determination result in Step S11 is YES, the phase adjusting operation is completed. When the sensor detection time lag ΔS is equal to or more than 610 ms and when the determination result in Step S11 is NO, the procedure goes to an error handling operation.

For example, when the sensor detection time lag ΔS is less than 40 ms in Step S4 or when the sensor detection time lag ΔS is equal to or more than 570 ms and less than 610 ms, the gears 23*y*, 23*c*, 23*m* and 23*bk* are, fox example, approximately ±22.5 degrees and are rarely out of phases. Accordingly, it is determined that the operation states of the gears 23*y*, 23*c*, 23*m* and 23*bk* are regarded as being within a regular range and the process is completed. Here, a time of 610 ms indicates a time required for one cycle of the photoconductor 2*bk*. When the sensor detection time lag ΔS makes any value indicated in Steps S5 through 10, one of the following processes C1 through C6 is performed according to the value. Rates (%) indicated below represent a rotation rate of each photoconductor during the steady rotation time:

Process C1: Number of Rotations of Photoconductor 2BK−5%,

Number of Rotations of Photoconductor 2M+5%;

Process C2: Number of Rotations of Photoconductor 2BK−10%,

Number of Rotations of Photoconductor 2M+10%;

Process C3: Number of Rotations of Photoconductor 2BK−16%,

Number of Rotations of Photoconductor 2M+16%;

Process C4: Number of Rotations of Photoconductor 2BK+16%,

Number of Rotations of Photoconductor 2M−16%;

Process C5: Number of Rotations of Photoconductor 2BK+10%,

Number of Rotations of Photoconductor 2M−10%;

Process C6: Number of Rotations of Photoconductor 2BK+5%,

Number of Rotations of Photoconductor 2M−5%.

As described above, when the second sensor 34*bk* does not detect the feeler Fbk before the first sensor 34*m* detects the feeler Fm and when the determination result in Step S3 is NO, the procedure goes to Step S12.

In Step S12, it is determined whether the first sensor 34*m* detects the feeler Fm before the second sensor 34*bk* detects the feeler Fbk. When the first sensor 34*m* detects the feeler Fm before the second sensor 34*bk* detects the feeler Fbk and when the determination result in Step S12 is YES, the procedure goes to Steps S13 through 520 of FIG. 18, When the first sensor 34*m* does not detect the feeler Fm before the second sensor 34*bk* detects the feeler Fbk and when the determination result in Step S12 is NO, the process of Step S12 goes back to a procedure before Step S3 and repeats until the first sensor 34*m* detects the feeler m before the second sensor 34*bk* detects the feeler Fbk.

In Step S13 of FIG. 18, it is determined whether the above-described sensor detection time lag ΔS is less than 40 ms. When the sensor detection time lag ΔS is less than 40 ms and when the determination result in Step S13 is YES, the phase adjusting operation is completed. When the sensor detection time lag ΔS is equal to or more than 40 ms and when the determination result in Step S13 is NO, the procedure goes to Step S14.

In Step S14 of FIG. 18, it is determined whether the sensor detection time lag ΔS is equal to or more than 40 ms and less than 80 ms. When the sensor detection time lag ΔS is equal to or more than 40 ms and less than 80 ms and when the determination result in Step S14 is YES, the procedure goes to a process B1 (see below for details). When the sensor detection time lag Δs is not equal to or more than 40 ms and not less than 80 ms and when the determination result in Step S14 is NO, the procedure goes to Step S15.

In Step S15 of FIG. 18, it is determined whether the sensor detection time lag ΔS is equal to or more than 80 ms and less than 152 ms. When the sensor detection time lag ΔS is equal to or more than 80 ms and less than 152 ms and when the determination result in Step S15 is YES, the procedure goes to a process B2 (see below for details). When the sensor detection time lag ΔS is not equal to or more than 80 ms and not less than 152 ms and when the determination result in Step S15 is NO, the procedure goes to Step S16.

In Step S16 of FIG. 18, it is determined whether the sensor detection time lag ΔS is equal to or more than 152 ms and less than 305 ms. When the sensor detection time lag ΔS is equal to or more than 152 ms and less than 305 ms and when the determination result in Step S16 is YES, the procedure goes to a process B3 (see below for details). When the sensor detection time lag ΔS is not equal to or more than 152 ms and not less than 305 ms and when the determination result in Step S16 is NO, the procedure goes to Step S17.

In Step S17 of FIG. 18, it is determined whether the sensor detection time lag ΔS is equal to or more than 305 ms and less than 458 ms. When the sensor detection time lag ΔS is equal to or more than 305 ms and less than 458 ms and when the determination result in Step S17 is YES, the procedure goes to a process B4 (see below for details). When the sensor detection time lag ΔS is not equal to or more than 305 ms and not less than 458 ms and when the determination result in Step S17 is NO, the procedure goes to Step S18.

In Step S18 of FIG. 18, it is determined whether the sensor detection time lag ΔS is equal to or more than 458 ms and less than 530 ms. When the sensor detection time lag ΔS is equal to or more than 458 ms and less than 530 ms and when the determination result in Step S18 is YES, the procedure goes to a process B5 (see below for details). When the sensor detection time lag ΔS is not equal to or more than 458 ms and not less than 530 ms and when the determination result in Step S18 is NO, the procedure goes to Step S19.

In Step S19 of FIG. 18, it is determined whether the sensor detection time lag ΔS is equal to or more than 530 ms and less than 570 ms. When the sensor detection time lag ΔS is equal to or more than 530 ms and less than 570 ms and when the determination result in Step S19 is YES, the procedure goes to a process B6 (see below for details). When the sensor detection time lag ΔS is not equal to or more than 530 ms and not less than 570 ms and when the determination result in Step S19 is NO, the procedure goes to Step S20.

In Step S20 of FIG. 18, it is determined whether the sensor detection time lag ΔS is equal to or more than 570 ms and less than 610 ms. When the sensor detection time lag ΔS is equal to or more than 570 ms and less than 610 ms and when the determination result in Step S20 is YES, the phase adjusting operation is completed. When the sensor detection time lag ΔS is equal to or more than 610 ms and when the determination result in Step S20 is NO, the procedure goes to an error handling operation.

Similar to the processes of Steps S4 through S11, when the sensor detection time lag ΔS makes any value indicated in Steps S14 through 19, one of the following processes B1 through B6 is performed according to the value. When the sensor detection time lag ΔS is less than 40 ms and when the sensor detection time lag ΔS is equal to or more than 570 ms and less than 610 ms, the phase adjusting process is completed.

Process B1: Number of Rotations of Photoconductor 2BK+5%,
Number of Rotations of Photoconductor 2M−5%;

Process B2: Number of Rotations of Photoconductor 2BK+10%,
Number of Rotations of Photoconductor 2M−10%;

Process B3: Number of Rotations of Photoconductor 2BK+16%,
Number of Rotations of Photoconductor 2M−16%;

Process B4: Number of Rotations of Photoconductor 2BK−16%,
Number of Rotations of Photoconductor 2M+16%;

Process B5: Number of Rotations of Photoconductor 2BK−10%,
Number of Rotations of Photoconductor 2M+10%;

Process B6: Number of Rotations of Photoconductor 2BK−5%,
Number of Rotations of Photoconductor 2M+5%.

As previously described, to increase and decrease the numbers of rotations of the gears 23*y*, 23*c*, 23*m* and 23*bk* and the respective photoconductors 2*y*, 2*c*, 2*m* and 2*bk*, the numbers of rotations of the first and second photoconductor motors M1 and M2 during the steady rotation time are controlled to be changed. The photoconductor motors M1 and M2 are then rotated at the changed numbers of rotations to adjust the phases of the gears 23*y*, 23*c*, 23*m* and 23*bk*. After adjusting the phases of the gears 23*y*, 23*c*, 23*m* and 23*bk*, the changed numbers of rotations of the photoconductor motors M1 and M2 are changed back to their original numbers of rotations during the steady rotation time to perform the image forming operations.

Table 3 shows the above-described sensor detection time lag ΔS, an angular difference with respect to the sensor detection time lag ΔS, and fluctuation in the numbers of rotations of the respective photoconductor motors for correcting the sensor detection time lag ΔS.

TABLE 3

| Angular Difference | ΔS | Fluctuation in Rotations of Photoconductor |
|---|---|---|
| Equal to or more than ±90 degrees to equal to or less than 180 degrees | Equal to or more than ±152 ms to equal to or less than 305 ms | ±16% |
| Equal to or more than ±45 degrees to less than 90 degrees | Equal to or more than ±80 ms to less than 152 ms | ±10% |
| Equal to or more than ±22.5 degrees to less than 45 degrees | Equal to or more than ±40 ms to less than 80 ms | ±5% |
| Equal to or more than ±0 degree to equal to or less than 22.5 degree | Equal to or more than ±0 ms to less than 40 ms | 0 |

Figure 19:
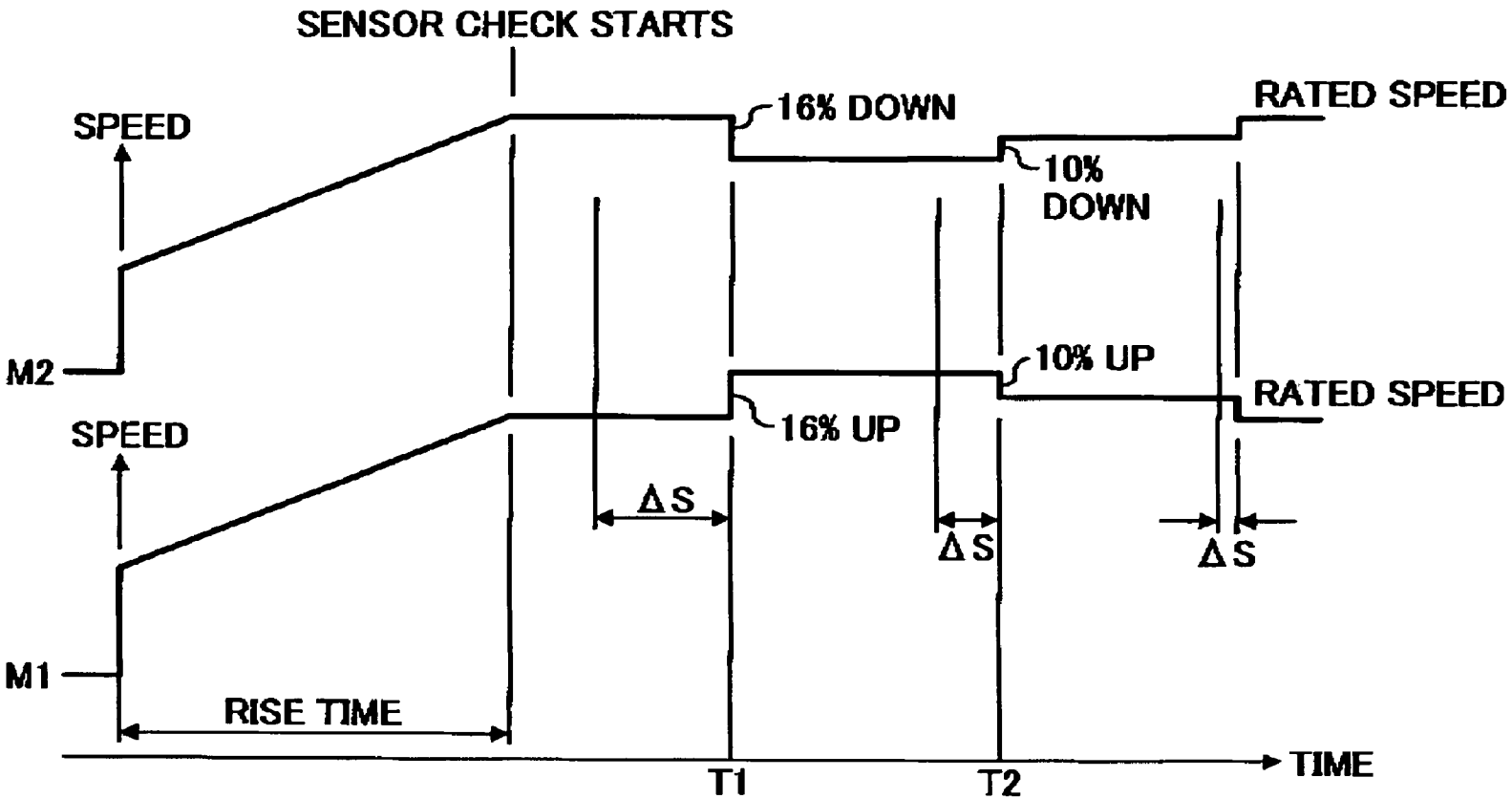
FIG. 19 is a graph of a control of motor rotations of the photoconductor motors.

Referring to FIG. 19, an example of controlling the rotations of the photoconductor motors M1 and M2 is described.

As shown in FIG. 19, in a case where the sensor detection time lag ΔS is detected after the first and second photoconductor motors M1 and M2 are started, the numbers of rotations of the photoconductor motors M1 and M2 are changed at a time T1 to respective values with respect to the steady rotation time, When the sensor detection time lag ΔS is detected again, the numbers of rotations of the photoconductor motors M1 and M2 are changed at a time T2. The number of rotations may be changed every time the sensor detection time lag ΔS is detected, to make the number of rotations set back to the number of rotations of the photoconductor motors M1 and M2 for their steady rotation time. In FIG. 19, the numbers of rotations of the. photoconductor motors M1 and M2 are changed by 16% on the first attempt, and by 10% on the second attempt, to the number of rotations thereof during the steady rotation time, so that the numbers of rotations of the photoconductor motors M1 and M2 are set back to that during the steady rotation time (a rated number of rotations).

In the example as described above, the numbers of rotations of the first and second photoconductor motors. M1 and M2 are controlled according to the values of the sensor detection time lag ΔS to adjust the phases of the gears 23*y*, 23*c*, 23*m*, and 23*bk* to the predetermined states at short times. As an alternative, the number of rotations of one of the photoconductor motors M1 and M2 may be controlled. Table 4 shows the sensor detection time lag ΔS, an angular difference with respect to the sensor detection time lag ΔS, and fluctuation in the number of rotations of the photoconductor motor for correcting the sensor detection time lag ΔS.

TABLE 4

| Angular Difference | ΔS | Fluctuation in Rotations of Photoconductor |
|---|---|---|
| Equal to or more than ±90 degrees to equal to or less than 180 degrees | Equal to or more than ±152 ms to equal to or less than 305 ms | ±32% |

TABLE 4-continued

| Angular Difference | ΔS | Fluctuation in Rotations of Photoconductor |
|---|---|---|
| Equal to or more than ±45 degrees to less than 90 degrees | Equal to or more than ±80 ms to less than 152 ms | ±20% |
| Equal to or more than ±22.5 degrees to less than 45 degrees | Equal to or more than ±40 ms to less than 80 ms | ±10% |
| Equal to or more than ±0 degree to equal to or less than 22.5 degree | Equal to or more than ±0 ms to less than 40 ms | 0 |

Figure 20:
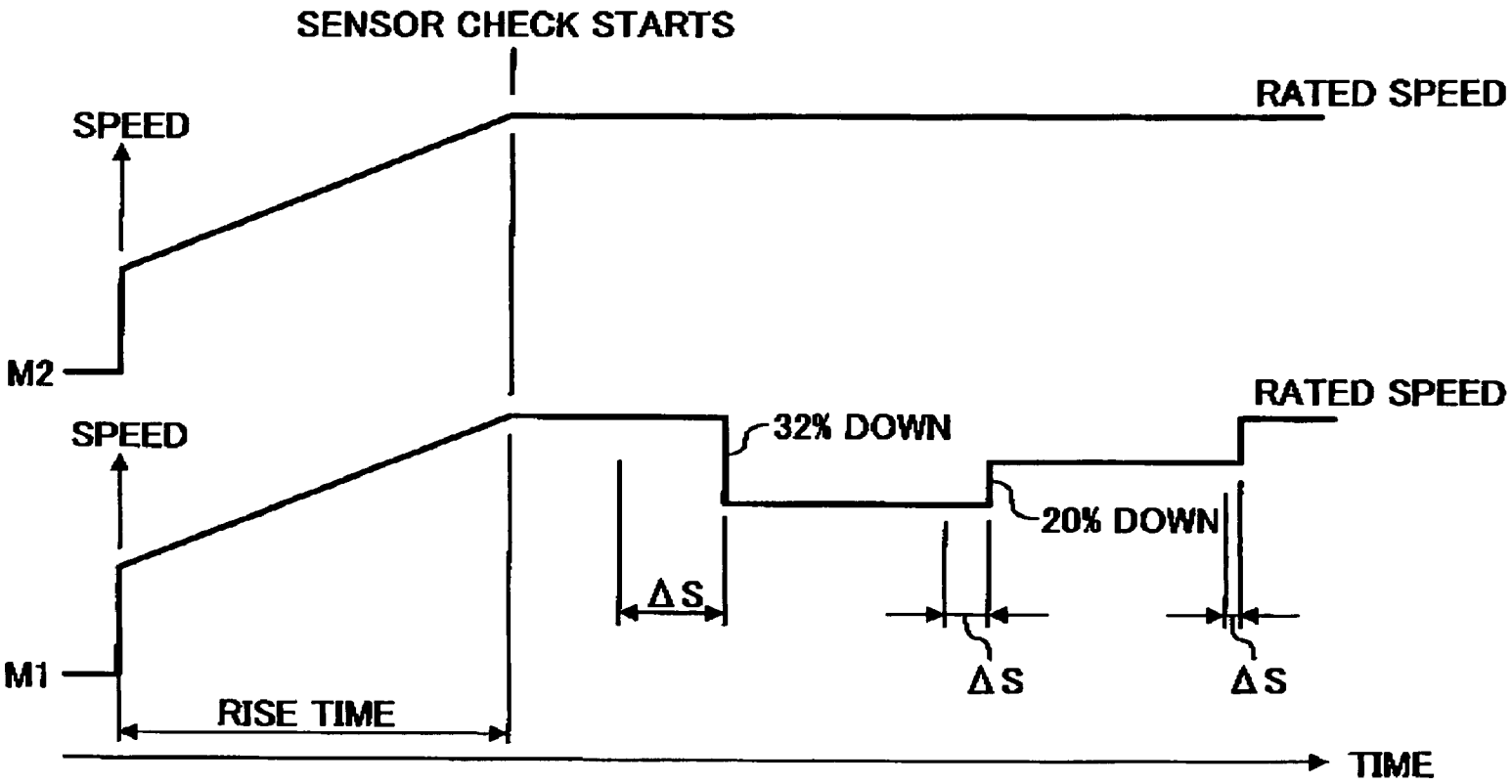
FIG. 20 is a graph of another control of motor rotations of the photoconductor motors.

Referring to FIG. 20, an example of controlling the rotation of the photoconductor motor M1 is described.

The number of rotation may be changed every time the sensor detection time lag ΔS is detected, to make the number of rotation set back to the number of rotation of the photoconductor motor M1 for its steady rotation time (a rated number of rotations).

Figure 16:
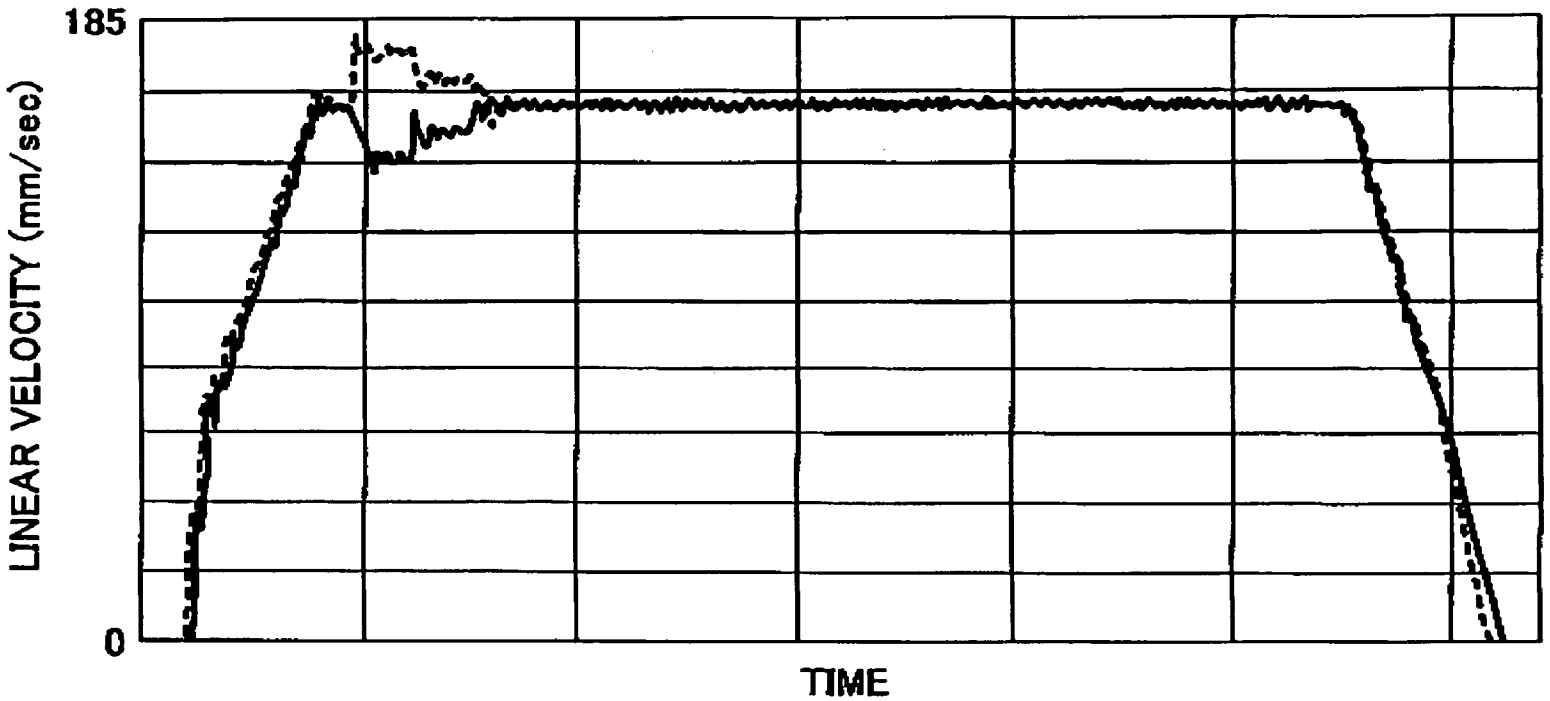
FIG. 16 is a graph showing surface linear velocities of the two photoconductor motors during the rise time period, the steady rotation time period and the fall time period.

Referring to FIG. 16, a graph of phase adjustments of the gears 23*y*, 23*c*, 23*m* and 23*bk* is described. After the first and second photoconductor motors M1 and M2 are started, the numbers of rotations of the photoconductor motors M1 and M2 are controlled according to the values of the sensor detection time lag ΔS to adjust the phases of the gears 23*y*, 23*c*, 23*m* and 23*bk*.

The above-described phase adjustment may be performed when the image forming operation in the black-and white mode is completed and that in the color mode is restarted. However, when the phase adjustment is performed when the image forming operation is started in the color mode and in the black-and-white mode, the gears 23*y*, 23*c*, 23*m* and 23*bk* may be configured to constantly have their desired phases, and thereby the image produced may be of high quality.

When the above-described braking unit is employed, the braking unit may stop the first position of the gear 23*m* in the vicinity of the first sensor 34*m* when the photoconductor motor M1 stops, and may stop the second position of the gear 23*bk* in the vicinity of the second sensor 34*bk* when the photoconductor motor M2 stops. Accordingly, if the braking unit and the above-described phase adjusting structure may be used together, when the photoconductor motors M1 and M2 start their rotations, the first and second positions of the gears 23*m* and 23*bk* are disposed at respective positions close to the first and second sensors 34*m* and 34*bk*, respectively. With this structure, the sensors 34*m* and 34*bk* detect the first and second positions, respectively, at short times. Thereby, the phases of the photoconductors 2*y*, 2*c*, 2*m* and 2*bk* may be adjusted at short times.

The image forming apparatus 1 of the present invention is Delectably provided with the color mode and the black-and-white mode, as described above. With a background image forming apparatus, a plurality of image forming operations including some jobs in the color mode and other Jobs in the black-and-white mode cannot sequentially be performed. That is, when a job performed in the color mode is completed, the photoconductor motors M1 and M2 and the drive motor DM are stopped once. Next, the photoconductors 2*y*, 2*c*, 2*m* and 2*bk* and the intermediate transfer member 3 are stopped. After that, the second photoconductor motor M2 and the drive motor DM are started again to start another job in the black-and-white mode. This structure, however, increases the number of ON and OFF operations to start the photoconductor motors M1 and M2 and the drive motor DM. Every time the ON and OFF operations are performed, the gears 23*y*, 23*c*, 23*m* and 23*bk* receive impacts caused by the ON and OFF operations, and thereby the gears 23*y*, 23*c*, 23*m* and 23*bk* may deteriorate in durability.

To eliminate the above-described inconvenience, the image forming apparatus of the present invention includes a structure such that the mode may bi-directionally be switched between the color mode and the black-and-white mode without stopping the second photoconductor motor M2 and the drive motor DM.

For example, assume that ten jobs of the image forming operations are sequentially performed, where the first five jobs are performed in the color mode before the other five jobs are performed in the black-and-white mode. Firstly, the first and second photoconductor motors M1 and M2 and the drive motor DM of FIG. 8 are started, and the first five jobs of the image forming operations are sequentially performed. Subsequently, the first photoconductor motor M1 stops while the second photoconductor motor M2 and the drive motor DM maintains their operations, and then the other five jobs are performed in the black-and-white mode.

When switching the mode from the black-and-white mode to the color mode, the second photoconductor motor M2 and the drive motor DM are started, and the image forming operations are performed in the black-and-white mode. After the jobs in the black-and-white mode are completed, the first photoconductor motor M1 is started while the second photoconductor motor M2 and the drive motor DM keeps their rotations, and then the jobs are performed in the color mode.

With the structure as described above, the number of the ON and OFF operations and the impacts made to the resin-based gears 23*y*, 23*c*, 23*m* and 23*bk* may be reduced, and thereby the lives of the gears 23*y*, 23*c*, 23*m* and 23*bk* may be made long.

Further, the image forming apparatus 1 with the direct transfer method shown in FIG. 7 includes motors and gears that are not shown in the figure. That is, photoconductors 2*y*, 2*c* and 2*m* for producing color toner images, the gears 23*y*, 23*c* and 23*m* coupled with the photoconductors 2*y*, 2*c* and 2*m*, respectively, the photoconductor 2*bk* for producing a black-and-white toner image, the gear 23*bk* coupled with the photoconductor 2*bk*, the first photoconductor motor M1 including the clock control motor which rotates the photoconductors 2*y*, 2*c* and 2*m* via the gears 23*y*, 23*c* and 23*m*, respectively, and the second photoconductor motor M2 including the clock control motor which rotates the photoconductor 2*bk* via the gear 23*bk*. The image forming apparatus 1 also includes the color mode and the black-and-white mode. In the color mode, respective single color toner images formed on the surfaces of the photoconductors 2*y*, 2*c* and 2*m* and the black-and-white toner image formed on the surface of the photoconductor 2*bk* are sequentially transferred onto the recording medium P carried by the recording medium bearing member 103 to obtain a full-color image. In an image forming operation in the black-and-white mode, the photoconductors 2*y*, 2*c*, and 2*m* are separated from the recording medium bearing member 103 and the photoconductor 2*bk* is held in contact with the recording medium bearing member 103. With this structure, the black toner image formed on the surface of the photoconductor 2*bk* are transferred onto the recording medium P carried by the recording medium bearing member 103 to obtain a black-and-white image. The color mode and the black-and-white mode are selectably provided to the image forming apparatus 1. Also in this example, both of the first and second photoconductor motors M1 and M2 include the DC brushless motor. The image forming apparatus 1 also has a structure such that the mode may bi-directionally be switched between the color mode and the black-and-white mode without stopping the second photoconductor motor M2 and the drive motor DM, and thereby the lives of the gears 23*y*, 23*c*, 23*m* and 23*bk* may be made long.

Assuming that the image forming mode is switched from the black-and-white mode to the color mode without stopping the second photoconductor motor M2 and the drive motor DM, as described above if the drive unit has a structure that the number of rotations of one of the first and second photoconductor motor M1 and M2 may be controlled to obtain the predetermined phases of the color gears 23*y*, 23*c* and 23*m* before starting the image forming operation in the color mode, the image forming operation in the color mode may produce a full-color image without the color shift. The phase adjusting operation may be performed in the same manner as the operations previously described with regard to FIGS. 16, 18 and 20. However, this operation is performed after the image forming mode is switched to the color mode. The phase adjusting operations for the gears 23*y*, 23*c*, 23*m* and 23*bk* are performed as described above, before starting the image forming operation in the color mode.

The image forming apparatus 1 shown in FIG. 5 may also include a structure such that surface linear velocities of the photoconductors 2*y*, 2*c*, 2*m* and 2*bk*, and the intermediate transfer member 3 can separately be switched. The structure may selectably be provided with a full speed mode and a low speed mode. In the full speed mode, the image forming operation is performed by rotatably driving the photoconductor and the intermediate transfer member 3 at a first surface linear velocity. In the low speed mode, the image forming operation is performed by rotatably driving the photoconductor and the intermediate transfer member 3 at a second surface linear velocity, which is lower than the first surface linear velocity. The full speed mode may speed up the image forming operation when compared with that performed in the low speed mode. On the other hand, the operation performed in the low speed mode may obtain an image with a high image density, compared with that performed in the full speed mode.

Figure 21:
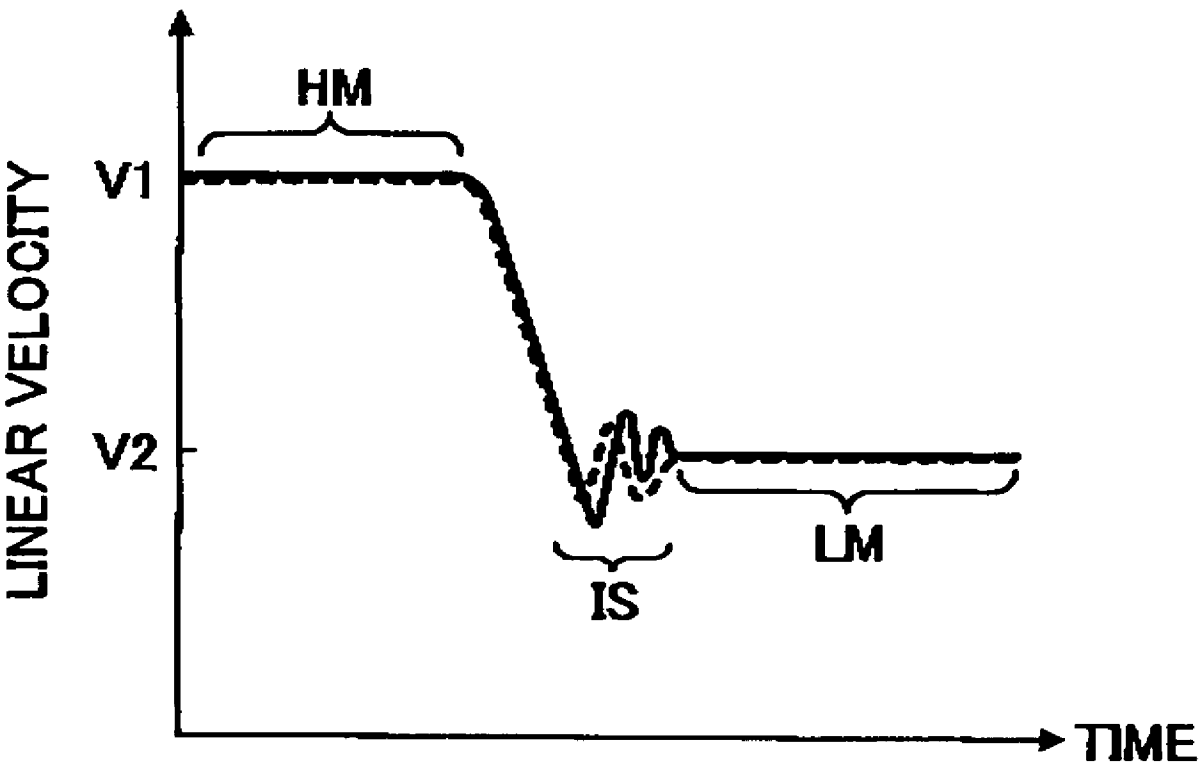
FIG. 21 is a graph of a surface linear velocity of the photoconductor motors when they are switched from a full speed mode to a low speed mode.

Referring to FIG. 21, a surface linear velocity of a photoconductor in the color mode is described. The surface linear velocity in FIG. 21 is obtained when a speed mode of the photoconductor is changed from a high speed mode HM to a low speed mode LM in the middle of the image forming operation performed in the color mode. The solid line represents surface linear velocities of the photoconductors 2*y*, 2*c* and 2*m*, and the dashed line represents a surface linear velocity of the photoconductor 2*bk*. A value of "V1" represents a surface linear velocity obtained in the high speed mode, and a value of "V2" represents a surface linear velocity obtained in the low speed mode.

When the speed mode is changed from the high speed mode HM to the low speed mode LM, the first and second photoconductor motors M1 and M2 and the drive motor DM are still activated without stopping. At this time, in a period IS, which is a predetermined period before the surface linear velocity of the photoconductor is stably controlled to the low speed V2, the surface linear velocities of the photoconductors 2*y*, 2*c* and 2*m* and that of the photoconductor 2*bk* may become drastically different to each other, according to an over shoot of the photoconductors 2*y*, 2*c*, 2*m* and 2*bk*. When such difference occurs, the gears 23*y*, 23*c*, 23*m* and 23*bk* may drastically be out of phase, and the color shift may occur in the subsequent color mode. The above-described inconvenience may occur when the speed mode is changed from the low speed mode to the high speed mode.

Accordingly, when the image forming operation is performed in the color mode, by changing the speed mode without stopping the second photoconductor motor M2 and the drive motor DM, the phase adjustment of the gears 23*y*, 23*c*, 23*m* and 23*bk* needs to be done. To avoid the above-described necessity, the image forming apparatus 1 of the present invention has the structure as described below.

The image forming apparatus 1 of FIG. 5 includes a copy mode selection of the color mode and the black-and-white mode, and a speed selection of the high speed mode and the low speed mode. These modes can be flexibly combined to make four selective modes; a full speed color mode, a full speed black-and-white mode, a low speed color mode, and a low speed black-and-white mode. The full speed color mode may be selected for performing a copy job in the color mode by rotating the photoconductors 2*y*, 2*c*, 2*m* and 2*bk* and the intermediate transfer member 3 at the first surface linear velocity. The full speed black-and-white mode may be selected for performing a copy job in the black-and-white mode by rotating the photoconductor 2*bk* and the intermediate transfer member 3 at the first surface linear velocity. The low speed color mode may be selected for performing a copy job in the color mode by rotating the photoconductors 2*y*, 2*c*, 2*m* and 2*bk* and the intermediate transfer member 3 at the second surface linear velocity. The low speed black-and-white mode may be selected for performing a copy job in the black-and-white mode by rotating the photoconductor 2*bk* and the intermediate transfer member 3 at the second surface linear velocity.

As previously described, the mode may be changed without stopping the second photoconductor motor M2 and the drive motor DM. When the changed mode is the full speed color mode or the low speed color mode, the control unit may be configured to control the change of the rotation number-of at least one motor of the first and second photoconductor motors M1 and M2 to obtain the predetermined phases of the gears 23*y*, 23*c*, 23*m* and 23*bk* before starting the image forming operation in the changed mode.

With the above-described structure, the full-color image produced at the last stage of the image forming operation may be prevented from the color shift even when the mode is changed from the black-and-white mode to the color mode.

Figure 22:
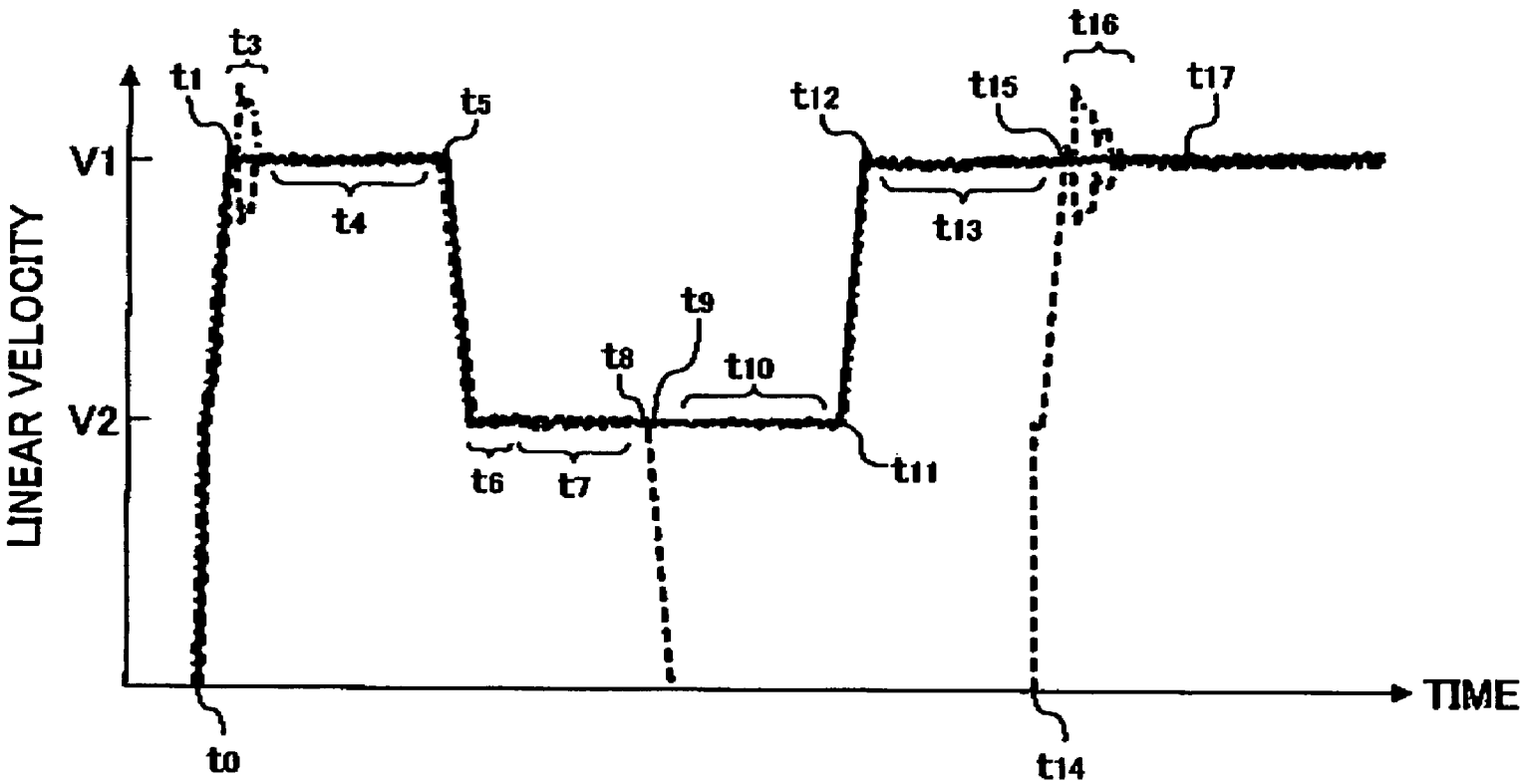
FIG. 22 is a graph of surface linear velocities of the photoconductor motors and the drive motors when they are switched between a color mode and a black-and-white mode.

Referring to FIG. 22, an example of an operation of the structure of FIG. 21 is described. The vertical axis shows the surface linear velocities of the photoconductors 2*y*, 2*c*, 2*m* and 2*bk* and the intermediate transfer member 3, and the horizontal axis shows the time. The solid line represents the surface linear velocity of the intermediate transfer member 3*m*, and the dashed line represents the surface linear velocity of the photoconductor 2*y*, 2*c* and 2*m*, and the short and long dashed line represents the surface linear velocity of the photoconductor 2*bk*. The first surface linear velocity V1, which is a basic surface linear velocity of the photoconductors 2*y*, 2*c*, 2*m* and 2*bk* and the intermediate transfer member 3, is 155 mm/sec, and the second surface linear velocity V2 is 77.5 mm/sec, which is half of the first surface linear velocity V1.

At t0 of FIG. 22, the first and second photoconductor motors M1 and M2 and the drive motor DM are started. At t1, the first and second photoconductor motors M1 and M2 and the drive motor DM complete the starting operation. In a period of the starting operation, the intermediate transfer member 3 and the photoconductors 2*y*, 2*c*, 2*m* and 2*bk* increase their speeds at the substantially the same surface linear velocity. The time required for the starting operation is approximately 1000 msec.

During a period of t3, which is a time after the starting operation of the photoconductor motors M1 and M2 and the drive motor DM are completed, the phase adjusting operations of the gears 23*y*, 23*c*, 23*m* and 23*bk* are performed, which is same as shown in FIGS. 16, 18 to 20. During a period of t4, the image forming operation is performed in the full speed color mode, which is a combination of the high speed mode and the color mode.

At t5, the numbers of rotations of the first and second photoconductor motors M1 and M2 and the drive motor DM are decreased so that the surface linear velocities of the photoconductors 2*y*, 2*c* and 2*m* and the intermediate transfer member 3 the second surface linear velocity V2. In a period of t6, the phase adjusting operations of the gears 23*y*, 23*c*, 23*m* and 23*bk* are performed. In the example shown in FIG. 22, the gears 23*y*, 23*c*, 23 *m* and 23*bk* are in the predetermined phases even when the speeds of the photoconductor motors M1 and M2 and the drive motor DM are decreased. Since no gears are out of phase, a phase adjusting operation is not performed to control the actual speeds of the photoconductor motors M1 and M2 and the drive motor DM.

In a period of t7, the image forming operation is performed in the low speed color mode, which is a combination of the low speed mode and the color mode. At t8, as shown in FIG. 6, the intermediate transfer member 3 is detached from the photoconductors 2*y*, 2*c*, 2*m* and 2*bk*. At t9, the surface linear velocities of the photoconductors 2*y*, 2*c* and 2*m* are decreased, the first photoconductor motor M1 is stopped, and then the rotations of the photoconductors 2*y*, 2*c* and 2*m* are stopped.

Subsequently, in a period of t10, the image forming operation is performed in the low speed black-and-white mode, which is a combination of the low speed mode and the black-and-white mode. During the period of t10, the phase adjusting operation of the gears 2*y*, 2*c* and 2*m* are not performed before this image forming operation.

Next, at t11, the surface linear velocities of the photoconductor 2*bk* and the intermediate transfer member 3 are started to increase. At t12, the surface linear velocities of the photoconductor 2*bk* and the intermediate transfer member 3 are returned to the first surface linear velocity V1. At this moment, the phase adjusting operation of the photoconductor 2*bk* and the intermediate transfer member 3 is not performed. Subsequently, in a period of t13, the image forming operation is performed in the full speed black-and-white mode, which is a combination of the high speed and the black-and-white mode.

At t14, the first photoconductor motor M1 starts the rotation, and at tl5, the starting operation of the photoconductor motor M1 completes. The starting operation at t5 also takes approximately 1000 msec. Subsequently, in a period of t16, the phase adjusting operation of the gears 23*y*, 23*c*, 23 *m* and 23*bk* is performed. At t17, the intermediate transfer member 3 contacts the photoconductors 2*y*, 2*c* and 2*m*. After the intermediate transfer member 3 and the photoconductors 2*y*, 2*c* and 2*m* are held in contact with each other at t17, the image forming operation is performed in the full speed color mode, which is a combination of the high speed mode and the color mode.

The intermediate transfer member 3 may contact with the photoconductors 2*y*, 2*c* and 2*m* while the phase adjusting operation is performed. With the structure, however, a great impact is given onto the surfaces of the gears 23*y*, 23*c*, 23*m* and 23*bk* to promote the wearing. Accordingly, as shown in FIG. 22, it is preferable to contact the intermediate transfer member 3 with the photoconductors 2*y*, 2*c* and 2*m* after the phase adjusting operation is performed.

The above-described structure may be applied to the image forming apparatus 1 with the direct transfer method as shown in FIG. 7. That is, this structure is provided with a function that the mode can be changed without stopping the second photoconductor motor M2 and the drive motor DM, and another function that surface linear velocities of the photoconductors 2*y*, 2*c*, 2*m* and 2*bk* and the recording medium bearing member 103 can be switched. Also, this structure includes a full speed color mode, a full speed black-and-white mode, a low speed color mode, and a low speed black-and-white mode. The full speed color mode may be selected for performing a copy job in the color mode by rotating the photoconductors 2*y*, 2*c*, 2*m* and 2*bk* and the recording medium bearing member 103 at the first surface linear velocity. The full speed black-and-white mode may be selected for performing a copy job in the black-and-white mode by rotating the photoconductor 2*bk* and the recording medium bearing member 103 at the first surface linear velocity. The low speed color mode may be selected for performing a copy job in the color mode by rotating the photoconductors 2*y*, 2*c*, 2*m* and 2*bk* and the recording medium bearing member 103 at the second surface linear velocity. The low speed black-and-white mode may be selected for performing a copy job in the black-and-white mode by rotating the photoconductor 2*bk* and the recording medium bearing member 103 at the second surface linear velocity. When the changed mode is the full speed color mode or the low speed color mode, the control unit may be configured to control the change of the rotation number of at least one motor of the first and second photoconductor motors M1 and M2 to obtain the predetermined phases of the gears 23*y*, 23*c*, 23*m* and 23*bk* before starting the image forming operation in the changed mode.

Figure 23:
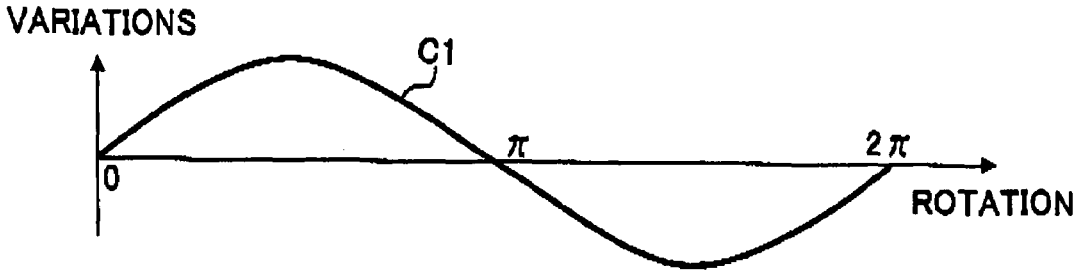
FIG. 23 is a graph showing a curve of a deflection of a pitch circle of a black-and-white gear in a radius direction thereof.
Figure 24:
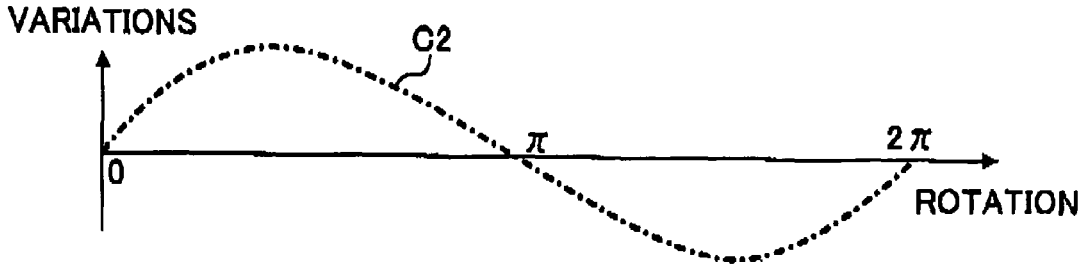
FIG. 24 is a graph showing a curve of a deflection of a pitch circle of a color gear in a radius direction thereof.

Referring to FIGS. 23 and 24, deflections of pitch circles of the gears 23*bk* and 23*m* of FIG. 8 in the radius direction thereof are described. A curve C1 shown in FIG. 23 and a curve C2 shown in FIG. 24 represent the above-described deflections observed when the gears 23*bk* and 23*m*, respectively, are rotated by one cycle. Since the rotations of a single gear cannot be measured, the deflection is substituted for the volume of rotations of the single gear. When pitch radiuses of the gears 23*bk* and 23*m* at their maximum values (+) are engaged with the output gears 26 and 25, respectively, angular velocities of the gears 23*bk* and 23*m* are at their minimum. When pitch radiuses of the gears 23*bk* and 23*m* at their minimum values (−) are engaged with the output gear 26 and the intermediate gear 24, respectively, angular velocities of the gears 23*bk* and 23*m* are at their maximum.

Figure 25:
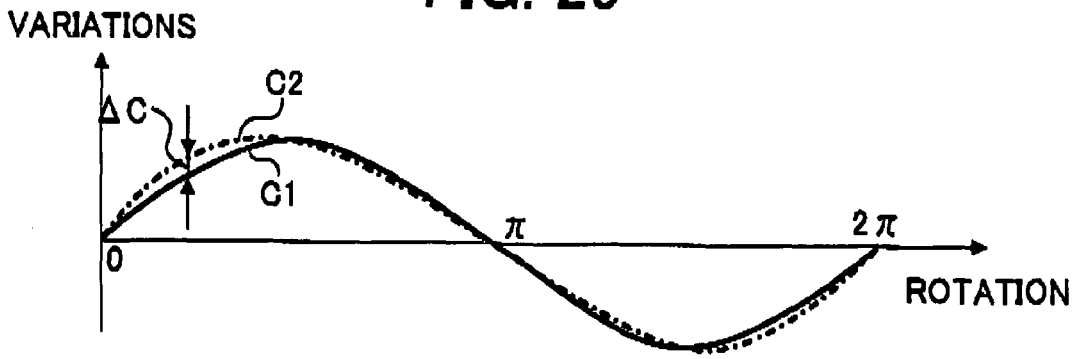
FIG. 25 is a graph showing a difference between the curves of the deflections of the pitch circles of the black-and-white gear and the color gear shown in FIGS. 24 and 25.

Here, the curve C1 of FIG. 23 and the curve C2 of FIG. 24 are approximated to each other. When the phases of the gears 23*y* and 23*bk* are correctly adjusted as described above, a difference AC between the curves C1 and C2 becomes minimal, as shown in FIG. 25. Therefore, when the phase adjusting operation is performed as described above, an occurrence of the color shift may effectively be restrained.

Figure 26:
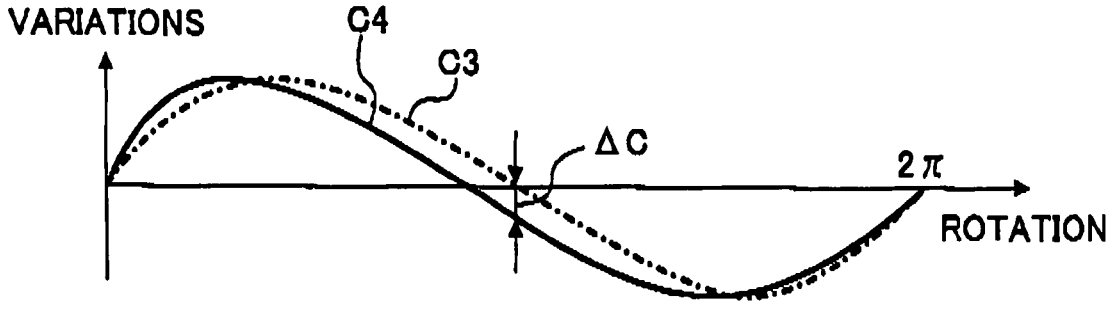
FIG. 26 is a graph showing another difference between the curves of the deflections of the pitch circles of the black-and-white gear and the color gear.

In fact, the curves representing the deflections of the pitch circles of the gears 23*bk* and 23*m* rarely approximate to each other as shown in FIGS. 23 and 24. In most cases, as shown in FIG. 26, curves C3 and C4 representing deflection of the pitch circle of the gears 23*bk* and 23*m* may have a large difference therebetween. In such cases, when the phase adjusting operation is performed, the difference ΔC between the curves C3 and C4 becomes large as shown in FIG. 26.

Figure 27:
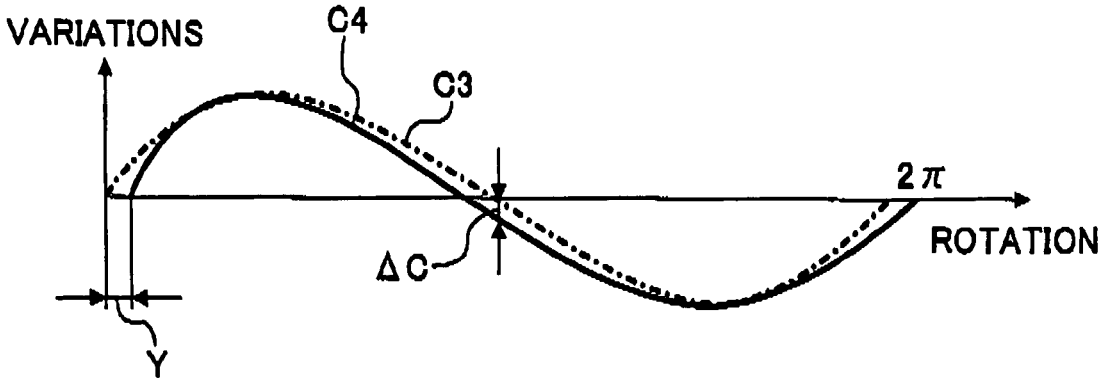
FIG. 27 is a graph showing a curve of a deflection when one of the curve of the deflections shown in FIG. 26 is shifted.

In such cases, when the phase of the curve C4 is shifted by an amount of a color shift angle Y as shown in FIG. 27, the difference ΔC between the curves C3 and C4 becomes small. That is, the gears 23*y*, 23*c*, 23 *m* and 23*bk* are preferably measured before assembling them to the image forming apparatus 1. By doing so, the color shift angle Y of the phase having a smallest difference C may be previously measured, a corrective value according to the optical color shift angle Y, and the phase adjusting operation may be performed as described above. After the phase adjusting operation, the control unit is configured to control the rotation number of at least one of the first and second photoconductor motors M1 and M2 according to a value obtained by adding the above-described predetermined corrected value to a time difference between a time in which the first sensor 34*m* detects the first position (the feeler Fm) and a time in which the second sensor 34*bk* detects the second position (the feeler Fbk). By doing so, the color shift produced on a final color image may be further reduced, and thereby the image quality of the final color image may be increased.

More specifically, the image forming operation may be controlled as shown in Table 5 described below instead of Table 3 which is previously described.

TABLE 5

| Angular Difference | Fluctuation in Rotations of Photoconductor |
|---|---|
| Equal to or more than ±90 degrees to equal to or less than 180 degrees | 16% |
| Equal to or more than 45 degrees to less than 90 degrees | 10% |
| Equal to or more than 22.5 degrees to less than 45 degrees | 5% |
| Equal to or more than 0 degree to equal to or less than 22.5 degree | 0 |

Figure 28:
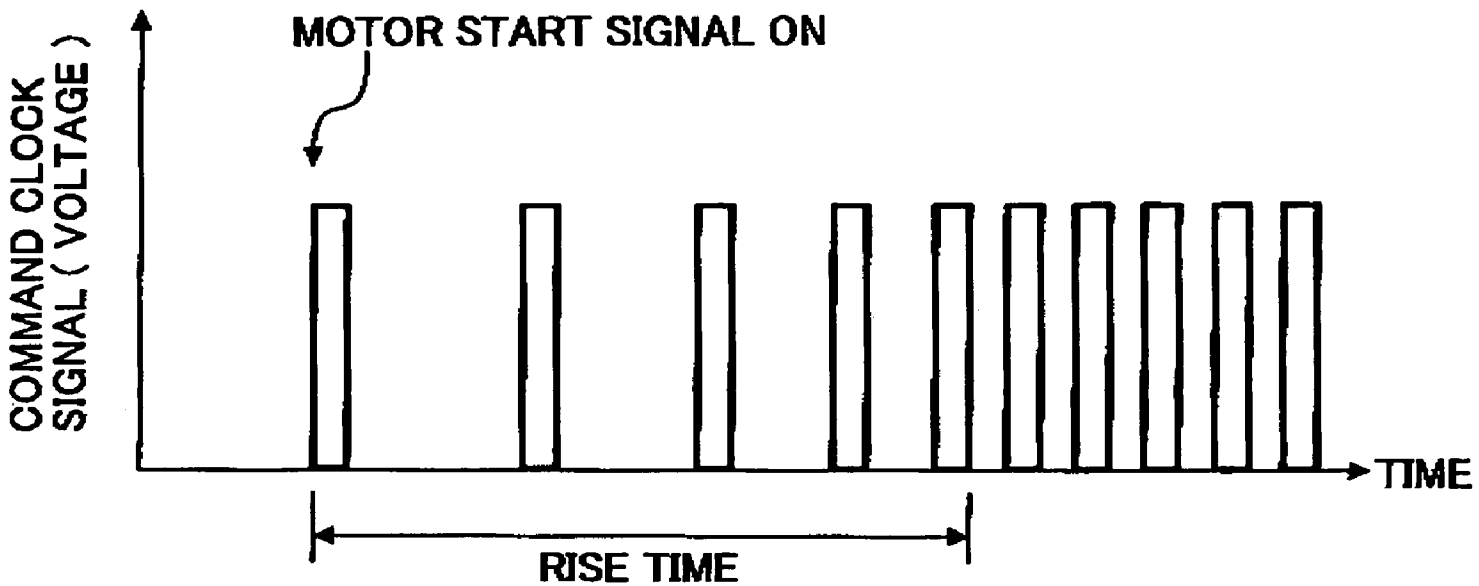
FIG. 28 is a graph showing a command clock signal at a start of a DC brushless motor used in the image forming apparatus of FIG. 5.

Referring to FIG. 28, the command clock signal produced when the photoconductor motors M1 and M2 and the drive motor DM are started is described.

Figure 29:
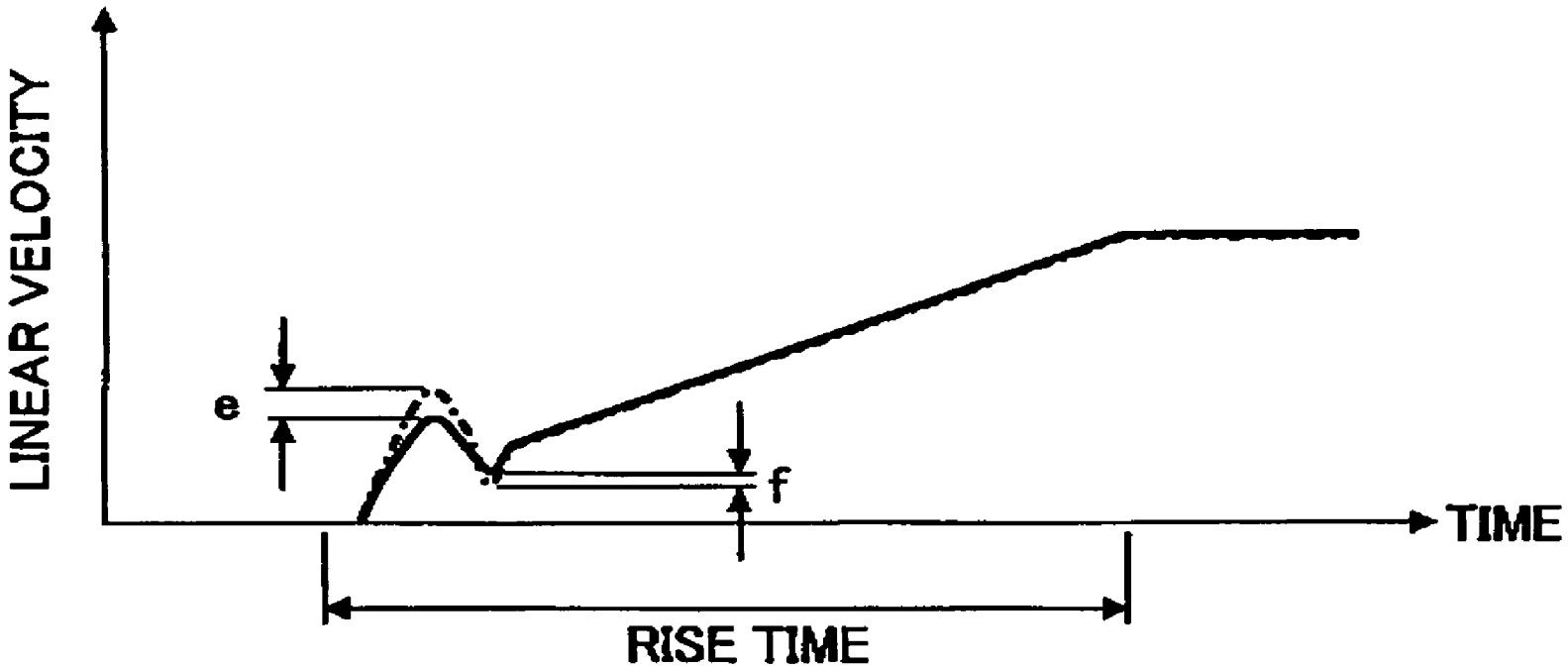
FIG. 29 is a graph showing surface linear velocities of the photoconductor and the drive motor during the rise time period.

As previously described, the photoconductor motors M1 and M2 and the drive motor DM may include the DC brushless motor. In this case, when the photoconductor motors M1 and M2 and the drive motor DM are started, the command clock signal having the number of clocks gradually increasing as shown in FIG. 28 is input to the photoconductor motors M1 and M2 and the drive motor DM. After the command clock signal is input to each motor, the surface linear velocities of the photoconductor and the intermediate transfer member 3 or those of the photoconductor and the recording medium bearing member 103 may be controlled as indicated by a solid line and a short and long dashed line shown in FIG. 29. Further, an amount of difference between an overshoot volume represented by a reference character e and an undershoot volume represented by a reference character f may be reduced.

Figure 30:
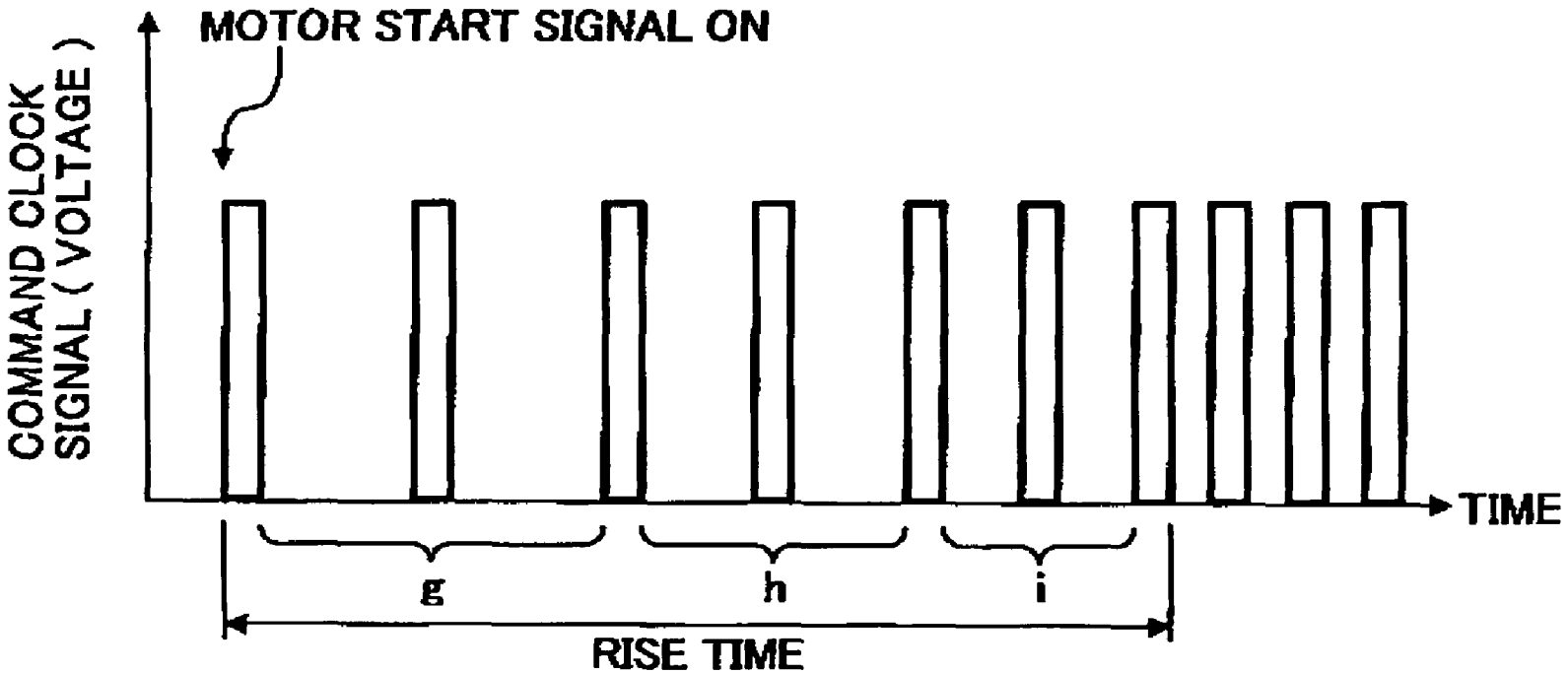
FIG. 30 is a graph showing another command clock signal input to the DC brushless motor during the rise time period.

Referring to FIG. 30, an example of the command clock signal produced when the photoconductor motors M1 and M2 and the drive motor DM area started is described.

When the photoconductor motors M1 and M2 and the drive motor DM including the DC brushless motor are started, the command clock signal having the number of clocks gradually increasing as indicated by reference characters g, h and i as shown in FIG. 30 is input to the photoconductor motors M1 and M2 and the drive motor DM. By doing so, similar to the case shown in FIG. 29, after the command clock signal is input to each motor, the surface linear velocities of the photoconductor and the intermediate transfer member 3 or those of the photoconductor and the recording medium bearing member 103 may be controlled to avoid a great difference.

Figure 31:
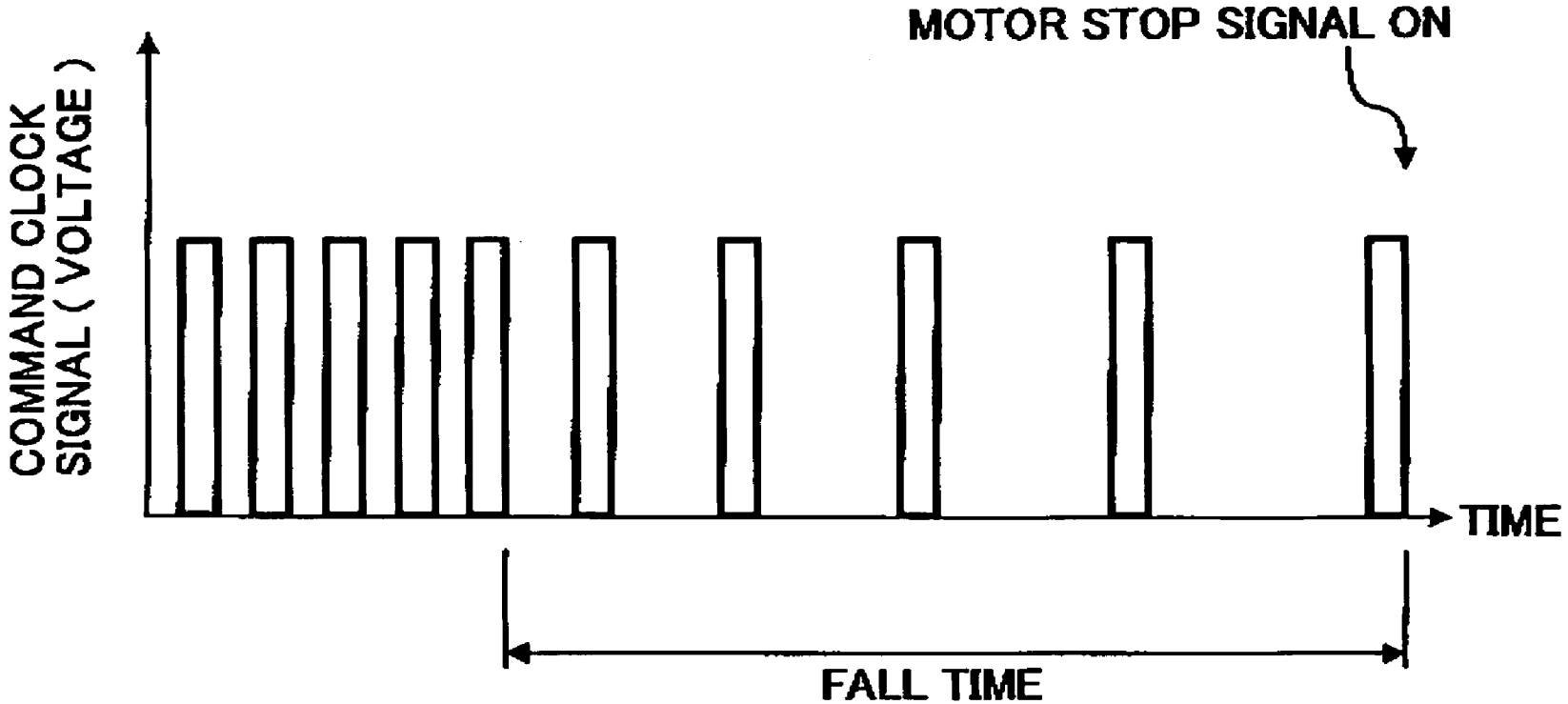
FIG. 31 is a graph showing another command clock signal input to the DC brushless motor during the fall time period.
Figure 32:
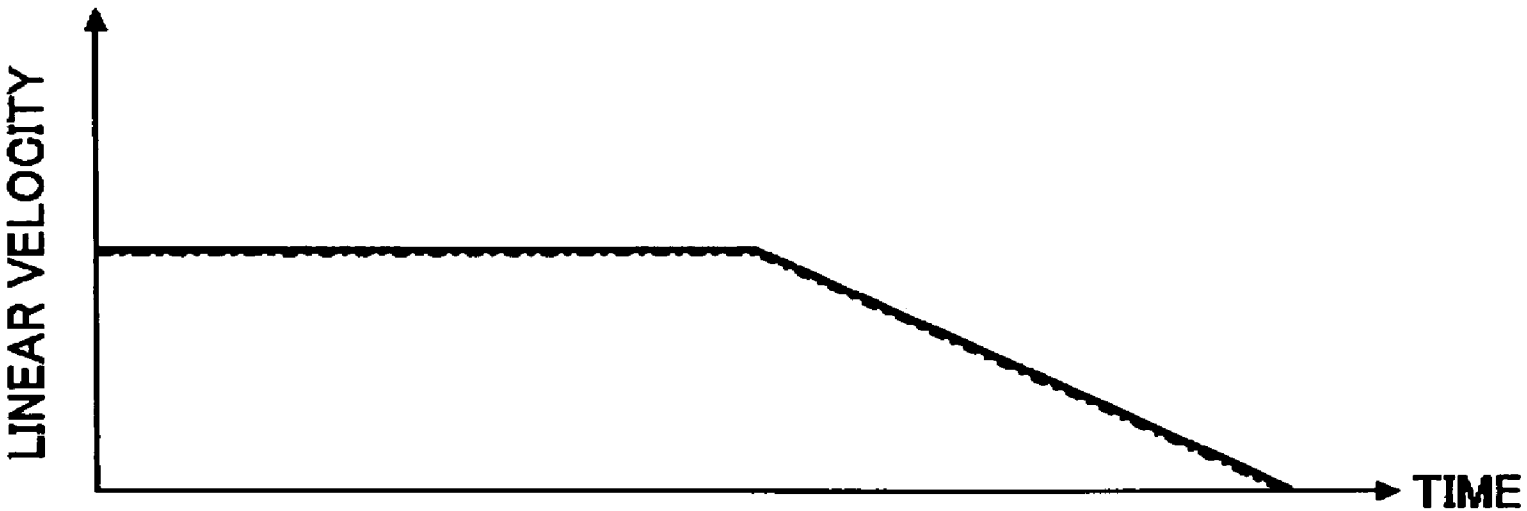
FIG. 32 is a graph showing surface linear velocities of the photoconductor motor and the drive motor during the fall time period.

Referring to FIG. 31, an example of the command clock signal produced when the photoconductor motors M1 and M2 and the drive motor DM including the DC brushless motor are stopped. When the photoconductor motors M1 and M2 and the drive motor DM are stopped, the command clock signal having the number of clocks gradually decreasing is input. After the command clock signal is input to each motor, the surface linear velocities of the photoconductor and the intermediate transfer member 3 (or those of the photoconductor and the recording medium bearing member 103) may be controlled as indicated by a solid line and a short and long dashed line shown in FIG. 32. Further, an amount of speed difference between them may be reduced or be eliminated.

Figure 33:
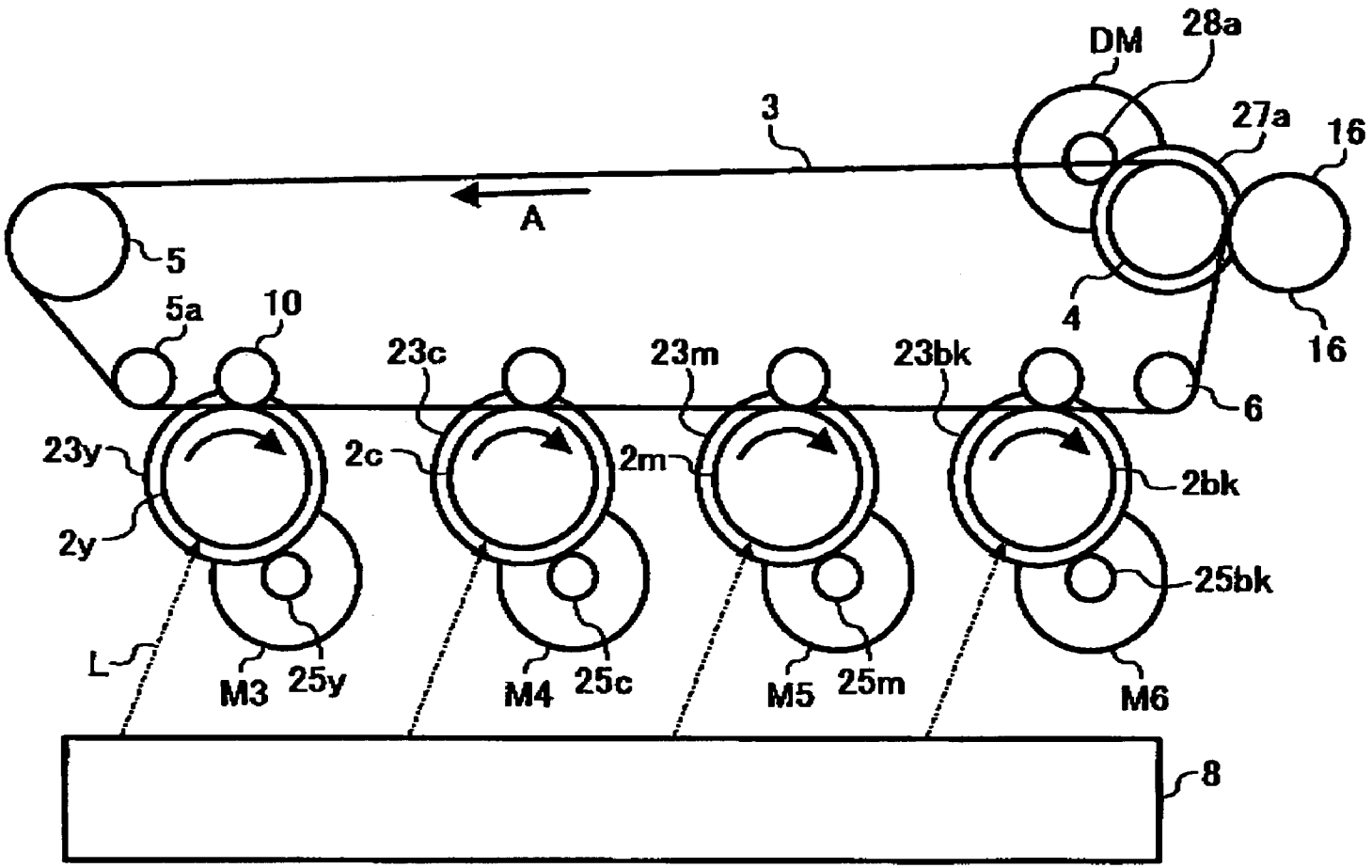
FIG. 33 is a schematic structure of an image forming portion of a tandem image forming apparatus.

In the above-described examples, the first photoconductor motor M1 controls the rotations of the photoconductors 2*y*, 2*c* and 2*m*, the second photoconductor motor M2 controls the rotation of the photoconductor 2*bk*. As an alternative, a drive method of each photoconductor may have another drive method. For example, as shown in FIG. 33, that the gears 23*y*, 23*c*, 23*m* and 23*bk* concentrically coupled with the photoconductors 2*y*, 2*c*, 2*m* and 2*bk*, respectively, may be engaged with the output gears 25*y*, 25*c*, 25*m* and 25*bk* of the photoconductor motors M3, M4, M5 and M6, respectively. The gears 23*y*, 23*c*, 23*m* and 23*bk* and the photoconductors 2*y*, 2*c*, 2*m* and 2*bk* are rotated, different color toner images formed on the photoconductors 2*y*, 2*c*, 2*m* and 2*bk* are transferred onto the intermediate transfer member 3 which moves in a direction A. The image forming apparatus 1 having the above-described structure may also be applied.

In the image forming apparatus 1 as shown in FIG. 33, the intermediate transfer member 3 is supported by supporting rollers 4, 5, 5*a* and 6. An output gear 28*a* of the drive motor DM is engaged with a gear 27*a* which is concentrically fixed to the supporting roller 4. The rotation of the drive motor DM is transmitted to the supporting roller 4 via the output gear 28*a* and the gear 27*a*. Then, the intermediate transfer member 3 is rotated in the direction A.

At least one motor of the above-described photoconductor motors M3, M4, M5 and M6 and the drive motor DM includes the clock control motor including the DC brushless motor, and the DC brushless motor is controlled as described above. With this structure, when the photoconductor motors M3, M4, M5 and M6 and the drive motor DM are started and stopped, a significantly different value between the surface linear velocities of the photoconductors 2*y*, 2*c*, 2*m* and 2*bk* and that of the intermediate transfer member 3 are prevented. Other basic structures are the same as the structures of the image forming apparatus as shown in FIGS. 5 to 9. In FIG. 33, the same reference numerals are applied to elements corresponding to the respective element as shown in FIG. 8.

In addition, the present invention may be applied to the image forming apparatus 1 which forms a single toner image on one photoconductor, transfers the single toner image onto a recording medium carried by the recording medium bearing member, and repeats the same image forming operations for four times to complete one full-color toner image.

Figure 34:
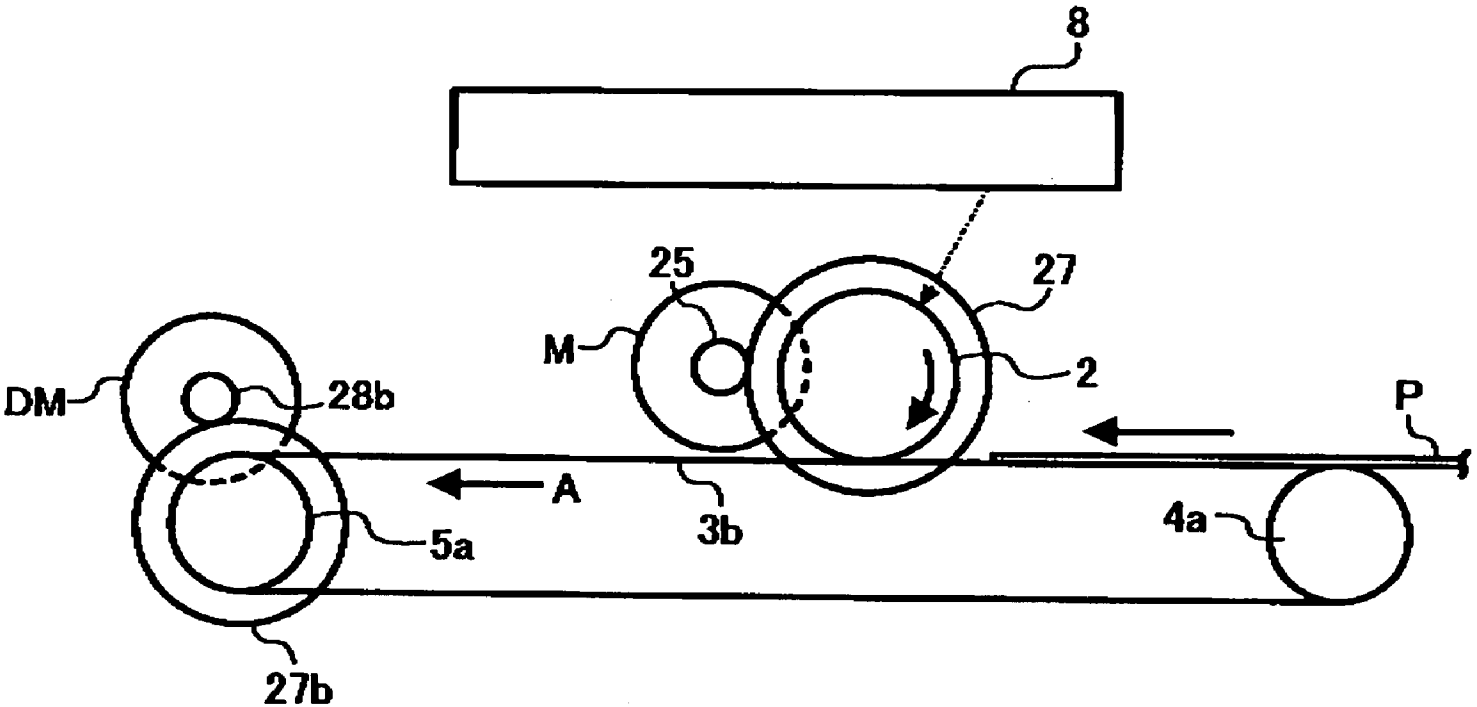
FIG. 34 is a schematic structure of an image forming portion of an image forming apparatus provided with one photoconductor.

Referring to FIG. 34, an exemplary structure of an image forming portion of the above-described image forming apparatus with one photoconductor is described.

The image forming apparatus described here, which includes a gear 27 concentrically fixed to the photoconductor 2, is engaged with an output gear 25 of the photoconductor motor M. The photoconductor motor M drives the photoconductor 2 clockwise in FIG. 34, so that a single color toner image is formed on a surface of the photoconductor 2.

A recording medium bearing member 3*b* which is an endless belt extended by supporting rollers 4*a* and 5*a*. The supporting roller 5*a* includes a gear 27*b* which is concentrically coupled threrewith. The gear 27*b* is engaged with an output gear 28*b* of the drive motor DM. The drive motor DM drives the recording medium bearing member 3*b* in a direction A as shown in FIG. 34.

A recording medium P which is fed from a sheet feeding unit (not shown) is carried by the recording medium bearing member 3*b* and is conveyed to a transferring unit (not shown). The transferring unit transfers the single color toner image formed on the surface of the photoconductor 2 onto the recording medium P. After the image forming operations for transferring the different single color toner images onto the recording medium P are performed for four times and the full-color toner image is formed on the recording medium P, the recording medium P is separated from the recording medium bearing member 3*b* and passes through a fixing unit, where the full-color toner image is fixed onto the recording medium P.

At least one motor of the photoconductor motor M and the drive motor DM includes a clock control motor including a DC brushless motor, and the DC brushless motor is controlled the same way as previously described. With this structure, when the photoconductor motor M and the drive motor DM are started, stopped, and stably rotated, a significantly different value between the surface linear velocities of the photoconductor 2 and that of the recording medium bearing member 3*b* is prevented.

In the image forming apparatus as described above, the number of rotations of the DC brushless motor is controlled according to a predetermined velocity curve. The predetermined velocity curve is recorded in the memory 33, for example, a nonvolatile memory, as shown in FIG. 8. At this time, when the properties of the elements of the image forming apparatus may be changed with age, the surface linear velocities of the photoconductor and the intermediate transfer member or the recording medium bearing member may be significantly different, Therefore, it is preferable to have a structure such that the velocity curve can be changed by controlling an operation panel (not shown) of the image forming apparatus or a connecting terminal, such as a personal computer, of the image forming apparatus. By doing so, a large difference between the surface linear velocities of the photoconductor and the intermediate transfer member or the recording medium bearing member, the velocity curve may be changed to a smaller value for making the difference smaller.

The present invention may be widely used for an image forming apparatus other than a printer, that is, a copying machine, a facsimile machine, and a multifunction machine.

Numerous additional modifications and variations are possible in light of the above teachings. It is therefore to be understood that within the scope of the appended claims, the disclosure of this patent specification may be practiced otherwise than as specifically described herein.

What is claimed as new and desired to be secured by Letters Patent of the United States is:

1. An image forming apparatus, comprising:

at least one image bearing member configured to bear a toner image on a surface thereof;

a transferring member arranged close to or in contact with the at least one image bearing member and configured to rotate in substantially synchronism with the at least one image bearing member to transfer the toner image born on the at least one image bearing member onto a recording medium;

at least one first motor rotating the at least one image bearing member;

a second motor rotating the transferring member;

a control mechanism configured to control a rotation number of at least one of the at least one first motor and the second motor during at least one of rise and fall time periods with a command clock signal and a feedback signal in accordance with a predetermined velocity curve; and at least one sensor configured to start sensing when a rotation speed of the at least one first motor falls below a predetermined speed.

2. An image forming apparatus, comprising:

at least one image bearing member configured to bear a toner image on a surface thereof;

an intermediate transfer member configured to receive the toner image from the at least one image bearing member;

a first motor rotating the at least one image bearing member;

a second motor rotating the intermediate transfer member;

a transfer mechanism configured to transfer the toner image from the intermediate transfer member to a recording medium;

a control mechanism configured to control rotations of the first and second motors; and at least one sensor configured to start sensing when a rotation speed of the first motor falls below a predetermined speed, wherein at least one of the first and second motors includes a clock control motor controlled by a command clock signal and a feedback signal, and wherein the control mechanism controls a rotation number of the clock control motor in accordance with a predetermined velocity curve during at least one of rise and fall time periods of the clock control motor.

3. The image forming apparatus according to claim 2, wherein the first motor includes the clock control motor, and the second motor includes a stepping motor.

4. The image forming apparatus according to claim 2, wherein each of the first and second motors includes the clock control motor.

5. The image forming apparatus according to claim 2, wherein the clock control motor is controlled to be rotated by the command clock signal having the clock number in accordance with the predetermined velocity curve during the at least one of rise and fall time periods of the clock control motor.

6. The image forming apparatus according to claim 2, wherein the clock control motor is controlled to be rotated by the command clock signal having a gradually increasing pulse number during the rise time period, having a substantially constant pulse number during a steady rotation time period, and having a gradually decreasing pulse number during the fall time period.

7. The image forming apparatus according to claim 2, further comprising:

a braking mechanism configured to forcedly reduce a rotation number of the clock control motor during the fall time period of the clock control motor.

8. The image forming apparatus according to claim 2, wherein the rotation number of the clock control motor is controlled by changing a pulse number of the command clock signal in steps during the at least one of rise and fall time periods of the clock control motor.

9. The image forming apparatus according to claim 2, wherein the clock control motor includes a direct current brushless motor.

10. An image forming apparatus comprising:

at least one image bearing member configured to bear a toner image on a surface thereof;

an intermediate transfer member configured to receive the toner image from the at least one image bearing member;

a first motor rotating the at least one image bearing member;

a second motor rotating the intermediate transfer member;

a transfer mechanism configured to transfer the toner image from the intermediate transfer member to a recording medium; and a control mechanism configured to control rotations of the first and second motors, wherein at least one of the first and second motors includes a clock control motor controlled by a command clock signal and a feedback signal, the control mechanism controls a rotation number of the clock control motor in accordance with a predetermined velocity curve during at least one of rise and fall time periods of the clock control motor, and the predetermined velocity curve is stored in a memory and can be changed by controlling an operation panel of the image forming apparatus or a connecting terminal of the image forming apparatus.

11. An image forming apparatus, comprising:

image bearing means for bearing a toner image and moving the toner image to a primary transfer position;

image overlaying means for receiving at least one toner image from the image bearing means into a single overlaid toner image at the primary transfer position, moving the single overlaid toner image to a secondary transfer position, and transferring the single overlaid toner image onto a receiving medium;

primary driving means for driving the image bearing means;

secondary driving means for driving the image overlaying means;

controlling means for controlling a rotation number of at least one of the primary and secondary driving means with a command clock signal and a feedback signal in accordance with a predetermined velocity curve; and sensing means for sensing when a rotation speed of the primary driving means falls below a predetermined speed.

12. The image forming apparatus according to claim 11, wherein the controlling means controls the rotation number of the at least one of the primary and the secondary driving means during at least one of rise and fall time periods with the command clock signal and the feedback signal in accordance with the predetermined velocity curve.

13. An image forming method, comprising the steps of:

driving an image bearing member with a primary driving member;

driving an overlaying member with a secondary driving member;

forming a toner image on the image bearing member;

moving the toner image with the image bearing member to a primary transfer position;

overlaying at least one toner image formed on the bearing member into a single toner image at the primary transfer position;

transporting the single toner image to a secondary transfer position;

transferring the single toner image transported to the secondary transfer position by the transporting step onto a recording medium;

controlling a rotation number of at least one of the primary and secondary driving members with a command clock signal and a feedback signal in accordance with a predetermined velocity curve; and sensing when a rotation speed of the primary driving member falls below a predetermined speed.

14. The image forming method according to claim 13, wherein the controlling step controls the rotation number of the at least one of the primary and secondary driving members during at least one of rise and fall time periods with the command clock signal and the feedback signal in accordance with the predetermined velocity curve.

15. An image forming apparatus, comprising:

at least one image bearing member configured to bear a toner image on a surface thereof;

a recording medium bearing member configured to carry a recording medium to receive the toner image from the at least one image bearing member;

a first motor rotating the at least one image bearing member;

a second motor rotating the recording medium bearing member;

a transfer mechanism configured to transfer the toner image from the image bearing member to a recording medium;

a control mechanism configured to control rotations of the first and second motors; and at least one sensor configured to start sensing when a rotation speed of the first motor falls below a predetermined speed, wherein at least one of the first and second motors includes a clock control motor controlled by a command clock signal and a feedback signal, and wherein the control mechanism controls a rotation number of the clock control motor in accordance with a predetermined velocity curve during at least one of rise and fall time periods of the clock control motor.

16. The image forming apparatus according to claim 15, wherein the first motor includes the clock control motor, and the second motor includes a stepping motor.

17. The image forming apparatus according to claim 15, wherein each of the first and second motors includes the clock control motor.

18. The image forming apparatus according to claim 15, wherein the clock control motor is controlled to be rotated by the command clock signal having the clock number in accordance with the predetermined velocity curve during the at least one of the rise and fall time periods of the clock control motor.

19. The image forming apparatus according to claim 15, wherein the clock control motor is controlled to be rotated by the command clock signal having a gradually increasing pulse number during the rise time period, having a substantially constant pulse number during a steady rotation time period, and having a gradually decreasing pulse number during the fall time period.

20. The image forming apparatus according to claim 15, further comprising:

a braking mechanism configured to forcedly reduce a rotation number of the clock control motor during the fall time period of the clock control motor.

21. The image forming apparatus according to claim 15, wherein the rotation number of the clock control motor is controlled by changing a pulse number of the command clock signal in steps during the at least one of the rise and fall time periods of the clock control motor.

22. The image forming apparatus according to claim 15, wherein the clock control motor includes a direct current brushless motor.

23. An image forming apparatus according, comprising:

at least one image bearing member configured to bear a toner image on a surface thereof;

a recording medium bearing member configured to carry a recording medium to receive the toner image from the at least one image bearing member;

a first motor rotating the at least one image bearing member;

a second motor rotating the recording medium bearing member;

a transfer mechanism configured to transfer the toner image from the image bearing member to a recording medium; and a control mechanism configured to control rotations of the first and second motors, wherein at least one of the first and second motors includes a clock control motor controlled by a command clock signal and a feedback signal, the control mechanism controls a rotation number of the clock control motor in accordance with a predetermined velocity curve during at least one of rise and fall time periods of the clock control motor, and the predetermined velocity curve is stored in a memory and can be changed by controlling an operation panel of the image forming apparatus or a connecting terminal of the image forming apparatus.

24. An image forming apparatus, comprising:

image bearing means for bearing a toner image and moving the toner image to a transfer position;

image transferring means for moving a recording sheet and transferring at least one toner image from the image bearing means onto the recording sheet in a single overlaid toner image at the transfer position;

primary driving means for driving the image bearing means;

secondary driving means for driving the image transferring means;

controlling means for controlling a rotation number of at least one of the primary and the secondary driving means with a command clock signal and a feedback signal in accordance with a predetermined velocity curve; and sensing means for sensing when a rotation speed of the primary driving means falls below a predetermined speed.

25. The image forming apparatus according to claim 24, wherein the controlling means controls the rotation number of the at least one of the primary and the secondary driving means during at least one of rise and fall time periods with the command clock signal and the feedback signal in accordance with the predetermined velocity curve.

26. An image forming method, comprising the steps of:

energizing an image bearing member with a primary driving member;

driving an overlaying member with a secondary driving member;

forming a toner image on the image bearing member;

moving the toner image with the image bearing member to a transfer position;

transferring at least one toner image formed on the bearing member onto the recording sheet driven by the driving step in a single overlaid toner image at the transfer position;

controlling a rotation number of at least one of the primary and secondary driving members with a command clock signal and a feedback signal in accordance with a predetermined velocity curve; and sensing when a rotation speed of the primary driving member falls below a predetermined speed.

27. The image forming method according to claim 26, wherein the controlling step controls the rotation number of the at least one of the primary and secondary driving members during at least one of rise and fall time periods with the command clock signal and the feedback signal in accordance with the predetermined velocity curve.

28. An image forming apparatus, comprising:

a plurality of color image bearing members having surfaces to bear a plurality of color toner images;

a monochrome image bearing member having a surface to bear a monochrome toner image;

an intermediate transfer member configured to receive the plurality of color toner images from the plurality of color image bearing members and the monochrome toner image from the monochrome image bearing member;

a first gear coupled with at least one of the plurality of color image bearing members;

a second gear coupled with the monochrome image bearing member;

a first motor including a clock control motor rotating the at least one of the plurality of color image bearing members via the first gear;

a second motor including the clock control motor rotating the monochrome image bearing member via the second gear;

a third motor rotating the intermediate transfer member;

a transfer mechanism configured to transfer the toner image from the intermediate transfer member to a recording medium;

a control mechanism configured to control rotations of the first, second and third motors; and at least one sensor configured to start sensing when a rotation speed of at least one of the first motor and the second motor falls below a predetermined speed, wherein the control mechanism controls rotation numbers of the clock control motors during at least one of rise and fall time periods in accordance with a predetermined velocity curve.

29. The image forming apparatus according to claim 28, wherein a rotation number of at least one of the clock control motors of the first and second motors is controlled to be changed to set positions of the first and second gears to have a predetermined phase relationship therebetween, after completion of the rise time periods of the first and second motors and before start of a subsequent image forming operation.

30. An image forming apparatus, comprising:

a plurality of color image bearing members having surfaces to bear a plurality of color toner images;

a monochrome image bearing member having a surface to bear a monochrome toner image;

an intermediate transfer member configured to receive the plurality of color toner images from the plurality of color image bearing members and the monochrome toner image from the monochrome image bearing member;

a first gear coupled with at least one of the plurality of color image bearing members;

a second gear coupled with the monochrome image bearing member;

a first motor including a clock control motor rotating the at least one of the plurality of color image bearing members via the first gear;

a second motor including the clock control motor rotating the monochrome image bearing member via the second gear;

a third motor rotating the intermediate transfer member;

a transfer mechanism configured to transfer the toner image from the intermediate transfer member to a recording medium; and a control mechanism configured to control rotations of the first, second and third motors, wherein the control mechanism controls rotation numbers of the clock control motors during at least one of rise and fall time periods in accordance with a predetermined velocity curve, the control mechanism has a plurality of operation modes which are selectable and bi-directionally switchable without stopping the second and third motors, and the plurality of operation modes include a color mode having a function of producing a full-color image by sequentially overlaying the plurality of color toner images formed on the surfaces of the plurality of color image bearing members and the monochrome toner image formed on the surface of the monochrome image bearing member onto the intermediate transfer member, and onto the recording medium, and a monochrome mode having a function of producing a monochrome image by stopping rotations of the plurality of color image bearing members, separating the intermediate transfer member from the plurality of color image bearing members, rotating the monochrome image bearing member, and transferring the monochrome toner image onto the intermediate transfer member, and onto the recording medium.

31. The image forming apparatus according to claim 30, wherein a rotation number of the at least one of the clock control motors of the first and second motors is controlled to be changed to set positions of the first and second gears to have a predetermined phase relationship therebetween, before the subsequent image forming operation starts in the color mode which is previously switched from the monochrome mode.

32. The image forming apparatus according to claim 30, wherein the control mechanism has a plurality of switchable surface linear velocities and a plurality of speed modes, the plurality of switchable surface linear velocities including:

a first surface linear velocity; and a second surface linear velocity which is slower than the first surface linear velocity, the plurality of speed modes including:

a full speed color mode having a function of rotating the plurality of color image bearing members, the monochrome image bearing member and the intermediate transfer member at the first surface linear velocity in the color mode;

a full speed monochrome mode having a function of rotating the monochrome image bearing member and the intermediate transfer member at the first surface linear velocity in the monochrome mode;

a low speed color mode having a function of rotating the plurality of color image bearing members, the monochrome image bearing member and the intermediate transfer member at the second surface linear velocity in the color mode; and a low speed monochrome mode having a function of rotating the monochrome image bearing member and the intermediate transfer member at the second surface linear velocity in the monochrome mode, and wherein a rotation number of the at least one of the clock control motors of the first and second motors is controlled to be changed to set positions of the first and second gears to have a predetermined phase relationship therebetween, before the subsequent image forming operation starts in one of the full speed color mode and the low speed color mode which is previously changed from different one of the full speed color mode, the low speed color mode, the full speed monochrome mode and the low speed monochrome mode.

33. An image forming apparatus comprising:

a plurality of color image bearing members having surfaces to bear a plurality of color toner images;

a monochrome image bearing member having a surface to bear a monochrome toner image;

an intermediate transfer member configured to receive the plurality of color toner images from the plurality of color image bearing members and the monochrome toner image from the monochrome image bearing member;

a first gear coupled with at least one of the plurality of color image bearing members;

a second gear coupled with the monochrome image bearing member;

a first motor including a clock control motor rotating the at least one of the plurality of color image bearing members via the first gear;

a second motor including the clock control motor rotating the monochrome image bearing member via the second gear;

a third motor rotating the intermediate transfer member;

a transfer mechanism configured to transfer the toner image from the intermediate transfer member to a recording medium;

a control mechanism configured to control rotations of the first, second and third motors;

a first sensor of the at least one sensor configured to detect a first position of the first gear in a circumferential direction of the first gear; and a second sensor of the at least one sensor configured to detect a second position of the second gear in a circumferential direction of the second gear, wherein the control mechanism controls rotation numbers of the clock control motors during at least one of rise and fall time periods in accordance with a predetermined velocity curve, a rotation number of at least one of the clock control motors of the first and second motors is controlled to be changed to set positions of the first and second gears to have a predetermined phase relationship therebetween, after completion of the rise time periods of the first and second motors and before start of a subsequent image forming operation, and the rotation number of at least one of the clock control motors of the first and second motors is controlled in accordance with a detection time difference between a first time period in which the first sensor detects the first position and a second time period in which the second sensor detects the second position, when the predetermined phase relationship between the first and second gears is adjusted.

34. The image forming apparatus according to claim 33, further comprising:

a third sensor configured to detect a third position of the first gear in a circumferential direction of the first gear; and a fourth sensor configured to detect a fourth position of the second gear in a circumferential direction of the second gear, wherein a rotation number of at least one of the clock control motors of the first and second motors is controlled in accordance with a value obtained by adding a predetermined correction value to a detection time difference between a third time period in which the third sensor detects the third position and a fourth time period in which the fourth sensor detects the fourth position, when the predetermined phase relationship between the first and second gears is adjusted.

35. An image forming apparatus, comprising:

a plurality of color image bearing members having surfaces to bear a plurality of color toner images;

a monochrome image bearing member having a surface to bear a monochrome toner image;

a recording medium bearing member configured to carry a recording medium to receive the plurality of color toner images from the plurality of color image bearing members and the monochrome toner image from the monochrome image bearing member;

a first gear coupled with at least one of the plurality of color image bearing members;

a second gear coupled with the monochrome image bearing member;

a first motor including a clock control motor rotating the at least one of the plurality of color image bearing members via the first gear;

a second motor including the clock control motor rotating the monochrome image bearing member to rotate via the second gear;

a third motor rotating the recording medium bearing member;

a transfer mechanism configured to transfer the toner image to a recording medium carried by the recording medium bearing member;

a control mechanism configured to control rotations of the first, second and third motors; and at least one sensor configured to start sensing when a rotation speed of at least one of the first motor and the second motor falls below a predetermined speed, wherein the control mechanism controls rotation numbers of the clock control motors during at least one of rise and fall time periods in accordance with a predetermined velocity curve.

36. An image forming apparatus, comprising:

a plurality of color image bearing members having surfaces to bear a plurality of color toner images;

a monochrome image bearing member having a surface to bear a monochrome toner image;

a recording medium bearing member configured to carry a recording medium to receive the plurality of color toner images from the plurality of color image bearing members and the monochrome toner image from the monochrome image bearing member;

a first gear coupled with at least one of the plurality of color image bearing members;

a second gear coupled with the monochrome image bearing member;

a first motor including a clock control motor rotating the at least one of the plurality of color image bearing members via the first gear;

a second motor including the clock control motor rotating the monochrome image bearing member to rotate via the second gear;

a third motor rotating the recording medium bearing member;

a transfer mechanism configured to transfer the toner image to a recording medium carried by the recording medium bearing member;

a control mechanism configured to control rotations of the first, second and third motors, wherein the control mechanism controls rotation numbers of the clock control motors during at least one of rise and fall time periods in accordance with a predetermined velocity curve, and a rotation number of at least one of the clock control motors of the first and second motors is controlled to be changed to set positions of the first and second gears to have a predetermined phase relationship, after completion of the rise time period of the first and second motors and before start of a subsequent image forming operation.

37. The image forming apparatus according to claim 36, wherein the control mechanism has a plurality of operation modes which are selectable and bi-directionally switchable without stopping the second and third motors, the plurality of operation modes including:

a color mode having a function of producing a full-color image by sequentially overlaying the plurality of color toner images formed on the surfaces of the plurality of color image bearing members and the monochrome toner image formed on the surface of the monochrome image bearing member onto the recording medium carried by the recording medium bearing member; and a monochrome mode having a function of producing a monochrome image by stopping rotations of the plurality of color image bearing members, separating the recording medium bearing member from the plurality of color image bearing members, rotating the monochrome image bearing member, and transferring the monochrome toner image onto the recording medium carried by the recording medium bearing member.

38. The image forming apparatus according to claim 37, wherein a rotation number of the at least one of the clock control motors of the first and second motors is controlled to be changed to set positions of the first and second gears to have a predetermined phase relationship, before the subsequent image forming operation starts in the color mode which is previously switched from the monochrome mode.

39. The image forming apparatus according to claim 37, wherein the control mechanism has a plurality of switchable surface linear velocities and a plurality of speed modes, the plurality of switchable surface linear velocities including:

a first surface linear velocity; and a second surface linear velocity which is slower than the first surface linear velocity, the plurality of speed modes including:

a full speed color mode having a function of rotating the plurality of color image bearing members, the monochrome image bearing member and the recording medium bearing member at the first surface linear velocity in the color mode;

a full speed monochrome mode having a function of rotating the monochrome image bearing member and the recording medium bearing member at the first surface linear velocity in the monochrome mode;

a low speed color mode having a function of rotating the plurality of color image bearing members, the monochrome image bearing member and the recording medium bearing member at the second surface linear velocity in the color mode; and a low speed monochrome mode having a function of rotating the monochrome image bearing member and the recording medium bearing member at the second surface linear velocity in the monochrome mode, and wherein a rotation number of the at least one of the clock control motors of the first and second motors is controlled to be changed to set positions of the first and second gears to have a predetermined phase relationship, before the subsequent image forming operation starts in one of the full speed color mode and the low speed color mode which is previously changed from different one of the full speed color mode, the low speed color mode, the full speed monochrome mode and the low speed monochrome mode.

40. The image forming apparatus according to claim 36, further comprising:

a first sensor configured to detect a first position of the first gear in a circumferential direction of the first gear; and a second sensor configured to detect a second position of the second gear in a circumferential direction of the second gear, wherein a rotation number of at least one of the clock control motors of the first and second motors is controlled in accordance with a detection time difference between a first time period in which the first sensor detects the first position and a second time period in which the second sensor detects the second position, when the predetermined phase relationship between the first and second gears is adjusted.

41. The image forming apparatus according to claim 36, further comprising:

a third sensor configured to detect a third position of the first gear in a circumferential direction of the first gear; and a fourth sensor configured to detect a fourth position of the second gear in a circumferential direction of the second gear, wherein a rotation number of at least one of the clock control motors of the first and second motors is controlled in accordance with a value obtained by adding a predetermined correction value to a detection time difference between a third time period in which the third sensor detects the third position and a fourth time period in which the fourth sensor detects the fourth position, when the predetermined phase relationship between the first and second gears is adjusted.

42. An image forming apparatus, comprising:

image bearing means for bearing a toner image;

intermediate transfer means for receiving the toner image from the image bearing means;

primary driving means for rotating the image bearing means;

secondary driving means for rotating the intermediate transfer means;

transfer means for transferring the toner image from the intermediate transfer means to a recording medium;

controlling means for controlling rotations of the primary driving means and the secondary driving means; and sensing means for sensing when a rotation speed of the primary driving means falls below a predetermined speed, wherein at least one of the primary driving means and the secondary driving means includes a clock control motor controlled by a command clock signal and a feedback signal, and the controlling means controls a rotation number of the clock control motor in accordance with a predetermined velocity curve during at least one of rise and fall time periods of the clock control motor.

43. The image forming apparatus according to claim 42, wherein the primary driving means includes the clock control motor, and the secondary driving means includes a stepping motor.

44. The image forming apparatus according to claim 42, wherein each of the primary driving means and the secondary driving means includes the clock control motor.

45. The image forming apparatus according to claim 42, wherein the clock control motor is controlled to be rotated by the command clock signal having the clock number in accordance with the predetermined velocity curve during the at least one of rise and fall time periods of the clock control motor.

46. The image forming apparatus according to claim 42, wherein the clock control motor is controlled to be rotated by the command clock signal having a gradually increasing pulse number during the rise time period, having a substantially constant pulse number during a steady rotation time period, and having a gradually decreasing pulse number during the fall time period.

47. The image forming apparatus according to claim 42, further comprising:

braking means for forcedly reducing a rotation number of the clock control motor during the fall time period of the clock control motor.

48. The image forming apparatus according to claim 42, wherein the rotation number of the clock control motor is controlled by changing a pulse number of the command clock signal in steps during the at least one of rise and fall time periods of the clock control motor.

49. The image forming apparatus according to claim 42, wherein the clock control motor includes a direct current brushless motor.

50. An image forming apparatus, comprising:

image bearing means for bearing a toner image;

intermediate transfer means for receiving the toner image from the image bearing means;

primary driving means for rotating the image bearing means;

secondary driving means for rotating the intermediate transfer means;

transfer means for transferring the toner image from the intermediate transfer means to a recording medium;

controlling means for controlling rotations of the primary driving means and the secondary driving means, wherein at least one of the primary driving means and the secondary driving means includes a clock control motor controlled by a command clock signal and a feedback signal, the controlling means controls a rotation number of the clock control motor in accordance with a predetermined velocity curve during at least one of rise and fall time periods of the clock control motor, and the predetermined velocity curve is stored in a memory and can be changed by controlling an operation panel of the image forming apparatus or a connecting terminal of the image forming apparatus.

51. An image forming apparatus, comprising:

plural color image bearing means for bearing color toner images;

monochrome image bearing means for bearing a monochrome toner image;

intermediate transfer means for receiving a toner image including the color toner images from the plural color image bearing means and the monochrome toner image from the monochrome image bearing means;

first coupling means for coupling with at least one of the plural color image bearing means;

second coupling means for coupling with the monochrome image bearing means;

primary driving means including a clock control motor for rotating the at least one of the plural color image bearing means via the first coupling means;

secondary driving means including the clock control motor for rotating the monochrome image bearing means via the second coupling means;

tertiary driving means for rotating the intermediate transfer means;

transfer means for transferring the toner image from the intermediate transfer means to a recording medium;

controlling means for controlling rotations of the primary, secondary, and tertiary driving means; and plural sensing means for sensing when a rotation speed of the primary driving means or the secondary driving means falls below a predetermined speed, wherein the controlling means controls rotation numbers of the clock control motors during at least one of rise and fall time periods in accordance with a predetermined velocity curve.

52. The image forming apparatus according to claim 51, wherein a rotation number of at least one of the clock control motors of the primary and secondary driving means is controlled to be changed to set positions of the first and second coupling means to have a predetermined phase relationship therebetween, after completion of the rise time periods of the primary and secondary driving means and before start of a subsequent image forming operation.

53. An image forming apparatus, comprising:

plural color image bearing means for bearing color toner images;

monochrome image bearing means for bearing a monochrome toner image;

intermediate transfer means for receiving a toner image including the color toner images from the plural color image bearing means and the monochrome toner image from the monochrome image bearing means;

first coupling means for coupling with at least one of the plural color image bearing means;

second coupling means for coupling with the monochrome image bearing means;

primary driving means including a clock control motor for rotating the at least one of the plural color image bearing means via the first coupling means;

secondary driving means including the clock control motor for rotating the monochrome image bearing means via the second coupling means;

tertiary driving means for rotating the intermediate transfer means;

transfer means for transferring the toner image from the intermediate transfer means to a recording medium;

controlling means for controlling rotations of the primary, secondary, and tertiary driving means, wherein the controlling means controls rotation numbers of the clock control motors during at least one of rise and fall time periods in accordance with a predetermined velocity curve the controlling means has a plurality of operation modes which are selectable and bi-directionally switchable without stopping the secondary and tertiary driving means, the plurality of operation includes:

a color mode having a function of producing a full-color image by sequentially overlaying the plurality of color toner images formed on the plural color image bearing means and the monochrome toner image formed on the monochrome image bearing means onto the intermediate transfer means, and onto the recording medium, and a monochrome mode having a function of producing a monochrome image by stopping rotations of the plural color image bearing means, separating the intermediate transfer means from the plural color image bearing means, rotating the monochrome image bearing means, and transferring the monochrome toner image onto the intermediate transfer means, and onto the recording medium.

54. The image forming apparatus according to claim 53, wherein a rotation number of the at least one of the clock control motors of the primary and secondary driving means is controlled to be changed to set positions of the first and second coupling means to have a predetermined phase relationship therebetween, before the subsequent image forming operation starts in the color mode which is previously switched from the monochrome mode.

55. The image forming apparatus according to claim 53, wherein the controlling means has a plurality of switchable surface linear velocities and a plurality of speed modes, the plurality of switchable surface linear velocities including:

a first surface linear velocity; and a second surface linear velocity which is slower than the first surface linear velocity, the plurality of speed modes including:

a full speed color mode having a function of rotating the plural color image bearing means, the monochrome image bearing means and the intermediate transfer means at the first surface linear velocity in the color mode;

a full speed monochrome mode having a function of rotating the monochrome image bearing means and the intermediate transfer means at the first surface linear velocity in the monochrome mode;

a low speed color mode having a function of rotating the plural color image bearing means, the monochrome image bearing means and the intermediate transfer means at the second surface linear velocity in the color mode; and a low speed monochrome mode having a function of rotating the monochrome image bearing means and the intermediate transfer means at the second surface linear velocity in the monochrome mode, and wherein a rotation number of the at least one of the clock control motors of the primary and secondary driving means is controlled to be changed to set positions of the first and second coupling means to have a predetermined phase relationship therebetween, before the subsequent image forming operation starts in one of the full speed color mode and the low speed color mode which is previously changed from different one of the full speed color mode, the low speed color mode, the full speed monochrome mode and the low speed monochrome mode.

56. An image forming apparatus, comprising:

plural color image bearing means for bearing color toner images;

monochrome image bearing means for bearing a monochrome toner image;

intermediate transfer means for receiving a toner image including the color toner images from the plural color image bearing means and the monochrome toner image from the monochrome image bearing means;

first coupling means for coupling with at least one of the plural color image bearing means;

second coupling means for coupling with the monochrome image bearing means;

primary driving means including a clock control motor for rotating the at least one of the plural color image bearing means via the first coupling means;

secondary driving means including the clock control motor for rotating the monochrome image bearing means via the second coupling means;

tertiary driving means for rotating the intermediate transfer means;

transfer means for transferring the toner image from the intermediate transfer means to a recording medium;

controlling means for controlling rotations of the primary, secondary, and tertiary driving means;

first sensing means of the plural sensing means for detecting a first position of the first coupling means in a circumferential direction of the first coupling means; and second sensing means of the plural sensing means for detecting a second position of the second coupling means in a circumferential direction of the second coupling means, wherein the controlling means controls rotation numbers of the clock control motors during at least one of rise and fall time periods in accordance with a predetermined velocity curve, a rotation number of at least one of the clock control motors of the primary and secondary driving means is controlled to be changed to set positions of the first and second coupling means to have a predetermined phase relationship therebetween, after completion of the rise time periods of the primary and secondary driving means and before start of a subsequent image forming operation, and the rotation number of at least one of the clock control motors of the primary and secondary driving means is controlled in accordance with a detection time difference between a first time period in which the first sensing means detects the first position and a second time period in which the second sensing means detects the second position, when the predetermined phase relationship between the first and second coupling means is adjusted.

57. The image forming apparatus according to claim 56, further comprising:

third sensing means of the plural sensing means for detecting a third position of the first coupling means in a circumferential direction of the first coupling means; and fourth sensing means of the plural sensing means for detecting a fourth position of the second coupling means in a circumferential direction of the second coupling means, wherein a rotation number of at least one of the clock control motors of the primary and secondary driving means is controlled in accordance with a value obtained by adding a predetermined correction value to a detection time difference between a third time period in which the third sensing means detects the third position and a fourth time period in which the fourth sensing means detects the fourth position, when the predetermined phase relationship between the first and second coupling means is adjusted.

58. An image forming method, comprising:

rotating an image bearing member with a primary motor;

rotating an intermediate transfer member with a secondary motor;

forming a toner image on the image bearing member;

receiving the toner image from the image bearing member on the intermediate transfer member;

transferring the toner image from the intermediate transfer member to a recording medium;

controlling rotations of the primary motor and the secondary motor; and sensing when a rotation speed of the primary motor falls below a predetermined speed, wherein at least one of the primary motor and the secondary motor includes a clock control motor controlled by a command clock signal and a feedback signal, and wherein the controlling step controls a rotation number of the clock control motor in accordance with a predetermined velocity curve during at least one of rise and fall time periods of the clock control motor.

59. The image forming method according to claim 58, wherein the primary motor includes the clock control motor, and the secondary motor includes a stepping motor.

60. The image forming method according to claim 58, wherein each of the primary motor and the secondary motor includes the clock control motor.

61. The image forming method according to claim 58, wherein the clock control motor is controlled to be rotated by the command clock signal having the clock number in accordance with the predetermined velocity curve during the at least one of rise and fall time periods of the clock control motor.

62. The image forming method according to claim 58, wherein the clock control motor is controlled to be rotated by the command clock signal having a gradually increasing pulse number during the rise time period, having a substantially constant pulse number during a steady rotation time period, and having a gradually decreasing pulse number during the fall time period.

63. The image forming method according to claim 58, further comprising:

forcedly reducing a rotation number of the clock control motor during the fall time period of the clock control motor.

64. The image forming method according to claim 58, wherein the rotation number of the clock control motor is controlled by changing a pulse number of the command clock signal in steps during the at least one of rise and fall time periods of the clock control motor.

65. The image forming method according to claim 58, wherein the clock control motor includes a direct current brushless motor.

66. An image forming method, rotating an image bearing member with a primary motor;

rotating an intermediate transfer member with a secondary motor;

forming a toner image on the image bearing member;

receiving the toner image from the image bearing member on the intermediate transfer member;

transferring the toner image from the intermediate transfer member to a recording medium; and controlling rotations of the primary motor and the secondary motor, wherein at least one of the primary motor and the secondary motor includes a clock control motor controlled by a command clock signal and a feedback signal, the controlling step controls a rotation number of the clock control motor in accordance with a predetermined velocity curve during at least one of rise and fall time periods of the clock control motor, and the predetermined velocity curve is stored in a memory and can be changed by controlling an operation panel or a connecting terminal.

67. An image forming method, comprising:

rotating at least one color image bearing member of a plurality of color image bearing members with a primary motor that includes a clock control motor coupled to the at least one color image bearing member via a first gear;

rotating a monochrome image bearing member with a secondary motor that includes the clock control motor coupled to the monochrome image bearing member via a second gear;

rotating an intermediate transfer member with a tertiary motor;

forming, on the intermediate transfer member, a toner image including a color toner images from the plurality of color image bearing members and a monochrome toner image from the monochrome image bearing member;

transferring the toner image from the intermediate transfer member to a recording medium using a transfer mechanism;

controlling the rotations of the primary, secondary, and tertiary motors using a control mechanism; and sensing when a rotation speed of at least one of the primary motor and the secondary motor falls below a predetermined speed, wherein the control mechanism controls rotation numbers of the clock control motors during at least one of rise and fall time periods in accordance with a predetermined velocity curve.

68. An image forming method, comprising:

rotating at least one color image bearing member of a plurality of color image bearing members with a primary motor that includes a clock control motor coupled to the at least one color image bearing member via a first gear;

rotating a monochrome image bearing member with a secondary motor that includes the clock control motor coupled to the monochrome image bearing member via a second gear;

rotating an intermediate transfer member with a tertiary motor;

forming, on the intermediate transfer member, a toner image including a color toner images from the plurality of color image bearing members and a monochrome toner image from the monochrome image bearing member;

transferring the toner image from the intermediate transfer member to a recording medium using a transfer mechanism; and controlling the rotations of the primary, secondary, and tertiary motors using a control mechanism, wherein the control mechanism controls rotation numbers of the clock control motors during at least one of rise and fall time periods in accordance with a predetermined velocity curve, and a rotation number of at least one of the clock control motors of the primary and secondary motors is controlled to be changed to set positions of the first and second gears to have a predetermined phase relationship therebetween, after completion of the rise time periods of the primary and secondary motors and before start of a subsequent image forming operation.

69. The image forming method according to claim 68, wherein the controlling mechanism has a plurality of operation modes which are selectable and bi-directionally switchable without stopping the secondary and tertiary motors, the plurality of operation modes including:

a color mode having a function of producing a full-color image by sequentially overlaying the plurality of color toner images formed on the plurality of color image bearing members and the monochrome toner image formed on the monochrome image bearing member onto the intermediate transfer member, and onto the recording medium; and a monochrome mode having a function of producing a monochrome image by stopping rotations of the plurality color image bearing members, separating the intermediate transfer member from the plurality of color image bearing members, rotating the monochrome image bearing member, and transferring the monochrome toner image onto the intermediate transfer member, and onto the recording medium.

70. The image forming method according to claim 69, wherein a rotation number of the at least one of the clock control motors of the primary and secondary motors is controlled to be changed to set positions of the first and second gears to have a predetermined phase relationship therebetween, before the subsequent image forming operation starts in the color mode which is previously switched from the monochrome mode.

71. The image forming method according to claim 69, wherein the controlling mechanism has a plurality of switchable surface linear velocities and a plurality of speed modes, the plurality of switchable surface linear velocities including:

a first surface linear velocity; and a second surface linear velocity which is slower than the first surface linear velocity, the plurality of speed modes including:

a full speed color mode having a function of rotating the plurality of color image bearing members, the monochrome image bearing member and the intermediate transfer member at the first surface linear velocity in the color mode;

a full speed monochrome mode having a function of rotating the monochrome image bearing member and the intermediate transfer member at the first surface linear velocity in the monochrome mode;

a low speed color mode having a function of rotating the plurality of color image bearing members, the monochrome image bearing member and the intermediate transfer member at the second surface linear velocity in the color mode; and a low speed monochrome mode having a function of rotating the monochrome image bearing member and the intermediate transfer member at the second surface linear velocity in the monochrome mode, and wherein a rotation number of the at least one of the clock control motors of the primary and secondary motors is controlled to be changed to set positions of the first and second gears to have a predetermined phase relationship therebetween, before the subsequent image forming operation starts in one of the full speed color mode and the low speed color mode which is previously changed from different one of the full speed color mode, the low speed color mode, the full speed monochrome mode and the low speed monochrome mode.

72. The image forming method according to claim 68, further comprising:

detecting a first position of the first gear in a circumferential direction of the first gear using a first sensor; and detecting a second position of the second gear in a circumferential direction of the second gear using a second sensor, wherein a rotation number of at least one of the clock control motors of the primary and secondary motors is controlled in accordance with a detection time difference between a first time period in which the first sensor detects the first position and a second time period in which the second sensor detects the second position, when the predetermined phase relationship between the first and second gears is adjusted.

73. The image forming method according to claim 68, further comprising:

detecting a third position of the first gear in a circumferential direction of the first gear using a third sensor; and detecting a fourth position of the second gear in a circumferential direction of the second gear using a fourth sensor, wherein a rotation number of at least one of the clock control motors of the primary and secondary motors is controlled in accordance with a value obtained by adding a predetermined correction value to a detection time difference between a third time period in which the third sensor detects the third position and a fourth time period in which the fourth sensor detects the fourth position, when the predetermined phase relationship between the first and second gears is adjusted.

* * * * *